US007316140B2

(12) United States Patent
Russell et al.

(10) Patent No.: US 7,316,140 B2
(45) **Date of Patent: *Jan. 8, 2008**

(54) ELECTRONIC TOKEN AND LOCK CORE

(75) Inventors: Roger Keith Russell, Indianapolis, IN (US); James Edmond Beylotte, Indianapolis, IN (US); Ralph P. Palmer, Indianapolis, IN (US)

(73) Assignee: Stanley Security Solutions, Inc., Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/032,745

(22) Filed: Jan. 11, 2005

(65) Prior Publication Data

US 2005/0144995 A1 Jul. 7, 2005

Related U.S. Application Data

(63) Continuation of application No. 10/688,536, filed on Oct. 17, 2003, now Pat. No. 6,840,072, which is a continuation of application No. 10/115,749, filed on Apr. 3, 2002, now Pat. No. 6,668,606, which is a continuation of application No. 09/287,981, filed on Apr. 7, 1999, now Pat. No. 6,442,986.

(60) Provisional application No. 60/080,974, filed on Apr. 7, 1998.

(51) Int. Cl.
*E05B 47/06* (2006.01)

(52) U.S. Cl. ..... 70/278.3; 70/278.7; 70/283.1; 70/359; 70/371

(58) Field of Classification Search ..... 70/278.2, 70/278.3, 278.6, 278.7, 279.1, 283, 283.1, 70/277, 367–369, 359, 371
See application file for complete search history.

(56) References Cited

U.S. PATENT DOCUMENTS 2,105,304 A 1/1938 Wagner (Continued)

FOREIGN PATENT DOCUMENTS

DE 2739062 3/1978

(Continued)

OTHER PUBLICATIONS

Brochure entitled "Lori Lock—Security Door Hardware," 08710/LS, BuyLine 2056, pp. 1-8, published by Lori Corporation, date unknown.

(Continued)

*Primary Examiner*—Lloyd A. Gall
(74) *Attorney, Agent, or Firm*—Baker & Daniels LLP

(57) ABSTRACT

A lock system is provided including a lock core and a token. The lock core comprises a core body, a lock actuator coupled to the core body for rotation about an axis, a blocking body, and a solenoid. The solenoid has a shaft that is movable between a first position in which the blocking body is locked to prevent rotation of the lock actuator about the axis and a second position in which the blocking body is unlocked to allow rotation of the lock actuator about the axis. The token is couplable mechanically to the lock actuator. The solenoid moves the shaft from the first position to the second position so that the blocking body is unlocked if the token has a valid access code.

24 Claims, 39 Drawing Sheets

U.S. PATENT DOCUMENTS

| | | | |
|---|---|---|---|
| 3,136,307 | A | 6/1964 | Richard |
| 3,160,792 | A | 12/1964 | Brendemuehl et al. |
| 3,283,550 | A | 11/1966 | Bradway |
| 3,296,842 | A | 1/1967 | Auerbach et al. |
| 3,347,072 | A | 10/1967 | Rose |
| 3,392,559 | A | 7/1968 | Hedin et al. |
| 3,579,183 | A | 5/1971 | Lipschutz |
| 3,599,454 | A | 8/1971 | Hill et al. |
| 3,639,906 | A | 2/1972 | Tritsch |
| 3,660,624 | A | 5/1972 | Bell |
| 3,660,831 | A | 5/1972 | Nicola et al. |
| 3,798,398 | A | 3/1974 | Hills |
| 3,889,501 | A | 6/1975 | Fort |
| 3,958,105 | A | 5/1976 | Sidlauskas |
| 3,970,824 | A | 7/1976 | Walton et al. |
| 4,137,985 | A | 2/1979 | Winchell |
| 4,142,389 | A | 3/1979 | Bahry et al. |
| 4,142,674 | A | 3/1979 | Walton |
| 4,148,372 | A | 4/1979 | Schroeder |
| 4,176,782 | A | 12/1979 | Fukuda et al. |
| 4,192,400 | A | 3/1980 | McEwan |
| 4,200,227 | A | 4/1980 | Lemelson |
| 4,205,325 | A | 5/1980 | Haygood et al. |
| 4,250,533 | A | 2/1981 | Nelson |
| 4,257,030 | A | 3/1981 | Bruhin et al. |
| 4,267,494 | A | 5/1981 | Matsuoka et al. |
| 4,291,237 | A | 9/1981 | Kitano |
| 4,292,541 | A | 9/1981 | Ambrosius |
| 4,297,569 | A | 10/1981 | Flies |
| 4,298,792 | A | 11/1981 | Granholm et al. |
| 4,326,125 | A | 4/1982 | Flies |
| 4,327,353 | A | 4/1982 | Beard et al. |
| 4,366,466 | A | 12/1982 | Lutz |
| 4,415,893 | A | 11/1983 | Roland et al. |
| 4,420,794 | A | 12/1983 | Anderson |
| 4,435,649 | A | 3/1984 | Vandigriff |
| 4,436,993 | A | 3/1984 | Flies |
| 4,438,426 | A | 3/1984 | Adkins |
| 4,458,512 | A | 7/1984 | Gelhard |
| 4,507,944 | A | 4/1985 | Widen et al. |
| 4,511,946 | A | 4/1985 | McGahan |
| 4,526,256 | A | 7/1985 | Urdal |
| 4,562,712 | A | 1/1986 | Wolter |
| 4,603,564 | A | 8/1986 | Kleinhany et al. |
| 4,635,455 | A | 1/1987 | Oliver |
| 4,663,952 | A | 5/1987 | Gelhard |
| 4,686,358 | A | 8/1987 | Seckinger et al. |
| 4,697,171 | A | 9/1987 | Suh |
| 4,703,293 | A | 10/1987 | Ono et al. |
| 4,704,884 | A | 11/1987 | Sugimoto |
| 4,712,398 | A | 12/1987 | Clarkson et al. |
| 4,726,205 | A | 2/1988 | Allerdist et al. |
| 4,734,693 | A | 3/1988 | Dluhosch et al. |
| 4,749,072 | A | 6/1988 | Lichty et al. |
| 4,771,620 | A | 9/1988 | Kleinhany |
| 4,789,859 | A | 12/1988 | Clarkson et al. |
| 4,791,280 | A | 12/1988 | O'Connell et al. |
| 4,807,454 | A | 2/1989 | Sengupta et al. |
| 4,835,407 | A | 5/1989 | Kataoka et al. |
| 4,837,822 | A | 6/1989 | Crosley et al. |
| 4,848,115 | A | 7/1989 | Clarkson et al. |
| 4,849,749 | A | 7/1989 | Fukamachi et al. |
| 4,858,453 | A | 8/1989 | Namazue |
| 4,864,292 | A | 9/1989 | Nieuwkoop |
| 4,866,962 | A | 9/1989 | Aston et al. |
| 4,866,964 | A | 9/1989 | Hall |
| 4,868,409 | A | 9/1989 | Tanaka et al. |
| 4,870,401 | A | 9/1989 | Lee et al. |
| 4,916,927 | A | 4/1990 | O'Connell et al. |
| 4,922,736 | A | 5/1990 | Tanaka et al. |
| 4,924,686 | A | 5/1990 | Vonlanthen |
| 4,939,915 | A | 7/1990 | Vonlanthen |
| 4,943,804 | A | 7/1990 | Lee et al. |
| 4,945,269 | A | 7/1990 | Kamm |
| 4,947,662 | A | 8/1990 | Imedio |
| 4,972,694 | A | 11/1990 | Aulbers et al. |
| 4,982,587 | A | 1/1991 | Tzou |
| 4,998,952 | A | 3/1991 | Hyatt, Jr. et al. |
| 5,003,801 | A | 4/1991 | Stinar et al. |
| 5,005,393 | A | 4/1991 | Ewalds et al. |
| 5,010,331 | A | 4/1991 | Dias et al. |
| 5,010,750 | A | 4/1991 | Boser et al. |
| 5,010,754 | A | 4/1991 | DeAngelo et al. |
| 5,019,812 | A | 5/1991 | Gostahagberg et al. |
| 5,076,081 | A | 12/1991 | Boris, Jr. |
| 5,079,435 | A | 1/1992 | Tanaka |
| 5,086,288 | A | 2/1992 | Stramer |
| 5,086,557 | A | 2/1992 | Hyatt, Jr. |
| 5,087,090 | A | 2/1992 | Humphrey et al. |
| 5,088,306 | A | 2/1992 | Field |
| 5,117,097 | A | 5/1992 | Kimura et al. |
| 5,131,038 | A | 7/1992 | Puhl et al. |
| 5,132,661 | A | 7/1992 | Pinnow |
| 5,140,317 | A | 8/1992 | Hyatt, Jr. et al. |
| 5,186,031 | A | 2/1993 | Janssen et al. |
| D333,972 | S | 3/1993 | Hyatt, Jr. et al. |
| 5,195,341 | A | 3/1993 | Nieuwkoop |
| 5,228,730 | A | 7/1993 | Gokcebay et al. |
| 5,229,648 | A | 7/1993 | Sues et al. |
| 5,245,329 | A | 9/1993 | Gokcebay |
| 5,254,842 | A | 10/1993 | Posner et al. |
| 5,289,177 | A | 2/1994 | Wake |
| 5,309,743 | A | 5/1994 | Kokubu et al. |
| 5,311,757 | A | 5/1994 | Spahn |
| 5,319,362 | A | 6/1994 | Hyatt, Jr. |
| 5,337,043 | A | 8/1994 | Gokcebay |
| 5,337,588 | A | 8/1994 | Chhatwal |
| 5,351,042 | A | 9/1994 | Aston |
| 5,367,295 | A | 11/1994 | Gokcebay et al. |
| 5,373,718 | A | 12/1994 | Schwerdt et al. |
| 5,423,198 | A | 6/1995 | DiVito et al. |
| 5,433,096 | A | 7/1995 | Janssen et al. |
| 5,441,022 | A | 8/1995 | Yoder et al. |
| 5,442,243 | A | 8/1995 | Bailey |
| 5,469,727 | A | 11/1995 | Spahn et al. |
| 5,475,996 | A | 12/1995 | Chen |
| 5,479,799 | A | 1/1996 | Kilman et al. |
| 5,507,162 | A | 4/1996 | Chhatwal |
| 5,526,662 | A | 6/1996 | Diekhoff et al. |
| 5,532,522 | A | 7/1996 | Dietz et al. |
| 5,540,069 | A | 7/1996 | Muller et al. |
| 5,542,274 | A | 8/1996 | Thordmark et al. |
| 5,552,777 | A | 9/1996 | Gokcebay et al. |
| 5,561,420 | A | 10/1996 | Kleefeldt et al. |
| 5,561,430 | A | 10/1996 | Knebelkamp |
| 5,561,997 | A | 10/1996 | Milman |
| 5,604,489 | A | 2/1997 | Hyatt, Jr. |
| 5,605,067 | A | 2/1997 | Juan |
| 5,628,217 | A | 5/1997 | Herrera |
| 5,632,168 | A | 5/1997 | Yano |
| 5,636,540 | A | 6/1997 | Myers |
| 5,640,863 | A | 6/1997 | Frolov |
| 5,671,621 | A | 9/1997 | Watanuki et al. |
| 5,685,182 | A | 11/1997 | Chhatwal |
| 5,699,686 | A | 12/1997 | Neumayer et al. |
| 5,724,028 | A | 3/1998 | Prokup |
| 5,745,044 | A | 4/1998 | Hyatt, Jr. et al. |
| 5,749,253 | A | 5/1998 | Glick et al. |
| 5,768,925 | A | 6/1998 | Ozawa et al. |
| 5,771,722 | A | 6/1998 | DiVito et al. |
| 5,775,148 | A | 7/1998 | Layton et al. |
| 5,791,178 | A | 8/1998 | Chamberlain et al. |
| 5,816,085 | A | 10/1998 | Winardi et al. |
| 5,819,564 | A | 10/1998 | Watanuki |

| | | | | |
|---|---|---|---|---|
| 5,823,027 | A | 10/1998 | Glick et al. | |
| 5,823,028 | A | 10/1998 | Mizumo et al. | |
| 5,826,449 | A | 10/1998 | Dupuis et al. | |
| 5,826,450 | A | 10/1998 | Lerchner et al. | |
| 5,836,187 | A | 11/1998 | Janssen et al. | |
| 5,841,363 | A | 11/1998 | Jakob et al. | |
| 5,870,913 | A | 2/1999 | Kohzu | |
| 5,870,915 | A | 2/1999 | D'Hont | |
| 6,000,609 | A | 12/1999 | Gokcebay et al. | |
| 6,005,487 | A | 12/1999 | Hyatt, Jr. et al. | |
| 6,035,675 | A | 3/2000 | Zimmer et al. | |
| 6,125,673 | A | 10/2000 | Luker | |
| 6,209,367 | B1 | 4/2001 | Hyatt, Jr. et al. | |
| 6,227,020 | B1 | 5/2001 | Lerchner | |
| 6,374,653 | B1 | 4/2002 | Gokcebay et al. | |
| 6,442,986 | B1 | 9/2002 | Russell et al. | |
| 6,474,122 | B2 | 11/2002 | Davis | |
| 6,564,601 | B2 | 5/2003 | Hyatt Jr. | |
| 6,588,243 | B1 | 7/2003 | Hyatt, Jr. et al. | |
| 6,668,606 | B1 | 12/2003 | Russell et al. | |
| 6,840,072 | B2 * | 1/2005 | Russell et al. | 70/278.3 |
| 2001/0040492 | A1 | 11/2001 | Hyatt, Jr. et al. | |
| 2002/0189307 | A1 | 12/2002 | Gokcebay et al. | |
| 2003/0205071 | A1 | 11/2003 | Hyatt, Jr. | |
| 2003/0221466 | A1 | 12/2003 | Hyatt, Jr. et al. | |

FOREIGN PATENT DOCUMENTS

| | | |
|---|---|---|
| DE | 2828336 | 1/1980 |
| DE | 3008728 | 9/1981 |
| EP | 0 065 182 A2 | 11/1982 |
| EP | 0 168 884 | 1/1986 |
| EP | 0 248 488 A2 | 12/1987 |
| EP | 0 248 488 B1 | 12/1987 |
| EP | 0 276 037 A2 | 7/1988 |
| EP | 0 276 037 B1 | 7/1988 |
| EP | 0 494 472 A1 | 7/1992 |
| FR | 1380749 | 10/1964 |
| FR | 2363837 | 3/1978 |
| GB | 1401281 | 7/1975 |
| WO | WO 87/00234 | 1/1987 |
| WO | WO 92/07156 | 4/1992 |
| WO | WO 92/07342 | 4/1992 |

OTHER PUBLICATIONS

Brochure entitled "Solitaire Plus Applications/Specifications," published by Marlock Company, date unknown.

The National Locksmith, "Falcon's Gibraltar System 2000," by Paul Hoos, pp. 20-23, dated Mar. 27, 1986.

* cited by examiner

ELECTRONIC TOKEN AND LOCK CORE

CROSS-REFERENCE TO RELATED APPLICATIONS

This application is a continuation of U.S. patent application Ser. No. 10/688,536, now U.S. Pat. No. 6,840,072, filed Oct. 17, 2003, which is a continuation of U.S. patent application Ser. No. 10/115,749, now U.S. Pat. No. 6,668,606, filed on Apr. 3, 2002, which is a continuation of U.S. patent application Ser. No. 09/287,981, filed on Apr. 7, 1999, now U.S. Pat. No. 6,442,986, which claimed the benefit of U.S. Provisional Patent Application Ser. No. 60/080,974, filed on Apr. 7, 1998, the disclosures of which are hereby incorporated by reference herein in their entirety.

BACKGROUND AND SUMMARY OF THE INVENTION

The present invention relates to electronic tokens and lock cores that cooperate to determine if access should be granted to the user of the token. More particularly, the present invention relates to electronic lock cores that are interchangeable.

Conventional locksets include a lock cylinder, a lock core that fits within the lock cylinder, and a token that cooperates with the lock core. The lock cylinder can take many forms. For example, the lock cylinder may be a padlock or part of a mortise lockset or cylindrical lockset. No matter what form the lock cylinder takes, the lock cylinder includes an opening that receives the lock core. Traditionally, the lock cores have included mechanical features that cooperated with a mechanical token to determine if the user of the token is granted or denied access through the lockset. See, for example, U.S. Pat. Nos. 4,424,693, 4,444,034, and 4,386,510.

Electronic access control systems interrogate a token having stored codes therein and compare the token codes with valid access codes before providing access to an area. See, for example, U.S. Pat. No. 5,351,042. If the token being interrogated has a valid access code, the electronic access control system interacts with portions of a lockset to permit the user of the token to gain access to the area protected by the lockset.

Access control systems may include mechanical and electrical access components to require that a token include both a valid "mechanical code", for example, an appropriately configured bitted blade to properly position mechanical tumblers, and the valid electronic access code before the user of the token is granted access. See, for example, U.S. Pat. Nos. 5,826,450, 5,768,925, and 5,685,182. Many of these electromechanical access control systems use power sources and access code validation systems which are not situated in the lock core and token and are thus connected by separate circuitry to the lock core.

According to one aspect of the present invention, a lock system is provided that includes a core body, a lock actuator, a return spring, a solenoid, and a token. The lock actuator is coupled to the core body for rotation about an axis. The blocking body is movable between a first position blocking rotation of the lock actuator about the axis and a second position permitting rotation of the lock actuator about the axis. The return spring biases the blocking body toward the first position. The solenoid has a shaft that is movable between a first position in which the blocking body is locked to prevent rotation of the lock actuator about the axis and a second position in which the blocking body is unlocked to allow rotation of the lock actuator about the axis. Movement of the shaft of the solenoid permits biasing of the return spring. The token is couplable to the lock actuator and the solenoid moves the shaft from the first position to the second position after the token is coupled to the lock actuator.

According to another aspect of the present invention, a lock system is provided that includes a core body, a lock actuator, a blocking body, a solenoid, and a token. The lock actuator is coupled to the core body for rotation about an axis. The blocking body is movable between a first position blocking rotation of the lock actuator about the axis and a second position permitting rotation of the lock actuator about the axis. The solenoid has a shaft movable between a first position in which the blocking body is locked to prevent rotation of the lock actuator about the axis and a second position in which the blocking body is unlocked to allow rotation of the lock actuator about the axis. The token is couplable to the lock actuator to control movement of the shaft between the first and second positions. Mechanical energy is transmitted through the token that urges the blocking body to the second position after the solenoid moves the shaft to the second position.

According to another aspect of the present disclosure, a lock system is provided that includes a core body, lock actuator, blocking body, return spring, solenoid, and token. The lock actuator is coupled to the core body for rotation about an axis. The blocking body is movable between a first position blocking rotation of the lock actuator about the axis and a second position permitting rotation of the lock actuator about the axis. The blocking body has a longitudinal axis. The return spring is positioned along the longitudinal axis of the blocking body that biases the blocking body toward the first position. The solenoid has a shaft movable between a first position in which the blocking body is locked to prevent rotation of the lock actuator about the axis and a second position in which the blocking body is unlocked to allow rotation of the lock actuator about the axis. The token is couplable to the lock actuator to control movement of the shaft between the first and second positions.

Additional features of the present invention will become apparent to those skilled in the art upon consideration of the following detailed description of preferred embodiments exemplifying the best mode of carrying out the invention as presently perceived.

DETAILED DESCRIPTION OF THE DRAWINGS

Figure 1:
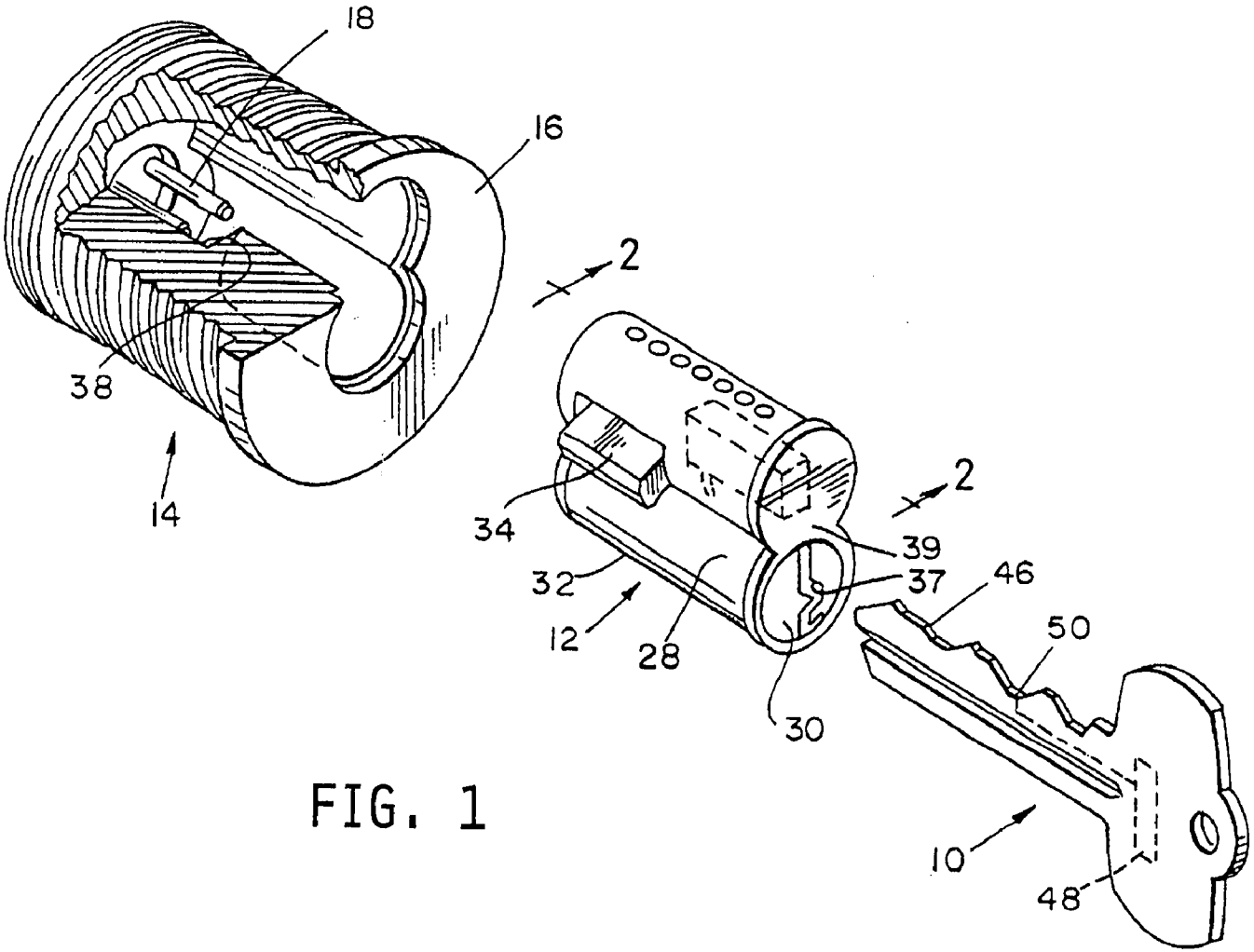
FIG. 1 is a perspective view of a token, a lock core, and a lock cylinder, the lock cylinder being formed to include an aperture to receive the lock core, and the lock core being formed to include a passageway to receive the token.

An electronic token 10 and lock core 12 in accordance with the present invention are shown in FIG. 1. The electronic token 10 and lock core 12 are components of a lockset that is installed in an entryway to restrict access through the entryway to valid individuals. The electronic token 10 and core 12 may include mechanical, electrical, and/or electrical/mechanical features that are used to grant or deny access to the user of the token 10. The electronic lock core 12 is interchangeable with a conventional lock core as shown, for example, in U.S. Pat. Nos. 4,444,034, 4,386,510, and 4,424,693. Thus, to change from a conventional mechanical lock core to the electronic lock core 12, a user must simply remove the mechanical lock core from the lock cylinder 14 and insert the electronic lock core 12 in the same lock cylinder 14.

Additional lockset components shown in FIG. 1 include a conventional lock cylinder 14 having a lock core-receiving aperture 16 and a throw member 18. In alternative embodiments of the present invention, the cylinder may be replaced by a padlock or any other type of closure or housing that accepts lock cores 12. Throw member 18 is a conventional lockset component and functions to transfer rotation or any type of movement induced by a token from lock core 12 to the rest of a lockset. In alternative embodiments, the throw member 18 may be replaced with any type of mechanism that performs the function of transferring rotation from the lock core 12 to the rest of the lockset.

The electronic lock core 12 and token 10 operate as a standalone unit and thus lock core 12 does not need to be hard-wired into an electrical system. All power required by lock core 12 and token 10 come from lock core 12 and token 10. In addition, any other features of the locking system such as access tracking, recombination, clock, display feedback, etc. must be contained within the token 10 and/or lock core 12.

Figure 2:
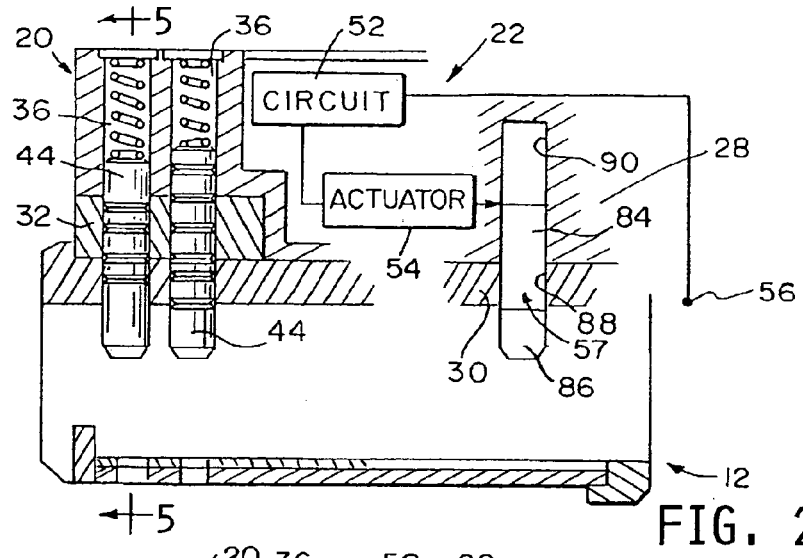
FIG. 2 is a sectional view, taken along line 2-2 of FIG. 1, showing the lock core including a mechanical portion having two tumbler pin barrels on the left side of the lock core and an electrical portion having a circuit, actuator, and mechanical linkage.
Figure 3:
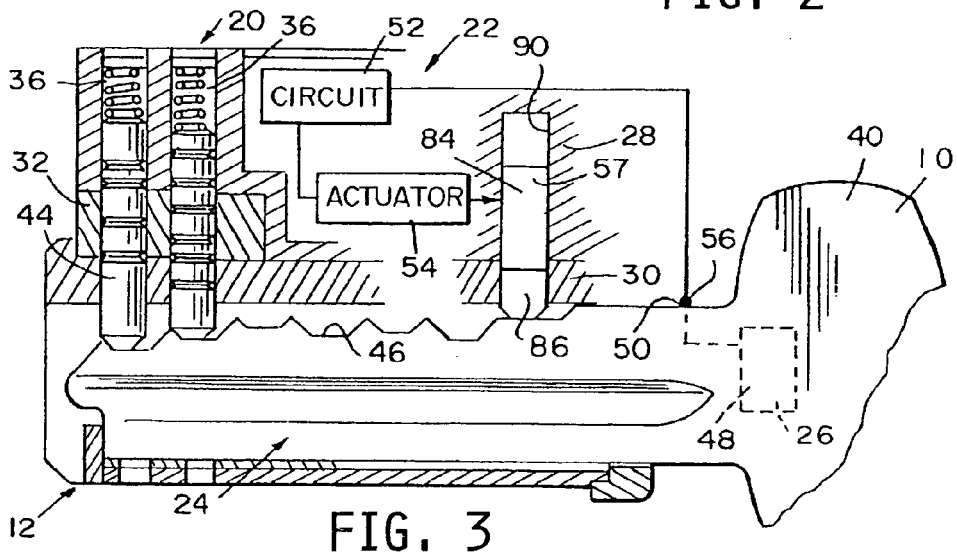
FIG. 3 is a sectional view similar to FIG. 2 showing the token positioned to lie in the passageway formed in the lock core, the token including a mechanical portion (bitted blade) and an electrical portion (phantom lines), the mechanical portion of the token interacting with the mechanical portion of the lock core, and the token engaging the mechanical linkage of the electrical portion of the lock core.
Figure 4:
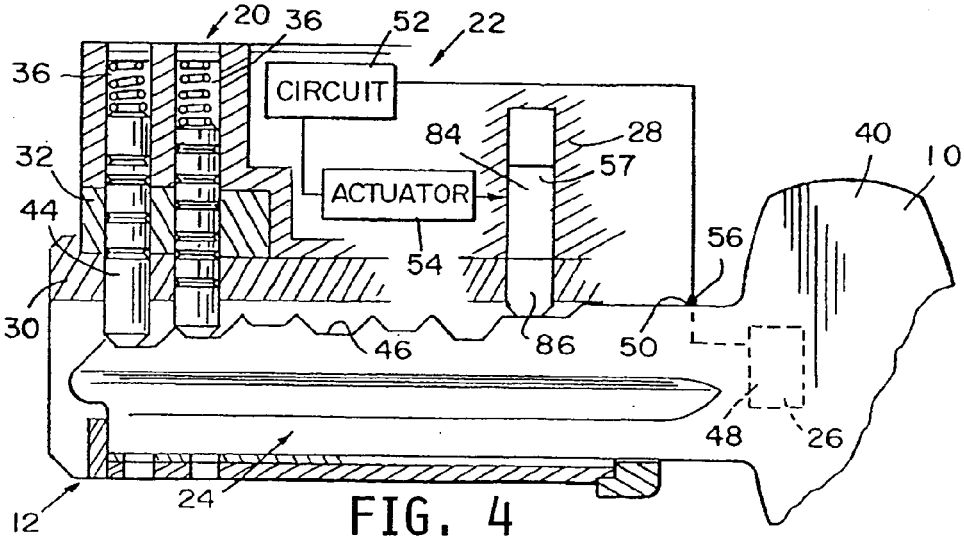
FIG. 4 is a sectional view similar to FIGS. 2 and 3 showing the circuit and actuator moving the mechanical linkage to permit the token to operate the lock core.

The lock core 12 includes a mechanical portion 20 and an electrical portion 22 that must be satisfied to permit an individual access through the entryway restricted by lock core 12 as shown in FIGS. 2-4. The token 10 also includes a mechanical portion 24 and an electrical portion 26 that cooperate with the mechanical and electrical portions 20, 22 of the lock core 12 to determine if the user of token 10 is permitted to operate the lockset.

Lock core 12 includes a core body 28, a key plug or lock actuator 30 positioned to lie in core body 28, a control sleeve 32 positioned to lie in core body 28, a control lug 34 coupled to control sleeve 32, pin tumbler barrels 36 positioned to lie partially in core body 28 and partially in the key plug 30, and a face plate 39 as shown, for example, in FIGS. 1-7. The pin tumbler barrels 36 comprise the mechanical portion 20 of lock core 12.

Figure 6:
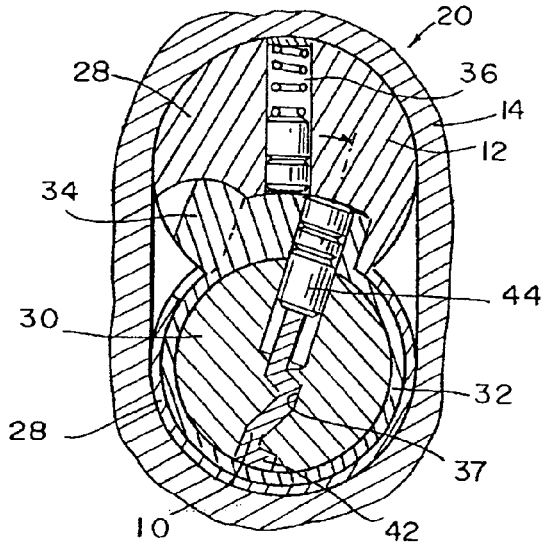
FIG. 6 is a sectional view similar to FIG. 5 showing a control token inserted into the lock core and biasing the tumbler pins so that rotation of the control token rotates the control sleeve and key plug relative to the core body.
Figure 7:
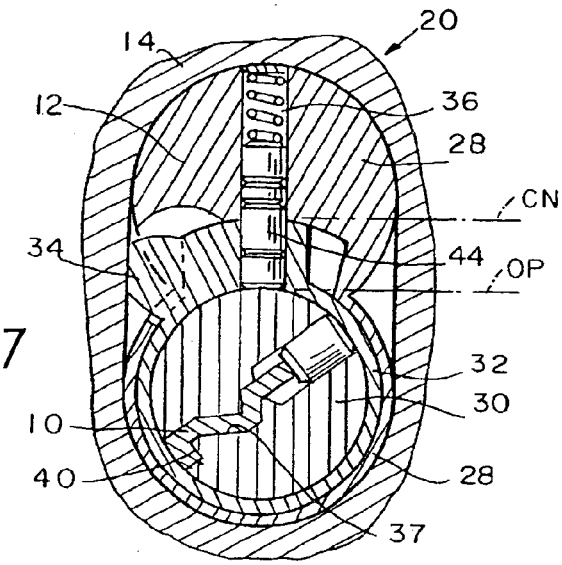
FIG. 7 is a sectional view similar to FIG. 6 showing an operating token inserted into lock core and biasing the tumbler pins so that rotation of the operating token rotates the key plug relative to the control sleeve and core body.

Key plug 30 is formed to include a keyway 37 that receives token 10. Keyway 37 is in communication with pin tumbler barrels 36. Key plug 30, control sleeve 32, and control lug 34 are rotatable relative to core body 28 by a token 10 as shown in FIGS. 6 and 7. The key plug 30 can be rotated by itself as shown in FIG. 7 and the key plug 30, control sleeve 32, and control lug 34 can be rotated together relative to core body 28 as shown in FIG. 6. When key plug 30 is rotated by itself, token 10 is permitted to rotate throw member 18 and thus cause the lockset to lock or unlock as desired.

Key plug 30 is one type of lock actuator that transfers movement induced by a token to move a door latch or other component of a lockset. In alternative embodiments of the present invention, key plug 30 may be linearly movable with respect to core body 28 to move a door latch or other component of the lockset.

Figure 5:
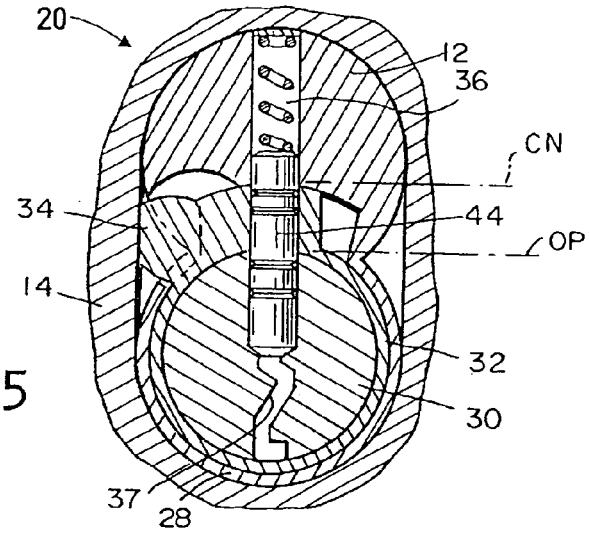
FIG. 5 is a sectional view taken along line 5-5 of FIG. 2 showing the lock core including a core body, a key plug positioned to lie within the core body and formed to include the passageway to receive the token, a control sleeve positioned to lie between the core body and key plug, a control lug appended to the control sleeve, and tumbler pins coupling the core body, control sleeve, and key plug together.

When control sleeve 32 and control lug 34 are rotated with key plug 30, control lug 34 is moved in and out of a recess 38 formed in lock cylinder 14 as shown in FIGS. 1 and 5-7. When control lug 34 is positioned to lie in recess 38 as shown in FIGS. 5 and 7, lock core 12 is securely held within lock cylinder 14. When control lug 34 is positioned to lie out of recess 38 as shown in FIG. 6, lock core 12 may be slid out of lock cylinder 14.

To rotate key plug 30 alone and, alternatively, control sleeve 32, control lug 34, and key plug 30 together, two different tokens are used with lock core 12. One of the tokens is referred to as an operating token 40 and is used when a user wants to rotate key plug 30 alone to cause the lockset to lock and unlock. The second token is referred to as a control token 42 and is used when a user wants to rotate key plug 30, control sleeve 32, and control lug 34 to move control lug 34 in and out of recess 38 formed in lock cylinder 14. The operating and control tokens 40, 42 cooperate with tumbler pins 44 positioned to lie in pin tumbler barrels 36 to determine if key plug 30 is rotated alone or together with control sleeve 32 and control lug 34.

Before a token 40, 42 is inserted into keyway 37 of key plug 30, tumbler pins 44 couple key plug 30 and control sleeve 32 to core body 28 as shown, for example, in FIGS. 2 and 5. When tumbler pins 44 are aligned in this manner, key plug 30 and control sleeve 32 are prevented from rotating relative to core body 28.

The operating token 40 engages tumbler pins 44 to align the faces of tumbler pins 44, as shown in FIGS. 2, 3, and 7, so that control sleeve 32 is coupled to core body 28 through tumbler pins 44 and key plug 30 is not coupled to core body 28 or control sleeve 32. This alignment of tumbler pins 44 by operating token 40 permits key plug 30 to rotate alone if all other locking systems of lock core 12 such as electrical portion 22 of lock core 12 are satisfied by operating token 40.

The control token 42 engages tumbler pins 44 to align the faces of tumbler pins 44 as shown in FIG. 6 so that control sleeve 32 is coupled to key plug 30 through tumbler pins 44 and neither key plug 30 nor control sleeve 32 is coupled to core body 28. This alignment of tumbler pins 44 by control token 42 permits key plug 30, control sleeve 32, and control lug 34 to rotate together if all other locking systems of lock core 12 such as electrical portion 22 of lock core 12 are satisfied by control token 42.

Figure 8:
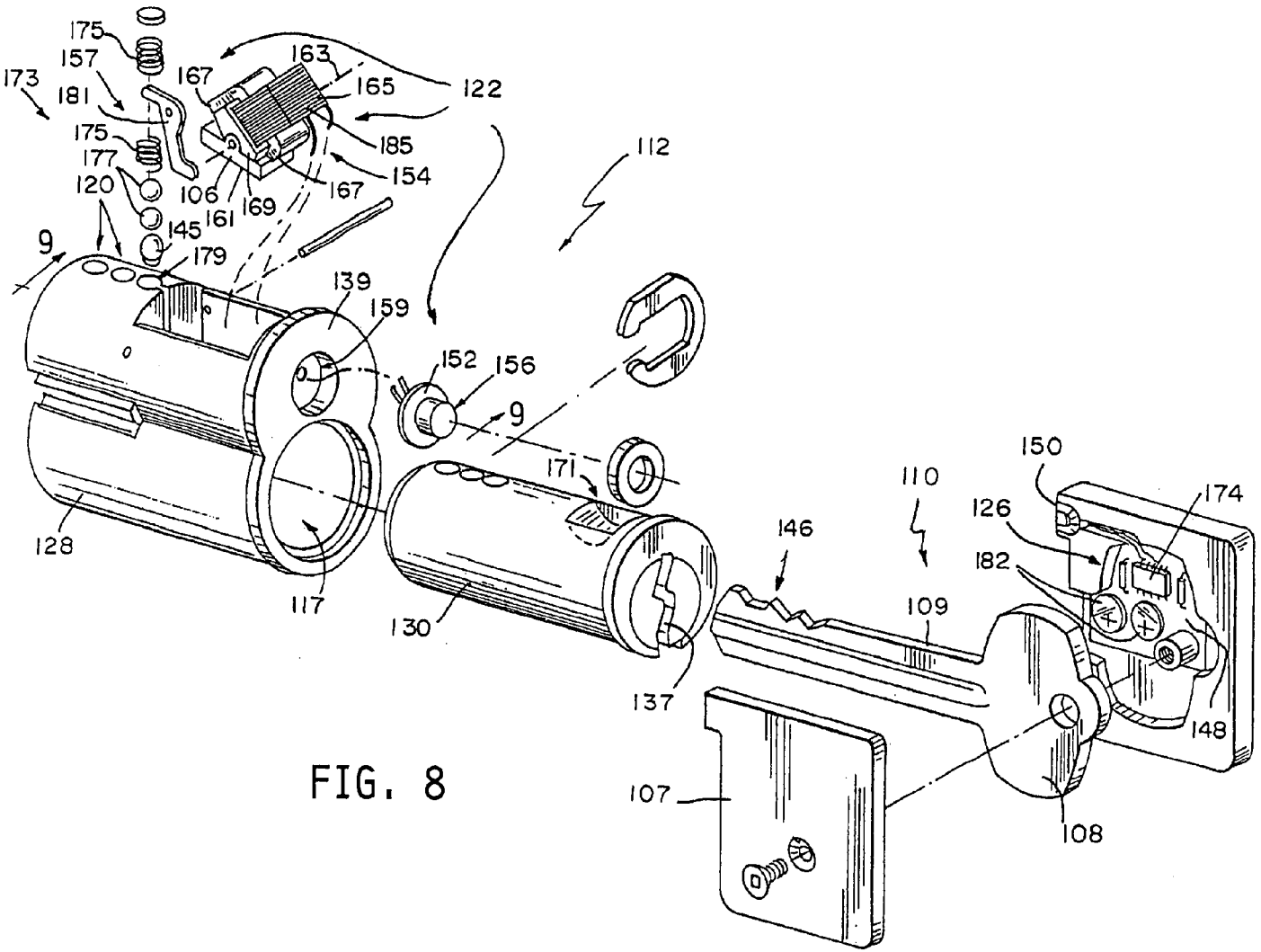
FIG. 8 is an exploded view of a preferred embodiment of an electronic token and lock core showing the lock core including a core body, a mechanical linkage having an energy storage system comprised of springs, bearings, and a cantilevered arm for insertion into the core body, an electromagnetic actuator having a blocker armature for mounting within the core body, a signal-receiving element to be located in a cavity formed in the front face of the core body, and a key plug having a blocker-receiving cavity and a keyway for insertion in the core body and showing the token including a bow and a bitted blade for receipt in the keyway, a casing for attachment to the bow, and a power supply and code storage elements lying in the casing.

The lock core 12 shown in FIG. 1 is a "figure-8 shaped" lock core 12. In alternative embodiments of the present invention, lock cores of other shapes, sizes, and configurations may incorporate the features disclosed in the present invention. For example, many European lock cores have a shape referred to as a Euro-core design. Additional details relating to lock cores 12 that can be used with the present invention are found, for example, in U.S. Pat. Nos. 4,444,034, 4,424,693, and 4,386,510 and are incorporated herein by reference.

The mechanical portion 24 of token 10 includes a bitted blade 46 and the electrical portion 26 includes a circuit 48 and contact or coupling 50. The mechanical portion 20 of lock core 12 includes pin tumbler barrels 36 and tumbler pins 44 that cooperate with bitted blade 46 of token 10. The operation of pin tumbler barrels 36 and tumbler pins 44 are discussed in detail in U.S. Pat. Nos. 4,444,034, 4,424,693, and 4,386,510 and are incorporated herein by reference. In alternative embodiments, the mechanical portion 24 of the lock core 12 and token 10 may include any type of mechanism in the lock core that the token must actuate before a user is granted access.

The electrical portion 22 of lock core 12 includes a circuit 52, an actuator 54, a contact and coupling 56, and a mechanical linkage 57. The circuit 52 of lock core 12 and circuit 48 of token 10 communicate through contacts 50, 56. Many types of contacts 50, 56 can be used and placed in many different locations on lock core 12 and token 10. These contacts 50, 56 include ohmic and inductive contacts as discussed in provisional patent application Ser. No. 60/080,974 filed Apr. 7, 1998 that is expressly incorporated by reference herein.

The circuit 52 of lock core 12 may include various combinations of a token identification reader or token communicator, a lock operator, a recombination system, a token access history, a clock, a power source, a power conditioner, and a power distributor. The circuit 48 of token 10 may include various combinations of token identification information or access code 74, token access history, clock, and power source 82. Various lock core 12 and token 10 configurations having different combinations of the above-mentioned features are illustrated and described in U.S. provisional patent application Ser. No. 60/080,974 filed Apr. 7, 1998 that is expressly incorporated by reference herein.

Before a token 10 is inserted into lock core 12, mechanical linkage 57 couples key plug 30 and core body 28 as shown in FIG. 3. The engagement between token 10 and mechanical linkage 57 provides energy to mechanical linkage 57 to later assist in moving mechanical linkage 57 if acutator 54 permits mechanical linkage 57 to move. The energy supplied to mechanical linkage 57 by token 10 can be stored by a spring, piezoelectric material/capacitor, elastic material, or other suitable device. In alternative embodiments, the mechanical linkage does not contact the token to receive energy.

After circuit 52 verifies that token 10 should be granted access, actuator 54 moves mechanical linkage 57 to a position shown in FIG. 4 to permit key plug 30 to rotate relative to core body 28 if the mechanical portion 20 of lock core 12 is also satisfied by token 10. In the illustrated embodiment, the mechanical linkage 57 includes first and second portions 84, 86 that can be separated. When circuit 52 verifies that token 10 should be granted access, actuator 54 positions mechanical linkage 57 so that the abutting faces of portions 84, 86 are positioned to lie at the intersection of core body 28 and key plug 30 and key plug 30 can rotate relative to core body 28. In alternative embodiments, when circuit 52 verifies that the token should be granted access, actuator 54 removes the entire mechanical linkage from the key plug to permit the key plug to rotate relative to the core body.

Because lock core 12 includes pin tumbler barrels 36, token 10 cannot be removed until the token is returned to the same position at which it was inserted as shown in FIG. 3. When token 10 is returned to this position, mechanical linkage 57 moves through chambers 88, 90 without assistance from actuator 54 to couple key plug 30 and core body 28 to prevent key plug 30 from rotating.

Referring specifically to FIGS. 8-11, a first embodiment of lock core 112 and token 110 are illustrated. Electronic lock core 112 includes a core body 128 having an aperture 117, a key plug or lock actuator 130 sized to be received in the aperture 117 and formed to include a keyway 137, a mechanical portion 120, and an electrical portion 122. Mechanical portion 120 includes two pin tumbler barrels 136 each containing tumbler pins 144 partially extending into keyway 137 and blocking rotation of key plug 130 relative to core body 128, as shown, for example, in FIG. 9, unless a token 110 containing an appropriately bitted blade 146 is inserted in keyway 137, as shown, for example in FIGS. 10-11.

Electrical portion 122 of lock core 112 includes a mechanical linkage 157, an electromagnetic actuator 154, a token communicator or coupling 156, and a circuit 152. Coupling 156 and circuit 152 are received in a cavity 159 formed in face plate 139 of core body 128. Electromagnetic actuator 154 includes an armature 161 pivotally supported for movement between first and second angularly displaced positions about a pivot axis 163 extending though center of mass 106 of armature 161, an electromagnet 165 having a pair of opposed pole members 167 extending toward the ends of armature 161 on either side of pivot axis 163, and a three pole permanent magnet 169 extending between pole members 167 of electromagnet 165. Armature 161 is received in a blocker-receiving channel 171 of key plug 130 to block rotation of key plug 130 relative to core body 128 when in the first position. Permanent magnet 169 biases armature 161 in the first position. When armature 161 is in the second position, it is not received in the blocker-receiving channel 171 and key plug 130 is permitted to rotate relative to core body 128.

Mechanical linkage 157 includes an energy storage system 173 having a spring 175, a semi-spherical tumbler pin 145 having a first end 104 extending into key way 137 and a spaced apart second end 105 and spherical tumbler pins 177 each including a downwardly facing semi-spherical surface for insertion into a barrel 179 partially formed in core body 128 and partially formed in key plug 130, and a cantilevered arm 181 for insertion into a cavity 183 in core body 128 in communication with barrel 179. Semi-spherical tumbler pin 145 includes a first end 104 extending into key way 137 and a spaced apart second end 105 engaging one of spherical tumbler pins 177. Each spherical tumbler pin 177 includes a downwardly facing semi-spherical surface.

Semi-spherical tumbler pin 145 and spherical tumbler pins 177 are utilized so that tumbler alignment in mechanical linkage 157 does not have to be as precise as the alignment of tumbler pins 144 in mechanical portion 120 in permitting key plug 130 rotation. So long as the downwardly facing semi-spherical surface of one of spherical pins 177 is located at the interface of core body 128 and key plug 130, rotation of key plug 130 will urge that spherical pin 177 upwardly until it is completely positioned within the portion of barrel formed in core body 128. Thus, the location of armature 161 with respect to blocker-receiving channel 171, and not the location of semi-spherical tumbler pin 145 and spherical tumbler pins 177, determines whether electrical portion 122 inhibits rotation of key plug 130 relative to core body 128. In alternative embodiments, the electrical portion includes tumbler pins similar to tumbler pins 144 instead of pins 145, 177 so that both the location of the armature 161 and the pins determine whether the requirements of the electrical portion are satisfied. Similar barrels 279, 379, 479, and 579, pins 245, 277, 345, 377, 445, 477, 545 and 577 are found in the lock core embodiments 212, 312, 412, and 512 described hereinafter to serve similar functions.

While FIG. 1 illustrates circuitry 48 and contact 50 integrally formed into the bow of electronic token 10, a presently preferred embodiment of electronic token 110 includes a standard mechanical token 109 having a bitted blade 146 and a bow 108 and a case 107 designed to encase bow 108, as shown, for example, in FIG. 8. Case 107 contains the electrical portion 126 of token 110. Standard token 109 is designed so bitted blade 146 may be received in keyway 137 of key plug 130. Illustratively electrical portion 126 includes a power supply 182, a coupling 150, incorporated previously by reference, and token identification information 174. Alternative forms of cases 607, 707, 807 and 907 for attachment to standard token bows are shown, for example, in FIGS. 25-28, respectively.

Figure 9:
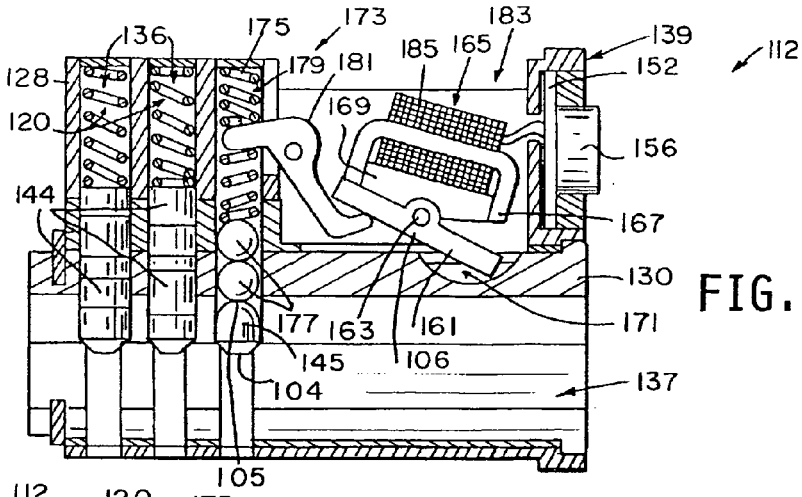
FIG. 9 is a sectional view taken along line 9-9 of FIG. 8 showing the lock core including a mechanical portion having two tumbler pin barrels each containing tumbler pins partially extending into the keyway and blocking rotation of the key plug relative to the core body and an electrical portion including the blocker of the electromagnetic actuator received in the blocker-receiving channel of the key plug to block rotation of the key plug relative to the core body.

Prior to token 110 insertion, tumbler pins 144 partially extend into keyway 137 and block rotation of the key plug 130 relative to core body 128 as shown in FIG. 9. Rotation of key plug 130 relative to core body 128 is also blocked by armature 161 of electromagnetic actuator 154 which is received in blocker-receiving channel 171 of key plug 130, as shown, for example, in FIG. 9. Armature 161 is inhibited from pivoting out of blocker-receiving channel 171 by cantilevered arm 181, as well as by permanent magnet 169.

Figure 10:
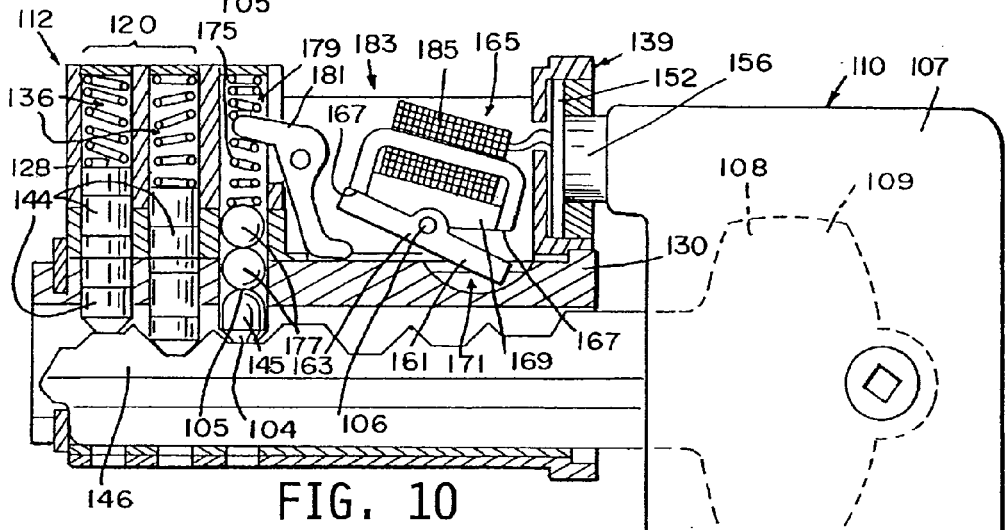
FIG. 10 is a sectional view similar to FIG. 9 with a token of FIG. 8 inserted into the keyway showing the bitted blade of the token aligning the tumbler pins of the mechanical portion of the lock core so that the tumbler pins no longer inhibit rotation of the key plug within the core body and compressing the springs and rotating the cantilevered arm of the electrical portion of the lock core to store energy within the springs and showing the blocker armature of the electromagnetic actuator still being received in the blocker receiving cavity but being free to rotate out of the blocker receiving cavity upon receipt of an authorized access signal by the electromagnetic actuator from the circuit after interrogating identification information on the token.
Figure 11:
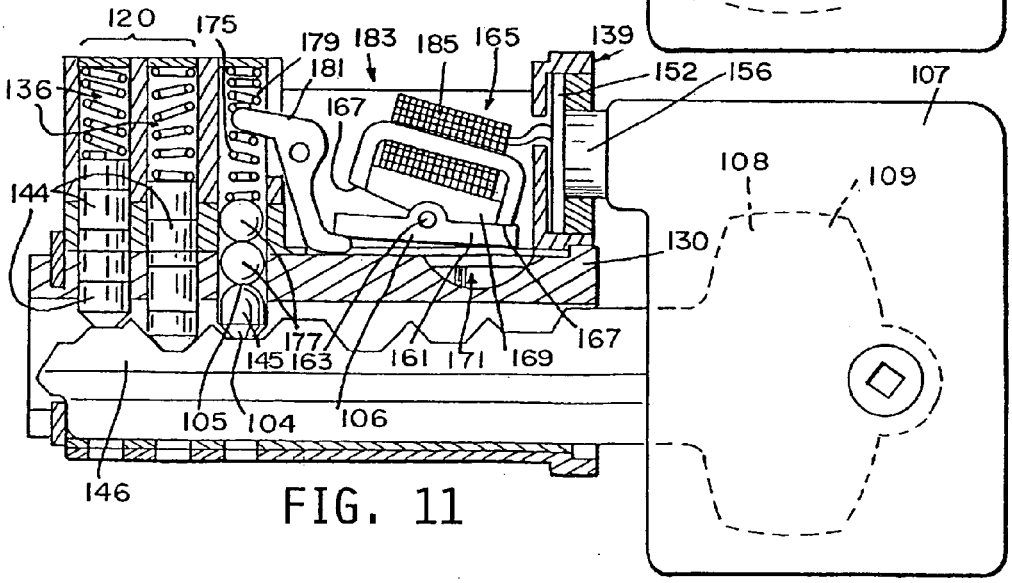
FIG. 11 is a sectional view similar to FIG. 10 showing the blocker armature of the electromagnetic actuator rotated out of the blocker receiving cavity after receipt of an appropriate code from the token allowing the key plug to rotate freely within core body.

When token 110 is inserted into keyway 137 bitted blade 146 of token 110 aligns tumbler pins 144 of the mechanical portion 120 so that they no longer inhibit rotation of key plug 130 with respect to core body 128 as shown in FIG. 10. Bitted blade 146 also urges semi-spherical tumbler pin 145 upwardly compressing spring 175 and causing rotation of arm 181 out of engagement with armature 161 freeing armature 161 to move if electromagnet 165 is energized in response to a valid authorization code. Thus, immediately after insertion of token 110, armature 161 of electromagnetic actuator 154 is still received in blocker-receiving cavity 171 but is free to rotate out of blocker-receiving cavity 171 upon lock core 112 receiving an authorized access signal from token 110, as shown, for example, in FIG. 10.

Compressed spring 175 stores energy which is used to urge arm 181 back into its initial position upon removal of token 110 from keyway 137, as shown in FIG. 9. This stored energy facilitates the return of armature 161 of electromagnetic actuator 154 to its blocking position in blocker-receiving slot 171.

If token 110 contains token identification information 174 which is authorized to open lock, coil 185 of electromagnet 165 is energized causing armature 161 of electromagnetic actuator 154 to be rotated out of the blocker-receiving cavity 171. Electromagnetic actuator 154 requires only a short energy pulse or trigger pulse to pivot armature 161 to the non-blocking position of FIG. 11. Once pivoted to the non-blocking position, armature 161 remains in that position without continued coil 185 energization. As a result, energy consumption of electronic lock core 112 is minimized extending the life of batteries used as a power source 182. Operation of a similar electromagnetic actuator 154 is described in depth in Ono et al. U.S. Pat. No. 4,703,293, the disclosure of which is incorporated herein by reference.

After the lockset has been configured to grant access to the authorized user, user removes token 110 from keyway 137 allowing the energy stored in compressed spring 175 to rotate arm 181 which pivots armature 161 of electromagnetic actuator 154 into its blocking position shown in FIG. 10. No electrical energy is required to return armature 161 to its blocking condition further extending the battery life of power source 182.

Figure 12:
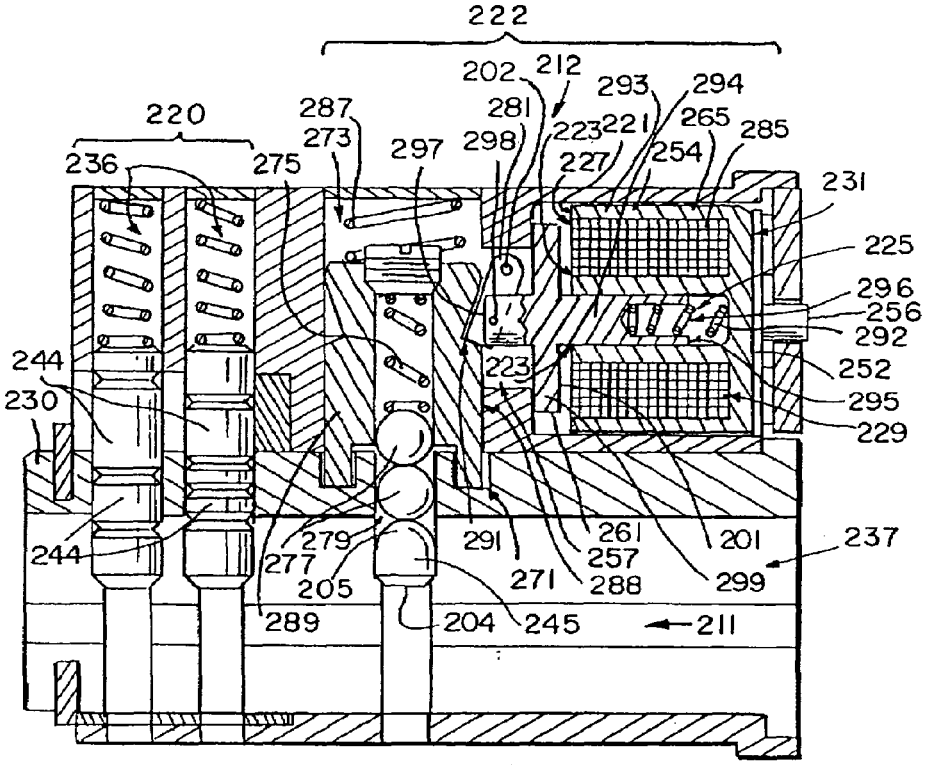
FIG. 12 is a sectional view of another preferred embodiment of a lock core showing the lock core including a core body, a key plug having a keyway therethrough, a mechanical portion having two tumbler pin barrels each containing tumbler pins extending into the keyway and positioned to prohibit rotation of the key plug relative to the core body, and an electrical portion having a mechanical energy storage mechanism comprised of a tumbler ball bearing, springs, a blocking body having a step formed therein, a latch engaging the step of the blocking body, and an electromagnetic actuator controlling movement of the latch.
Figure 13:
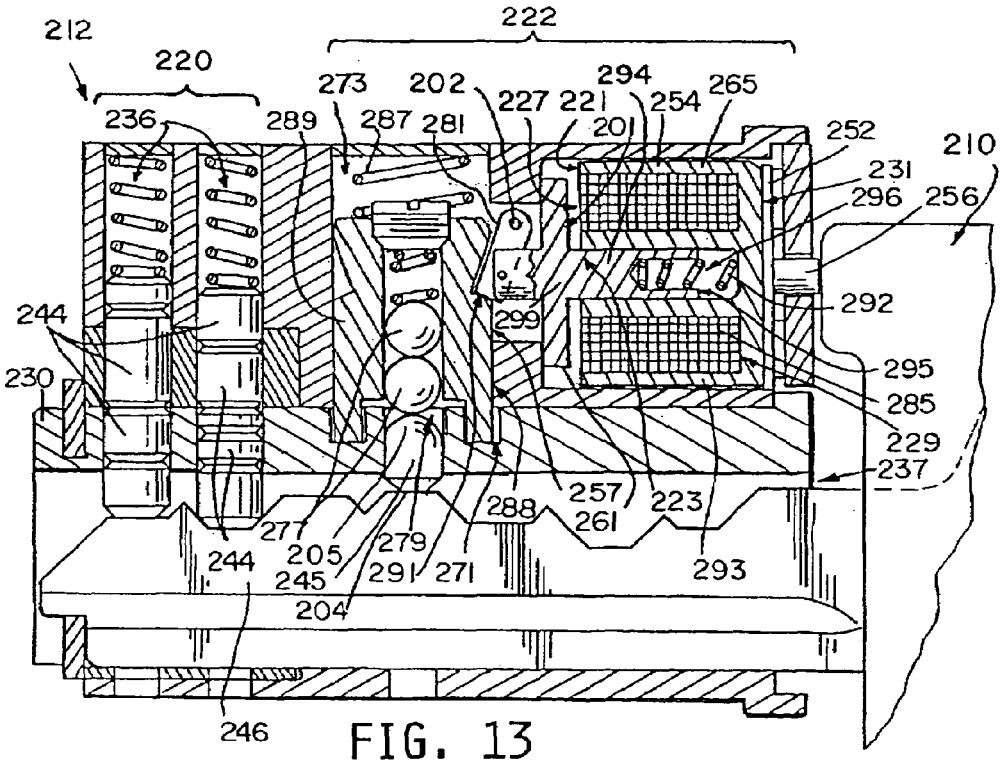
FIG. 13 is a sectional view similar to FIG. 12 with the token of FIG. 8 inserted in the keyway of the key plug so that the bitted blade has positioned the tumbler pins of the mechanical portion in a position which does not inhibit rotation of the key plug relative to the core body and stored energy in the spring of the electrical portion.
Figure 14:
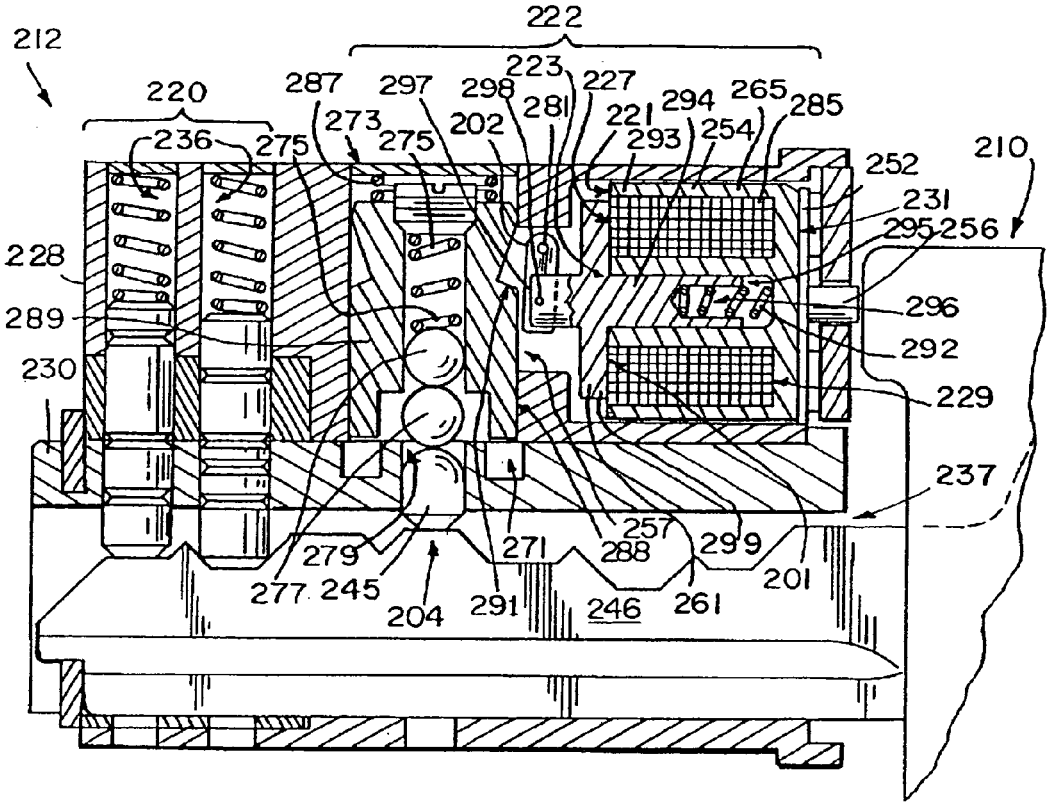
FIG. 14 is a sectional view similar to FIG. 13 after the electromagnetic actuator has been energized in response to the receipt of a valid access code from the token and has disengaged the latch from the step formed in the blocking body to allow energy stored in the lower spring to urge the blocking body into a position in which it no longer inhibits rotation of key plug with respect to core body.
Figure 15:
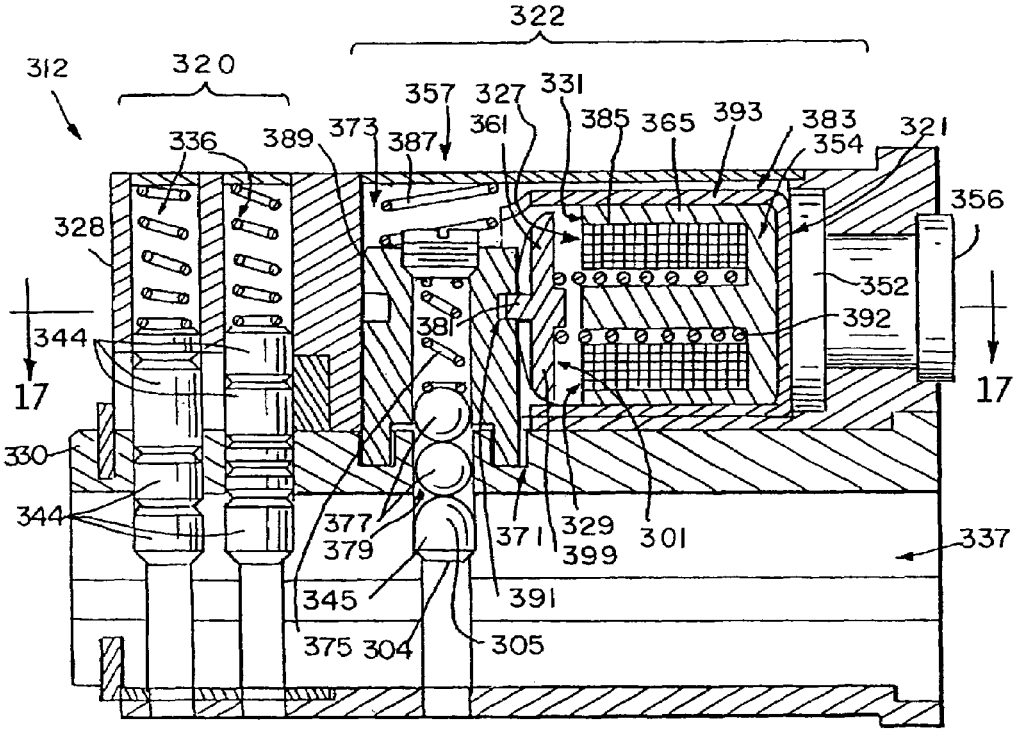
FIG. 15 is a sectional view of yet another preferred embodiment of an electronic lock core including a mechanical portion having two tumbler pin barrels each containing tumbler pins partially extending into the keyway and blocking rotation of the key plug relative to the core body and an electrical portion including a flange coupled to a disk that is pivotally attached to an electromagnet extending into a channel to hold the blocker body in a blocker-receiving cavity of the key plug and block rotation of the key plug relative to the core body.
Figure 16:
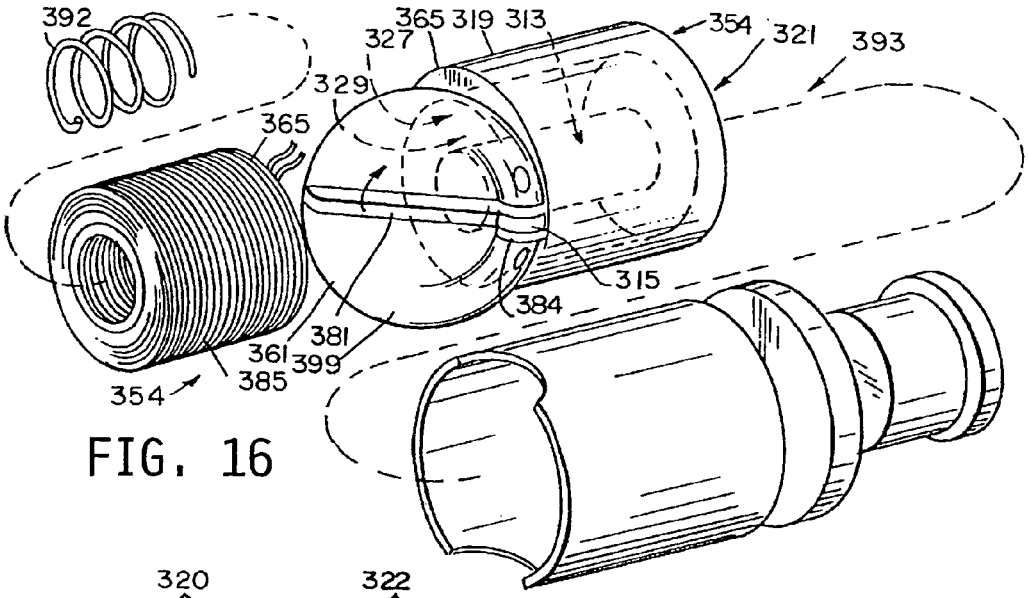
FIG. 16 is an exploded view of the electromagnetic actuator of FIG. 15 showing a core of an electromagnet into which a coil is inserted and a ferrous disk having the flange for receipt in the indentation in the blocker body that is pivotally mounted to the electromagnet.
Figure 17:
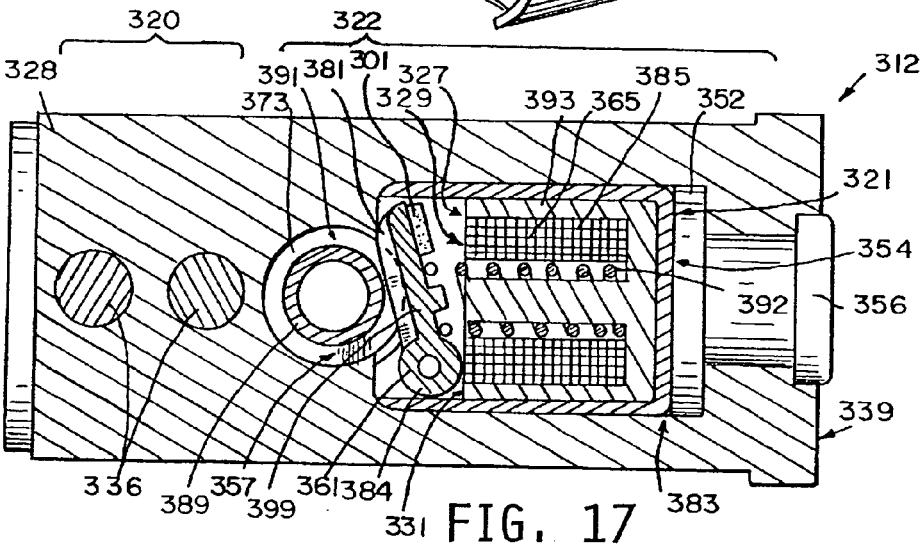
FIG. 17 is a sectional view taken along line 17-17 of FIG. 15 showing the flange of the ferrous disk received in the indentation in the blocker to prevent movement of the blocker and also showing a mechanical portion similar to that shown in FIGS. 9-11.
Figure 18:
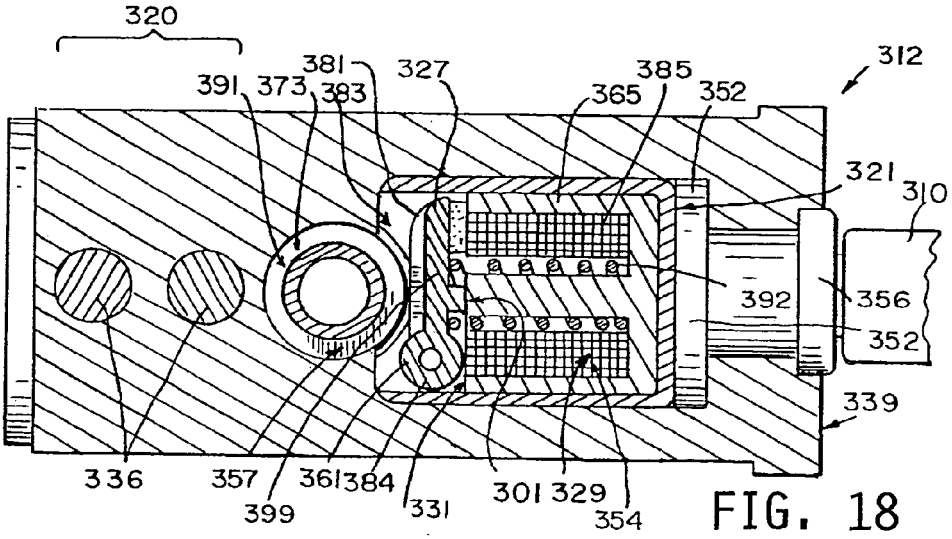
FIG. 18 is a sectional view similar to FIG. 17 with a token as shown in FIG. 8 inserted in the keyway showing the electromagnet energized in response to an authorized code to pivot the flange to a position allowing movement of energy storage mechanism.

Referring to FIGS. 12-14, a second embodiment of the lock core 212 in accordance with the present invention is illustrated. Lock core 212 includes core body 228, a key plug or lock actuator 230 having a keyway 237 therethrough, and a mechanical portion 220 including two tumbler pin barrels 236 each containing tumblers pins 244 extending into keyway 237 and blocking rotation of the key plug 230 relative to core body 228. Lock core 212 also includes electrical portion 222 having a coupling or token communicator 256, a circuit 252, an electromagnetic actuator 254, and a mechanical linkage 257. Mechanical linkage 257 includes a mechanical energy storage system 273 having a semi-spherical tumbler pin 245, spherical tumbler pins 277, a lower spring 275, an upper spring 287, a blocking body 289 having a step 291 formed therein, a latch 281, and blocking body-receiving cavity 271 formed in key plug 230. Electromagnetic actuator 254 is coupled to latch 281 to control the movement of latch 281 between a position lying in step 291 of blocker body 289 and a position away from step 291.

When token 210 is inserted into keyway 237 of key plug 230, bitted blade 246 positions tumbler pins 244 of mechanical portion 220 so they do not inhibit rotation of the key plug 230 relative to the core body 228 as shown in FIG. 13. Bitted blade 246 also engages semi-spherical tumbler pin 245 and urges it, and spherical tumbler pins 277, upwardly to compress lower spring 275. After token 210 insertion, but prior to receiving an authorized code, latch 281 is positioned in step 291 preventing blocking body 289 from moving out of blocker body-receiving cavity 271. The energy stored in the lower spring 275 after token insertion is used to urge blocking body 289 upwardly out of blocker body-receiving cavity 271 once latch 281 is urged away from step 291.

After electromagnetic actuator 254 has been energized in response to the receipt of a valid access code, latch 281 is momentarily disengaged from step 291 allowing energy stored in lower spring 275 to urge blocking body 289 into a position in which it no longer inhibits rotation of key plug 230 with respect to core body 228 as shown in FIG. 14. The upward movement of blocking body 289 stores mechanical energy in upper spring 287 which is later used to return blocking body 289 to its blocking position upon removal of token 210 as shown in FIG. 12.

Electromagnetic actuator 254 includes a core 293, a movable element 261, and a spring 292 biasing the movable element 261 away from the core 293. Core 293 has a first end 221 having a cross-sectional area (not shown) and formed to include a circular opening 223 therethrough communicating with a cylindrical axial cavity 225 and a ring-shaped opening 227 therethrough communicating with an annular cavity 229, a closed second end 231, and a cylindrical coil 285 received in the annular cavity 229.

Movable element 261 includes a shaft 294 having a first end 295 formed to include a spring receiving cavity 296, a second end 297 having a connector hole 298 extending therethrough, and a disk 299 extending radially from the shaft 294 between the first end 295 and second end 297. Disk 299 has a surface 201 facing first end 221 of electromagnet 265 which has a cross-sectional area substantially similar to cross-sectional area of first end 221 of electromagnet 265. First end 295 of movable element 261 is received in cylindrical axial cavity 225 of core 293. Spring 292 is received in spring-receiving cavity 296 and engages closed second end 231 of core 293 to bias disk 299 away from first end 231 of core 293. Second end 297 of shaft 294 is connected by a fastener to latch 281 which is pivotally mounted about pivot axis 202 to lock core 212. Second end 297 is connected to latch 281 at a point spaced apart from pivot axis 202 to increase mechanical advantage.

When current flows through coil 285 of electromagnet 265 in response to receipt of an authorized code from token 210, a magnetic field is produced which attracts surface 201 of disk 299 toward first end 231 of core 293 causing latch 281 to pivot away from blocking body 289 and to disengage step 291. Blocking body 289 is immediately urged upwardly by compressed spring 275 upon disengagement of latch 281 from step 291 as shown in FIG. 14. Cessation of current flow causes shaft 294 to move in the direction of arrow 211 in FIG. 12 allowing latch 281 to pivot into engagement with sidewall 288 of blocking body 289. Upon token 210 removal upper spring 287 will urge blocking body 289 to its blocking position while allowing latch 281 to be urged into engagement with step 291 as shown in FIG. 12. Thus, current need only flow through coil 285 long enough to disengage latch 281 from step 291 momentarily so that blocking body 289 can be urged upwardly out of blocker-receiving cavity 271. Because continuous current flow through coil 285 is not required to maintain the electrical portion 222 in a state in which key plug 230 rotation with respect to core body 228 is permitted, battery 182 life can be extended.

Referring to FIGS. 15-18, a third embodiment of an electronic lock core 312 is illustrated. Electronic lock core 312 includes a core body 328, a key plug or lock actuator 330 formed to include a keyway 337, a mechanical portion 320, and an electrical portion 322. Mechanical portion 320 includes two tumbler pin barrels 336 each containing tumbler pins 344 partially extending into keyway 337 and blocking rotation of key plug 330 relative to core body 328.

Electrical portion 322 includes a coupling or token communicator 356, circuit 352, an electromagnetic actuator 354, and a mechanical linkage 357. Mechanical linkage 357 includes a mechanical energy storage system 373 having a semi-spherical tumbler pin 345, spherical tumbler pins 377, lower spring 375, upper spring 387, a blocking body 389 having a channel 391 formed therein, and a blocker-receiving cavity 371 formed in key plug 330. Electromagnetic actuator 354 includes an electromagnet 365, a movable element 361 attached by a hinge coupling to electromagnet 365, and a spring 392 biasing the unattached portions of movable element 361 away from the electromagnet 365. Electromagnetic actuator 254 includes an electromagnet 365, a movable element 361 attached by a hinge coupling to electromagnet 365, and a spring 392 biasing the unattached portions of movable element 361 away from the electromagnet 365.

Movable element 361 includes a disk-shaped ferrous element 399 having an electromagnet-facing surface 301, an opposite surface having a flange 381 extending therefrom, and a mounting bracket 384 formed at one edge. Electromagnet 365 includes a core 393 and a coil 385. Core 393 includes a closed first end 321, a cylindrical outer shell 319 extending from the first end 321, a central shaft 313 extending axially from the first end 321, and a second end 331 having a mounting ear 315 extending therefrom. The core 393 is formed to include an annular opening 327 communicating with an internal cavity 329 defined by the outer shell 319, closed end 321, and central shaft 317. Mounting bracket of movable element 361 is pivotally connected to mounting ear 315 of core 393, as shown, for example, in FIG. 16 so that electromagnet-facing surface 301 is directed toward second end 331 of core 393. Coil 385 and spring 392 are received in cavity 329, as shown, for example, in FIG. 16.

Electromagnetic actuator 354 is mounted in cavity 383 of lock body 328 so that flange 381 of movable element 361 is biased toward channel 391 of blocking body 389 by spring 392. When current is induced to flow through coil 385, an electromagnetic field is generated which attracts disk 399 of movable element 361 toward second end 331 of electromagnet 365 causing flange 381 to pivot out of channel 391. If a token 310 including an appropriately bitted blade 346 has been inserted into keyway 337, mechanical energy storage system 373 compresses lower spring 375 to store energy which urges blocking body 389 upwardly out of blocker body-receiving channel 371 immediately upon removal of flange 381 from channel 391.

Figure 19:
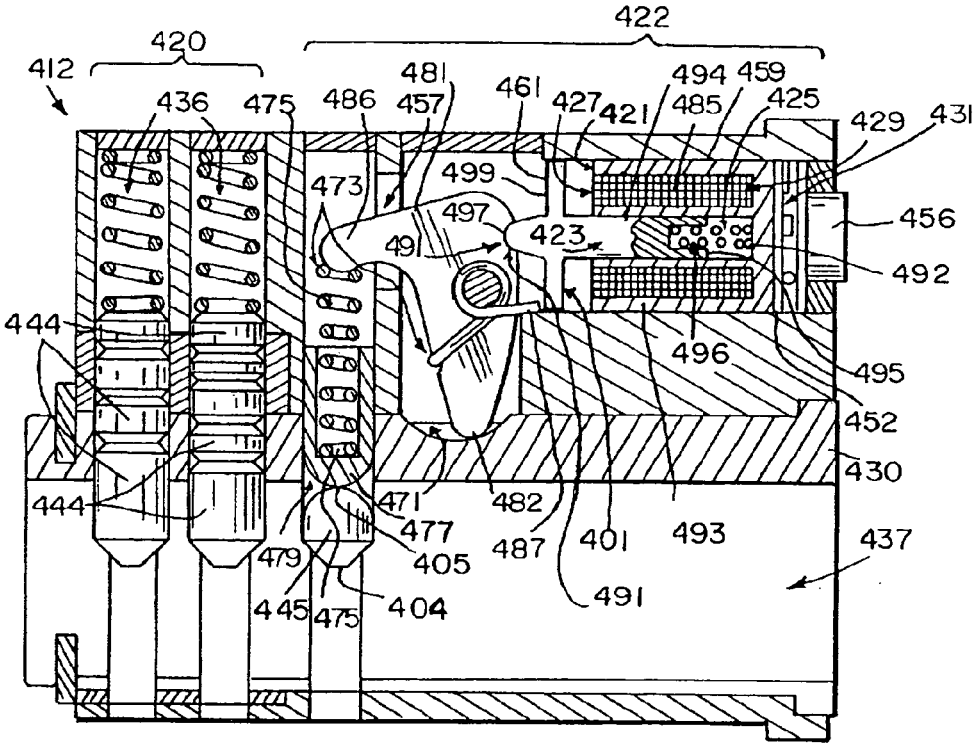
FIG. 19 is a sectional view of yet another preferred embodiment of a lock core according to the present invention, showing the lock core including a mechanical portion having two tumbler pin barrels each containing tumbler pins extending partially into the keyway and blocking the rotation of key plug with respect to core body, a mechanical energy storage device having semi-spherical ended tumblers, a coiled spring, a pivotally mounted latch with a blocker end, a storage end, and an indentation, and a torsion spring, and also showing a latch receiving cavity in the key plug with the blocker end of the latch received therein, a latch blocker having a tip received in the indentation, and an electromagnetic actuator for moving the latch blocker.
Figure 20:
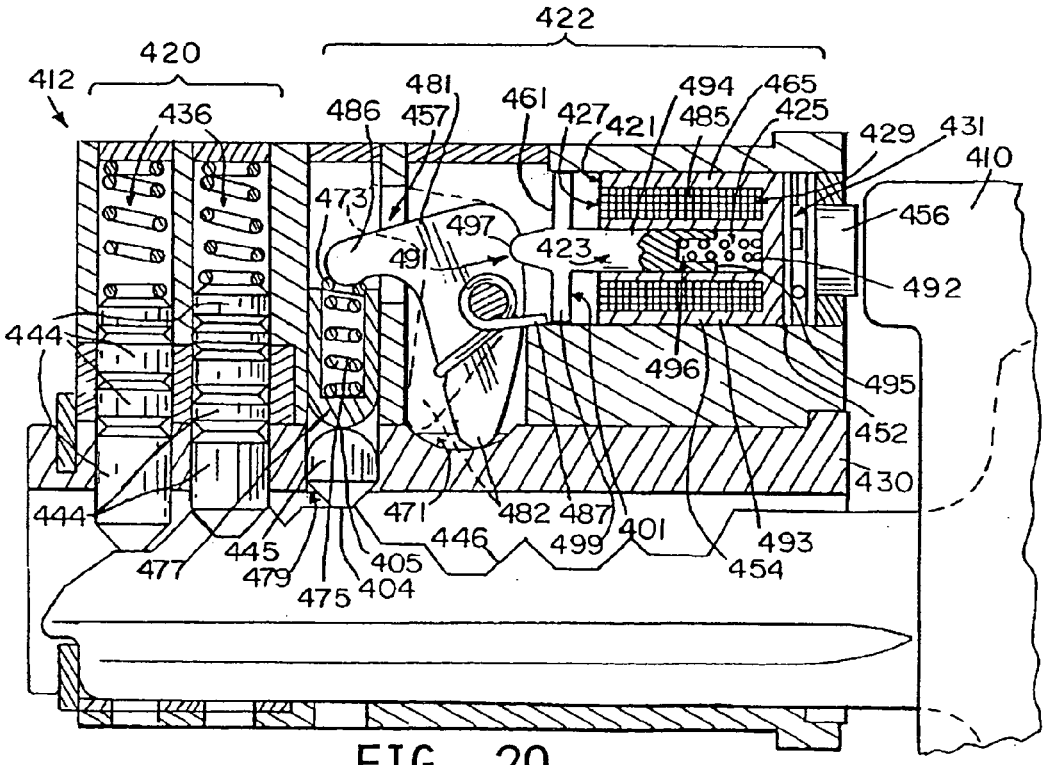
FIG. 20 is a sectional view similar to FIG. 19 with a token of FIG. 8 inserted in the keyway so that the bitted blade has positioned the tumbler pins of the mechanical portion in a position which does not inhibit rotation of the key plug relative to the core body and has urged the semi-spherical tumblers upward to store energy in the spring that may be released to urge the blocker end of latch from its current position in which it continues to inhibit rotation of the key plug with respect to the core body to a second position (shown in phantom lines) in which blocker end of latch is no longer received in the blocker receiving channel.
Figure 21:
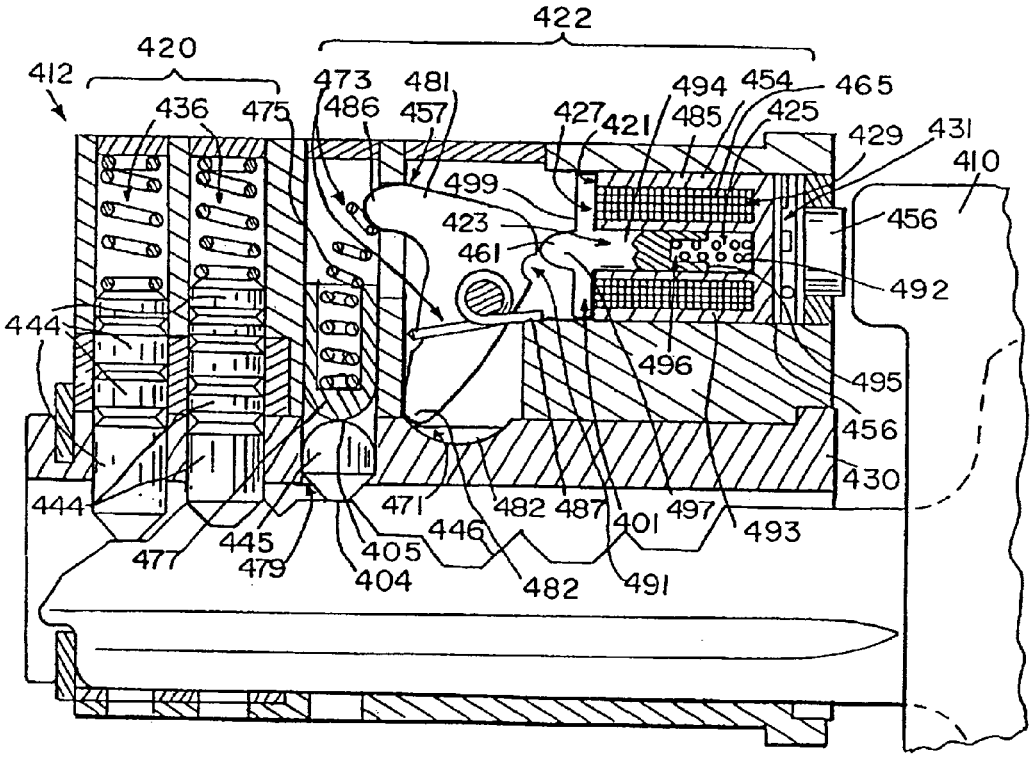
FIG. 21 is a sectional view similar to FIG. 20 showing the blocker end of the latch rotated out of the blocker receiving channel in response to removal of the tip of the latch blocker from the indentation of the latch after the electromagnet has been momentarily energized in response to receiving an authorized code to free the key plug to rotate with respect to the core body.

Referring to FIGS. 19-21 a fourth embodiment of a lock core 412 is illustrated. Lock core 412 includes mechanical portion 420 having two tumbler pin barrels 436 each containing tumbler pins 444 extending partially into the keyway 437 blocking the rotation of key plug or lock actuator 430 with respect to core body 428 and an electrical portion 422. Electrical portion 422 includes a coupling or token communicator 456, circuit 452, an electromagnetic actuator 454, and a mechanical linkage 457. Mechanical linkage 457 includes a mechanical energy storage system 473 having a semi-spherical tumbler 445, a semi-spherical ended tumbler 477, a lower spring 475, a pivotally-mounted latch 481 having a blocker end 482, a storage end 486, and an indentation 491, a torsion spring 487, and a latch-receiving cavity 471 in the key plug 430. Before, token 410 communicates with lock core 412, blocker end 482 of latch 481 is positioned in latch-receiving cavity 471 of key plug 430 to prevent rotation of key plug 430 relative to core body 428.

Electromagnetic actuator 454 includes an electromagnet 465, a movable element 461, and a spring 492. Electromagnet 465 includes a core 493 having a first end 421 formed to include a circular opening 423 therethrough communicating with a cylindrical axial cavity 425 and a ring-shaped opening 427 therethrough communicating with an annular cavity 429, a closed second end 431, and a cylindrical coil 485 received in the annular cavity 429. Movable element 461 includes a shaft 494 having a first end 495 formed to include a spring-receiving cavity 496, a pointed second end 497, and a disk 499 extending radially from the shaft 494 between the first end 495 and second end 497. First end 495 of movable element 461 is received in cylindrical axial cavity 425 of core 493. Spring 492 is received in spring-receiving cavity 496 and engages closed second end 431 of core 493 to bias disk 499 away from first end 431 of core 493. Second end 497 of shaft 494 is biased by spring 492 toward and for receipt into indentation 491 of latch 481 which is pivotally mounted to lock core 412. Coil 485 and spring 492 are received in cavity 427, as shown, for example, in FIGS. 19-21.

When a token 410 is inserted into keyway 437, bitted blade 446 positions tumbler pins 444 of mechanical portion 420 in a position which does not inhibit rotation of the key plug 430 relative to the core body 428. Bitted blade 446 also urges semi-spherical tumbler pin 445 upwardly storing energy in spring 475 that may be later released to urge storage end 486 of pivotally-mounted latch 481 upwardly and pivot blocker end 482 of latch 481 from its blocking position, in which it inhibits rotation of key plug 430 with respect to core body 428, to a second position (shown in phantom lines) in which blocker end 482 of latch 481 is no longer received in the blocker-receiving channel 471.

Blocker end 482 of latch 481 is pivoted out of the blocker-receiving channel 471 in response to removal of tip 497 of movable element 461 from indentation 491 in latch 481 after the electromagnet 465 has been momentarily energized in response to receiving an authorized code freeing the key plug 430 to rotate with respect to the core body 428.

Figure 22:
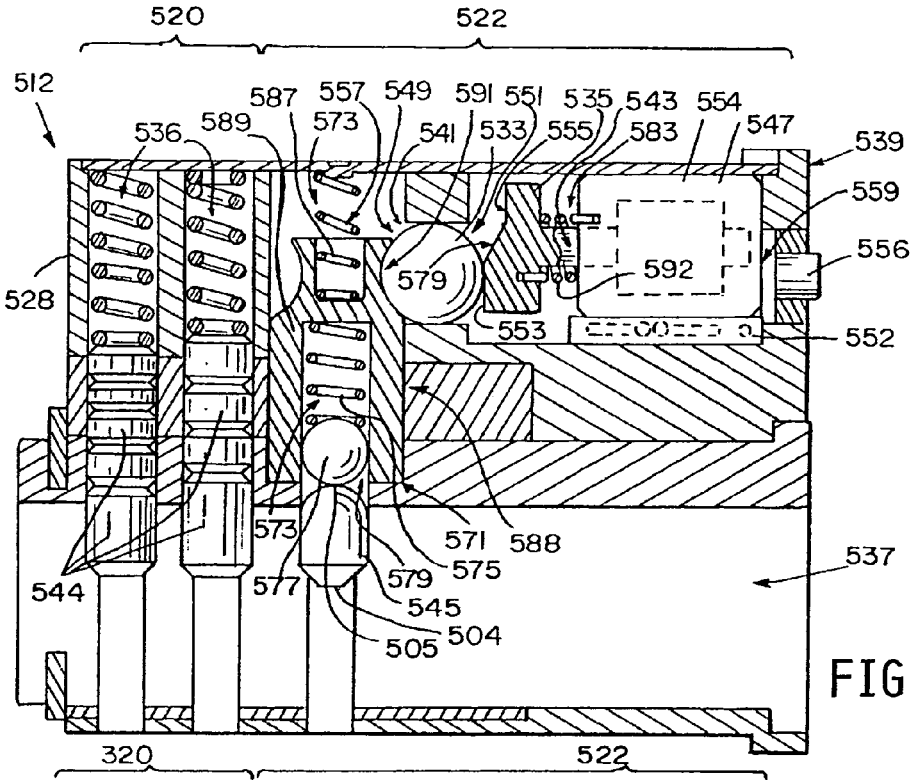
FIG. 22 is a sectional view of yet another preferred embodiment of the electronic lock core of the present invention showing a mechanical portion having two tumbler pin barrels each having tumbler pins partially extending into the keyway and blocking rotation of the key plug relative to the core body and a mechanical energy storage device including tumblers, a lower spring, a blocker body having an annular indentation and an upper spring, and a ball bearing received in a sleeve opening at one end adjacent to the blocker body and, at the other end, adjacent to a cam attached to a rotatable shaft, the ball bearing being received in the indentation to block motion of the blocker body.
Figure 23:
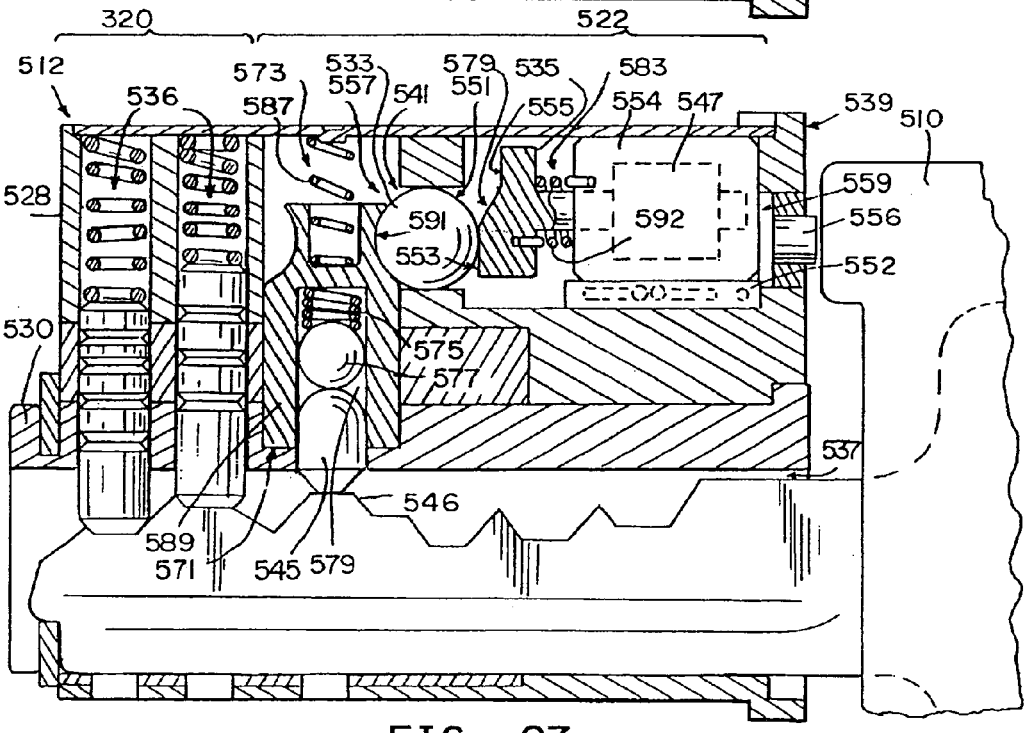
FIG. 23 is a cross-sectional view similar to FIG. 22 with a token of FIG. 8 received in the keyway aligning the tumbler pins of the mechanical portion to permit rotation of the key plug relative to the core body and compressing the lower spring of the mechanical energy storage device to store energy for moving the blocker body upward upon removal of the ball from the indentation of the blocker body.
Figure 24:
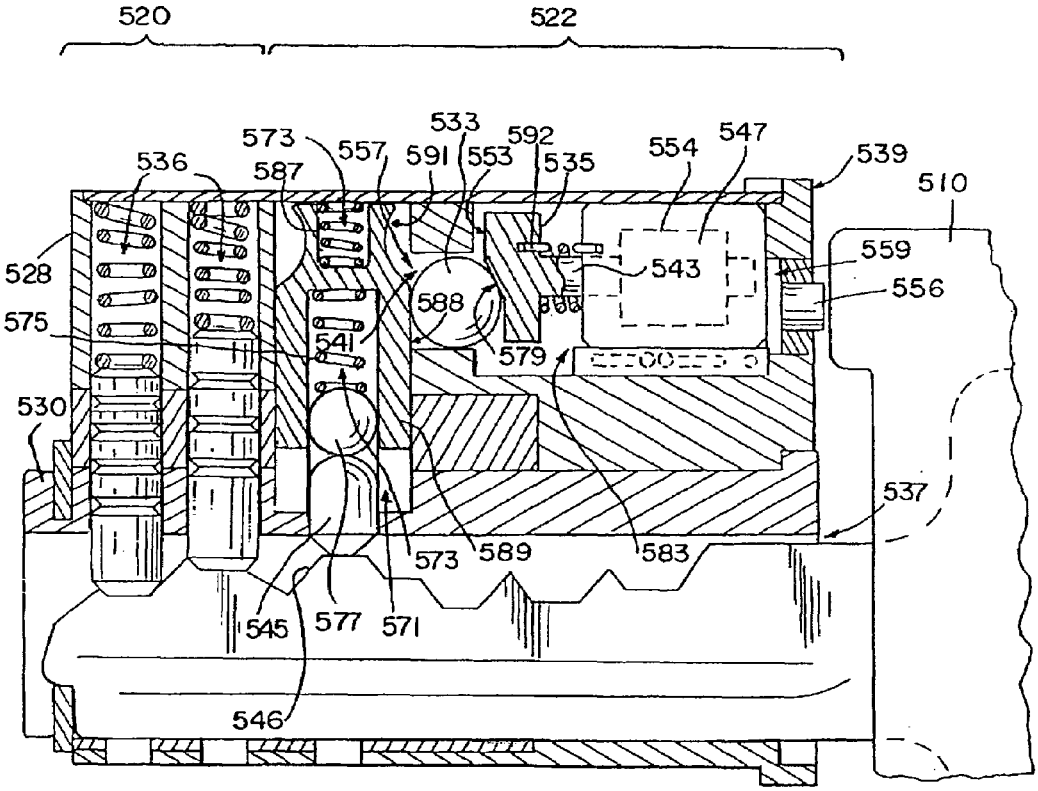
FIG. 24 is a cross-sectional view similar to FIG. 23 showing the cam rotated 180 degrees from the position shown in FIG. 23 by a rotatable solenoid in response to a valid access signal thereby allowing the ball to move out of the indentation of the blocker body which has been urged upward by the energy stored in the lower spring so that the blocker body no longer blocks rotation of the key plug relative to the core body.
Figures 25, 26, 27, 28:
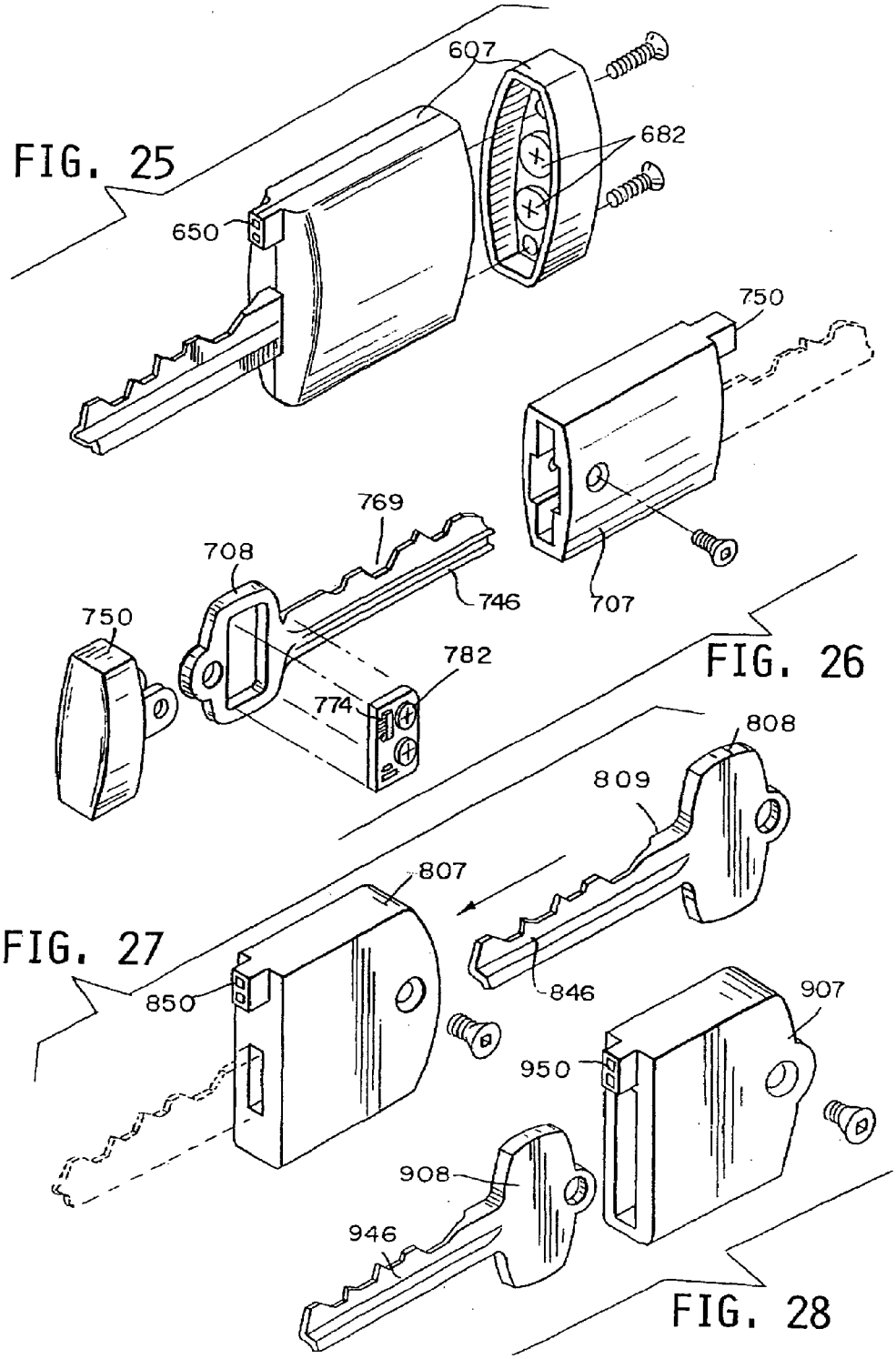
FIG. 25 is a partially exploded view of another preferred embodiment of a bow cover for a token.
FIG. 26 is a partially exploded view of yet another preferred embodiment of a bow cover.
FIG. 27 is a partially exploded view of yet another preferred embodiment of a bow cover.
FIG. 28 is a partially exploded view of yet another preferred embodiment of a bow cover.
Figure 29:
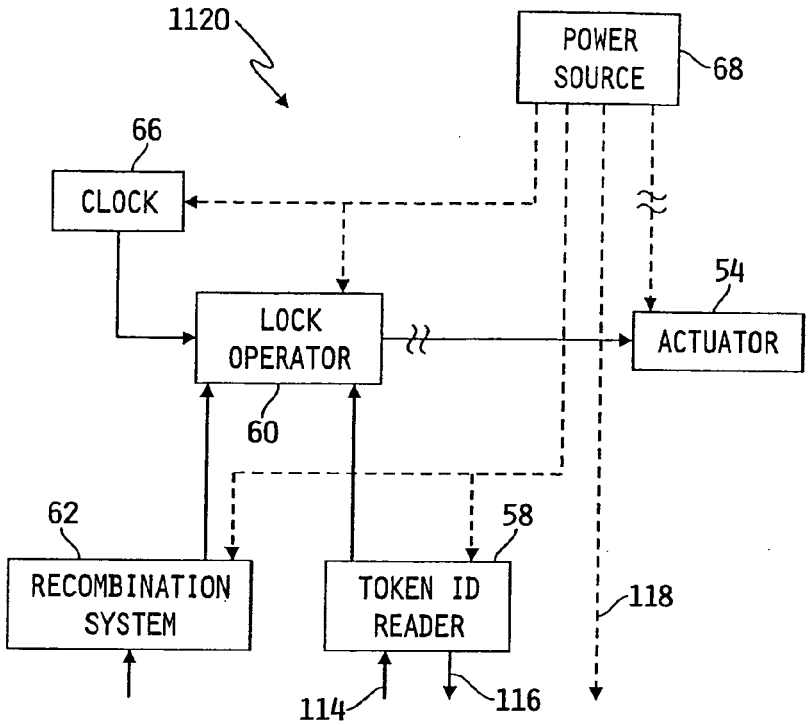
FIGS. 29-44 are flow charts showing the functional operation of several embodiments of the circuit of the electrical portion of the lock core shown in FIGS. 2-4.
Figure 30:
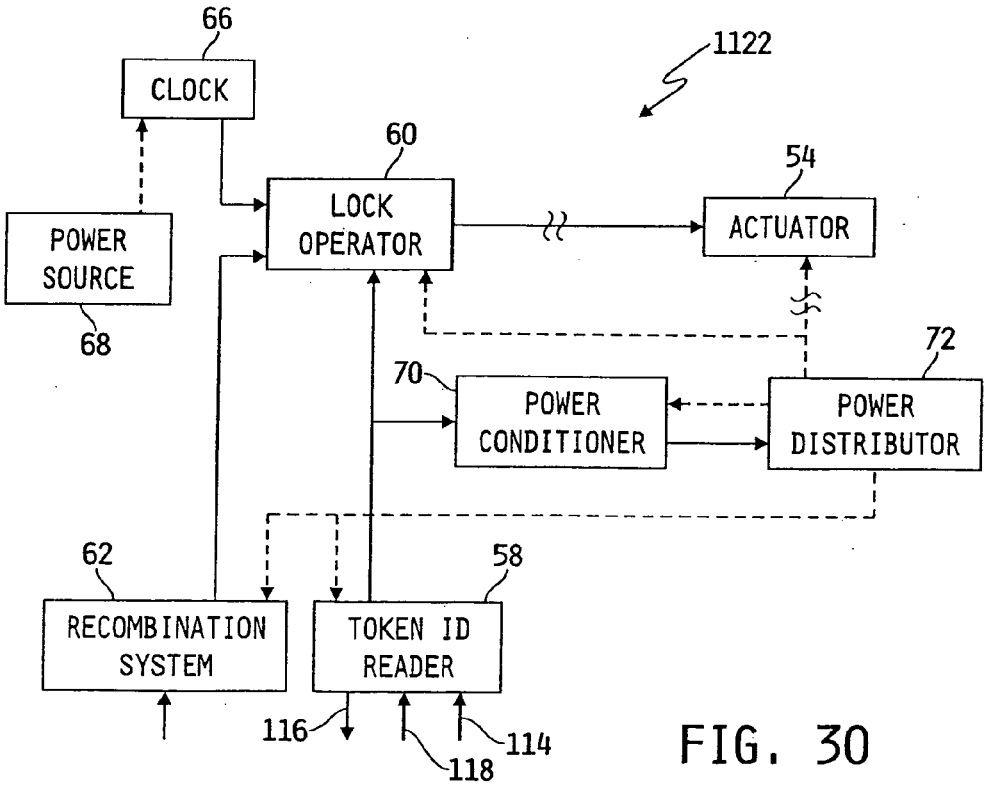
Figure 31:
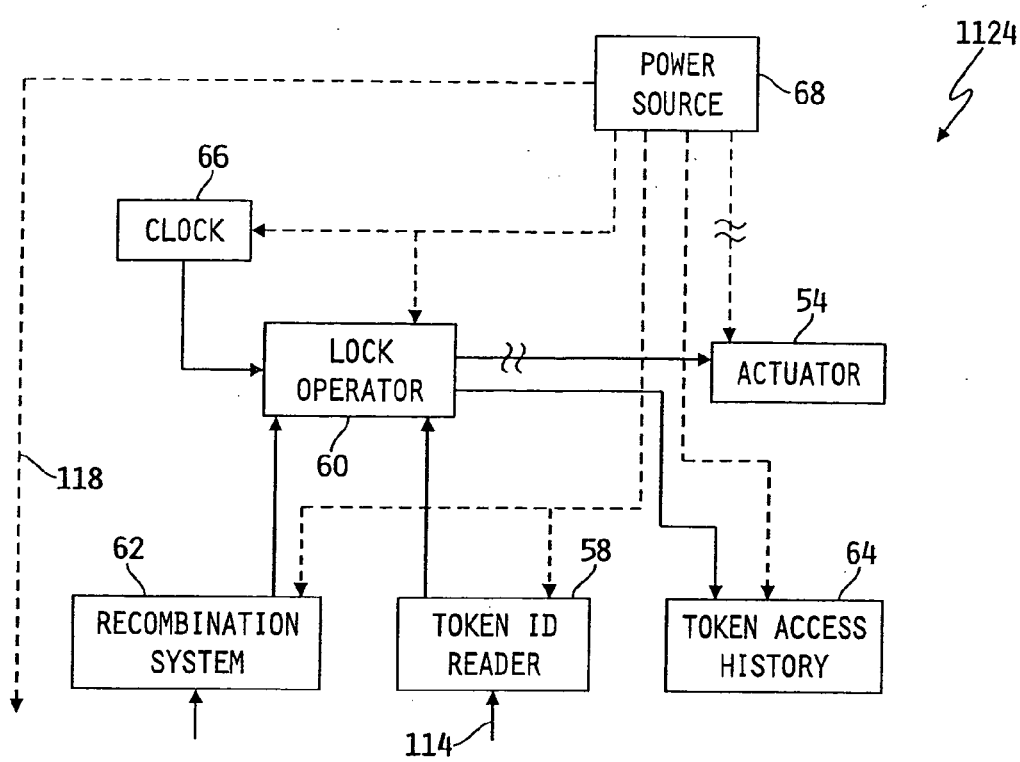
Figure 32:
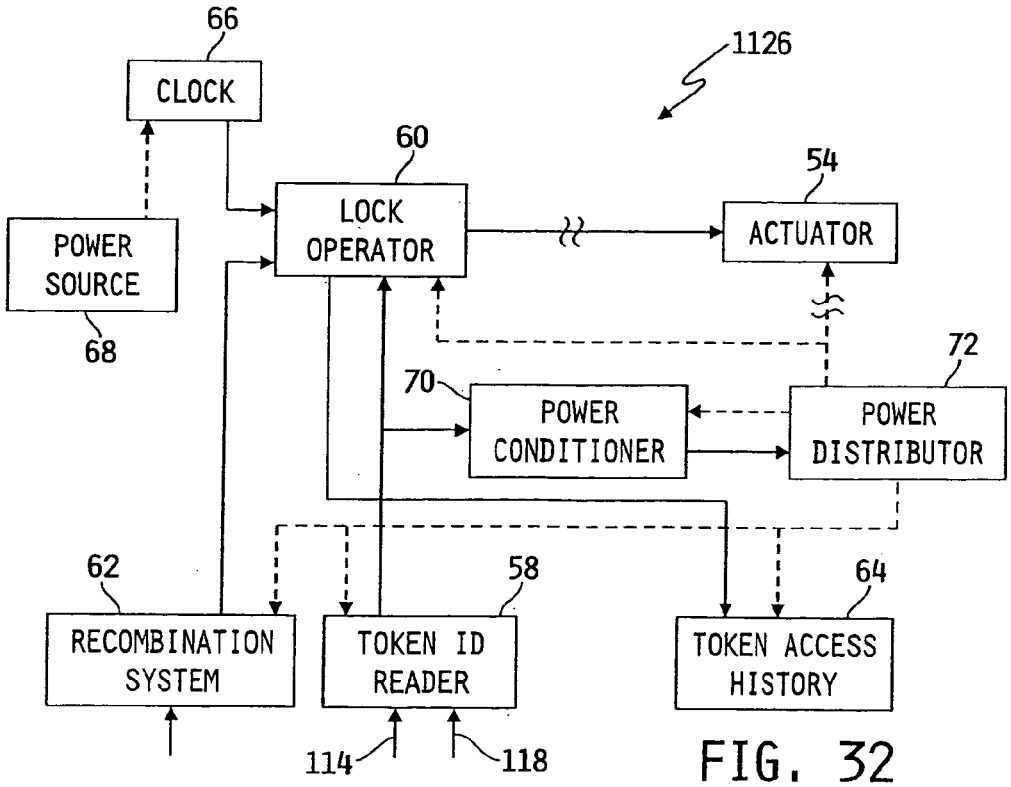
Figure 33:
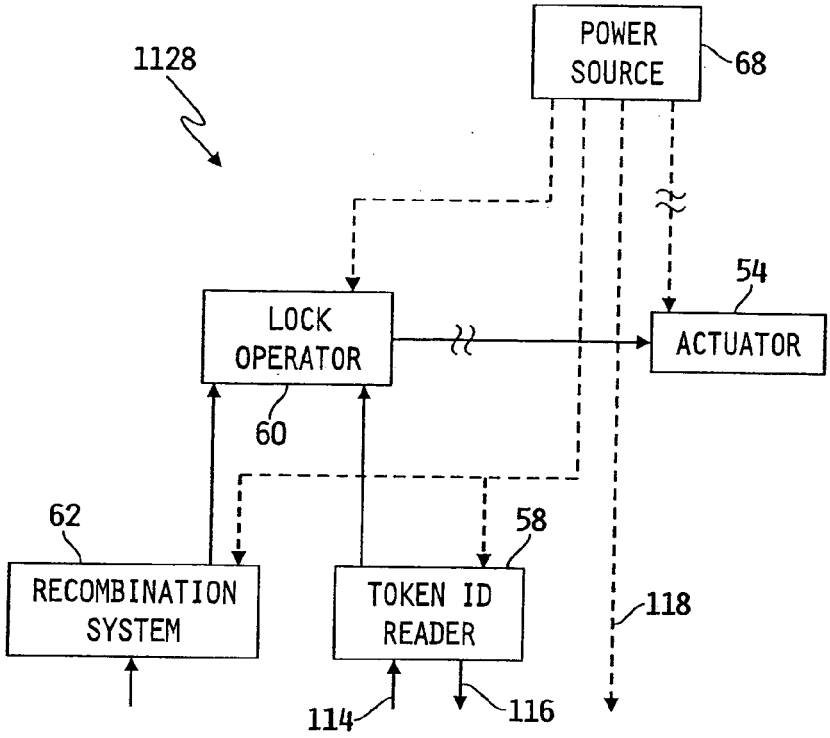
Figure 34:
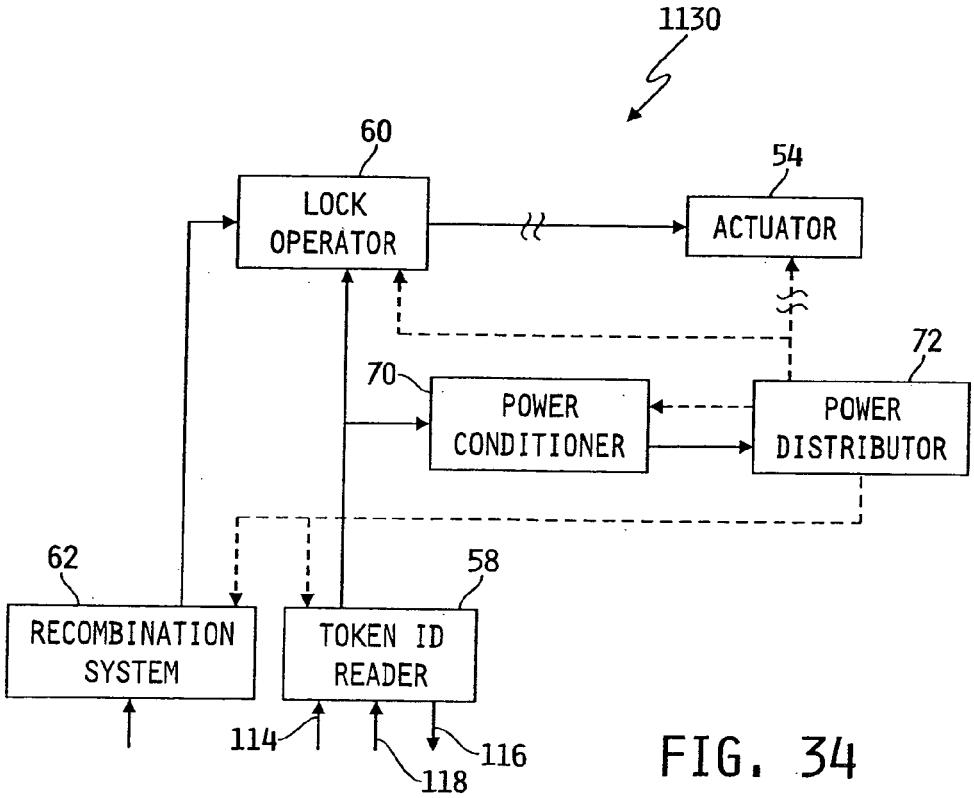
Figure 35:
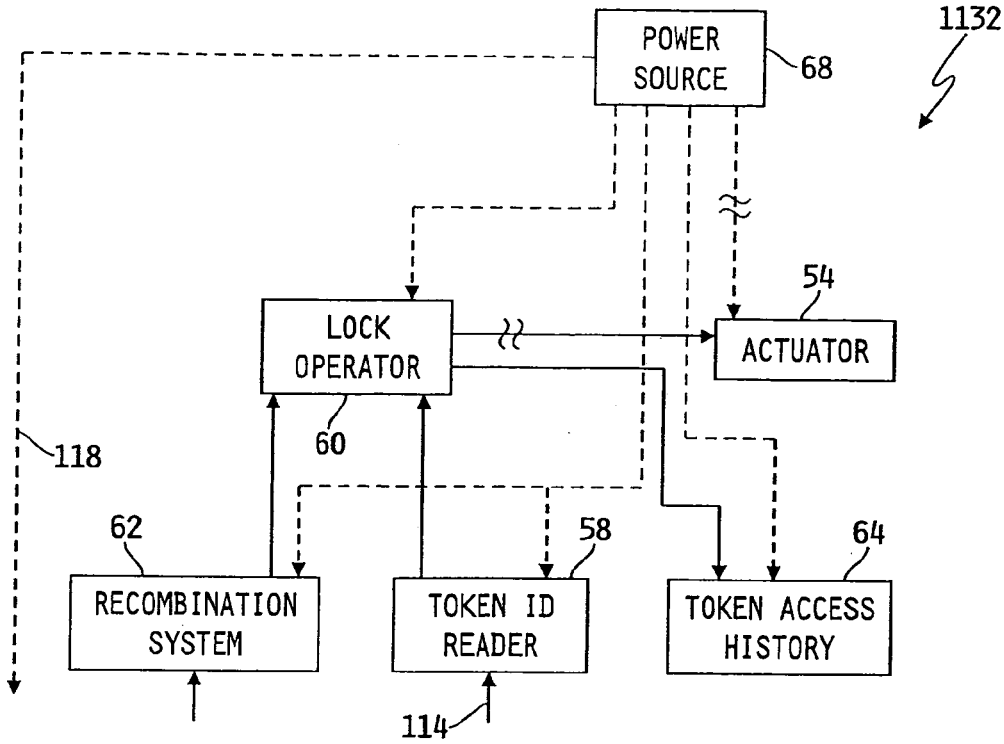
Figure 36:
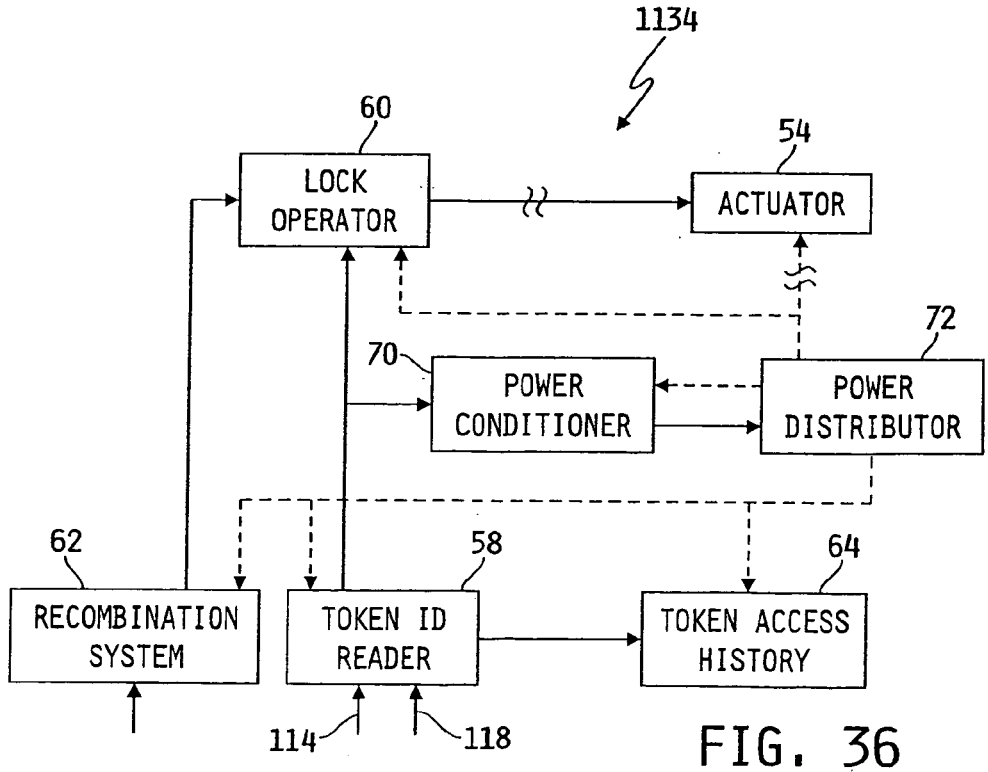
Figure 37:
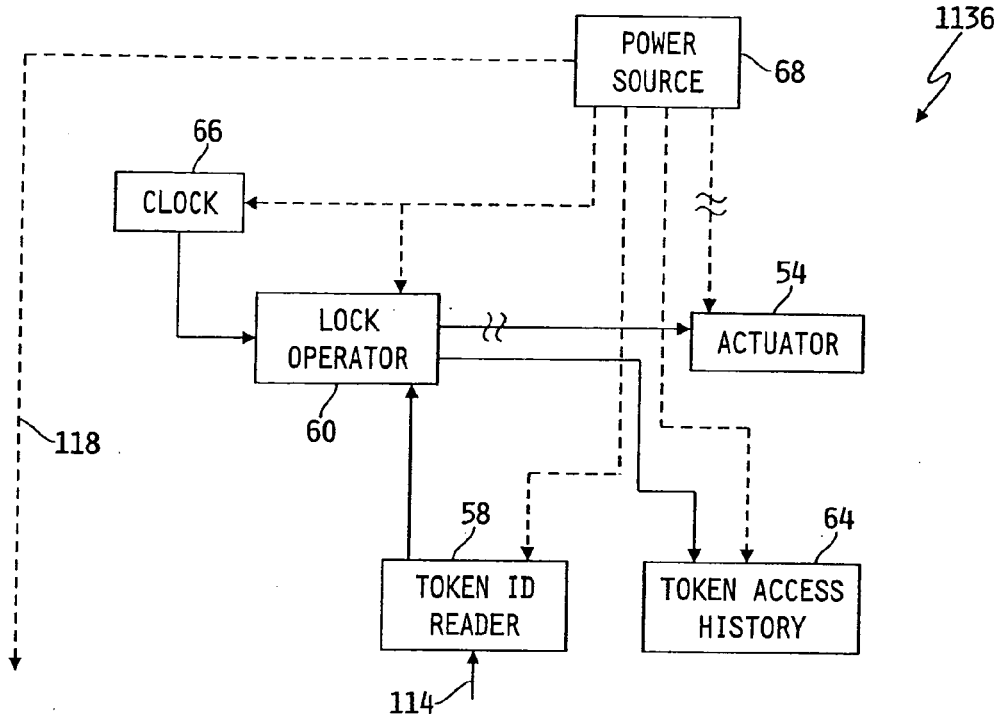
Figure 38:
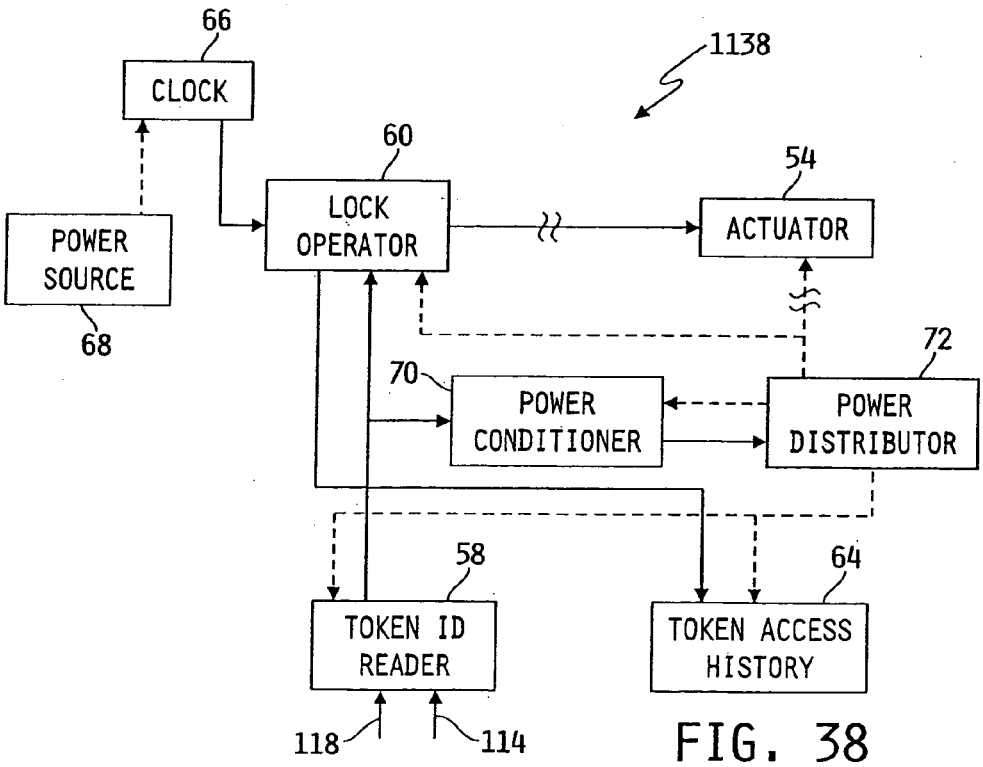
Figure 39:
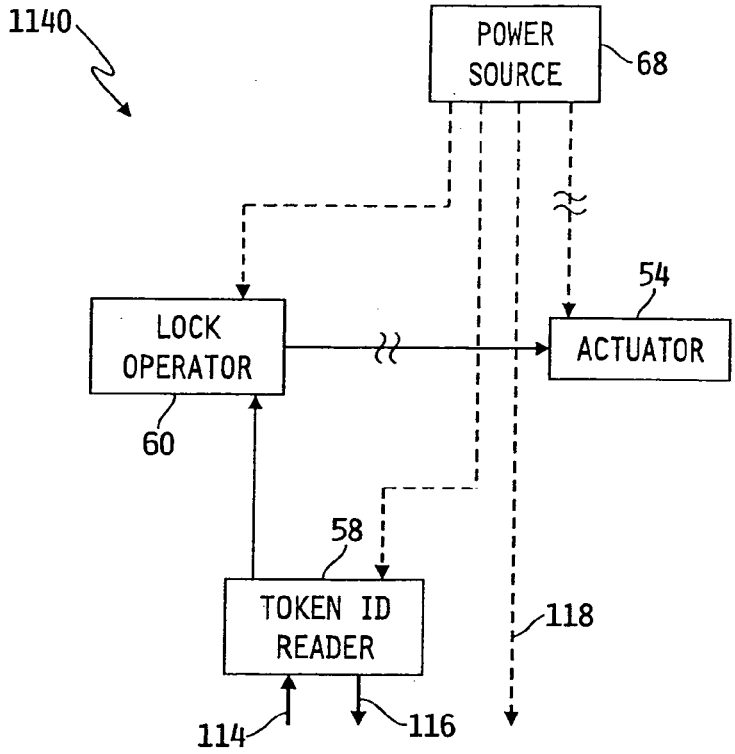
Figure 40:
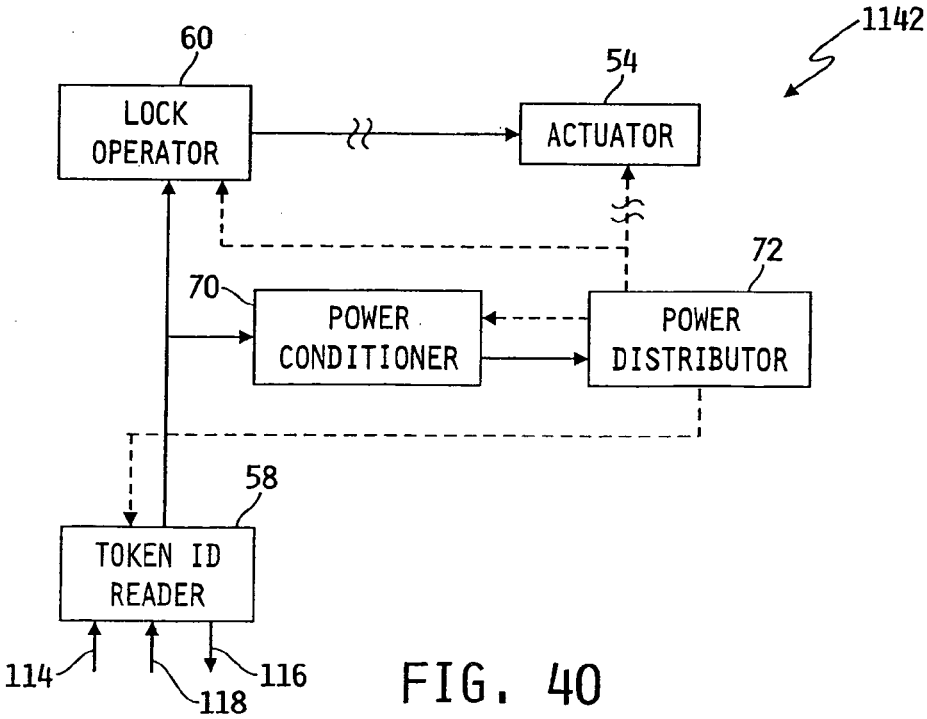
Figure 41:
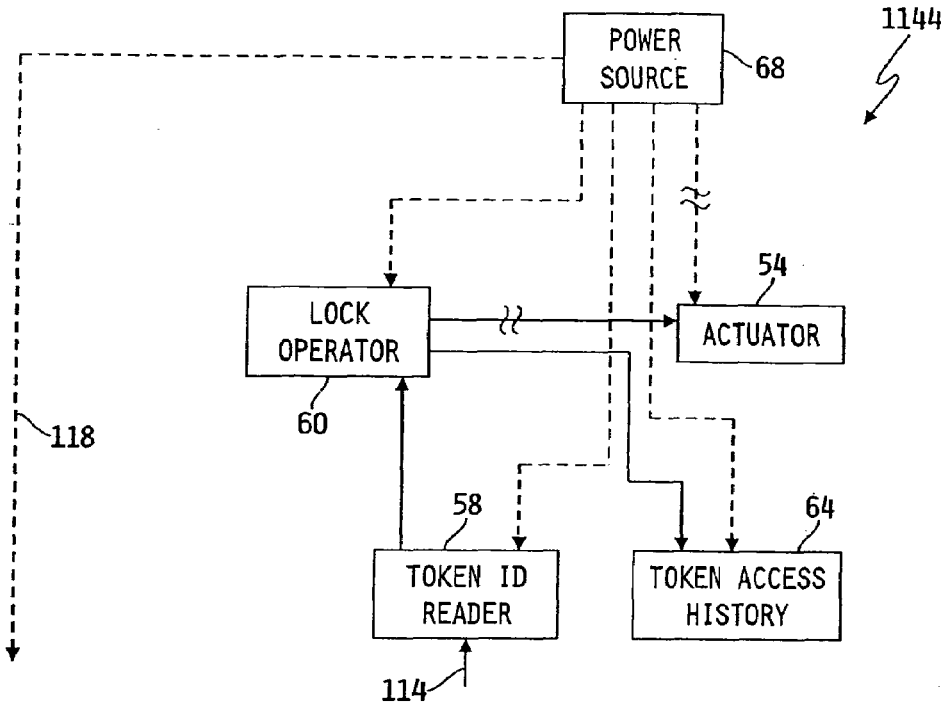
Figure 42:
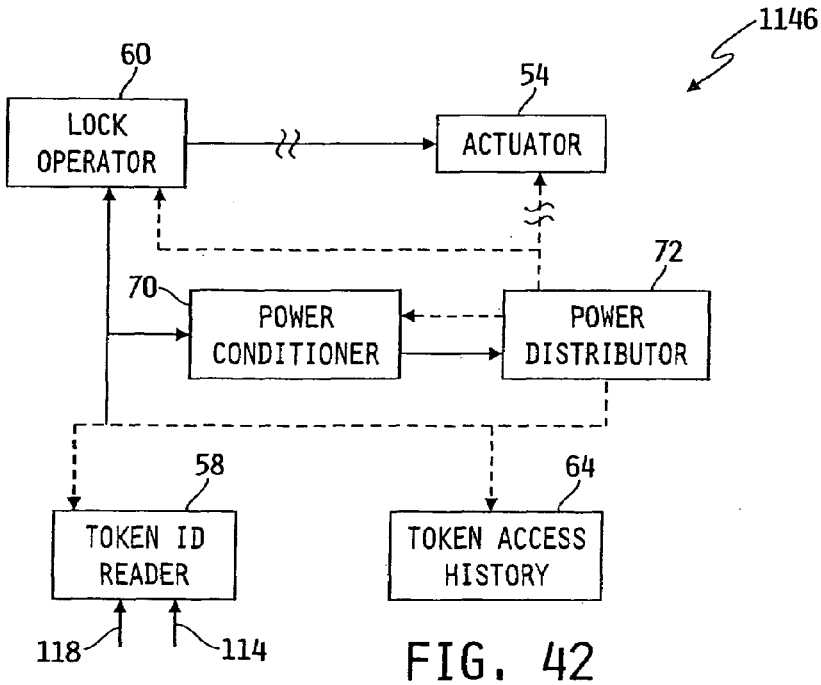
Figure 43:
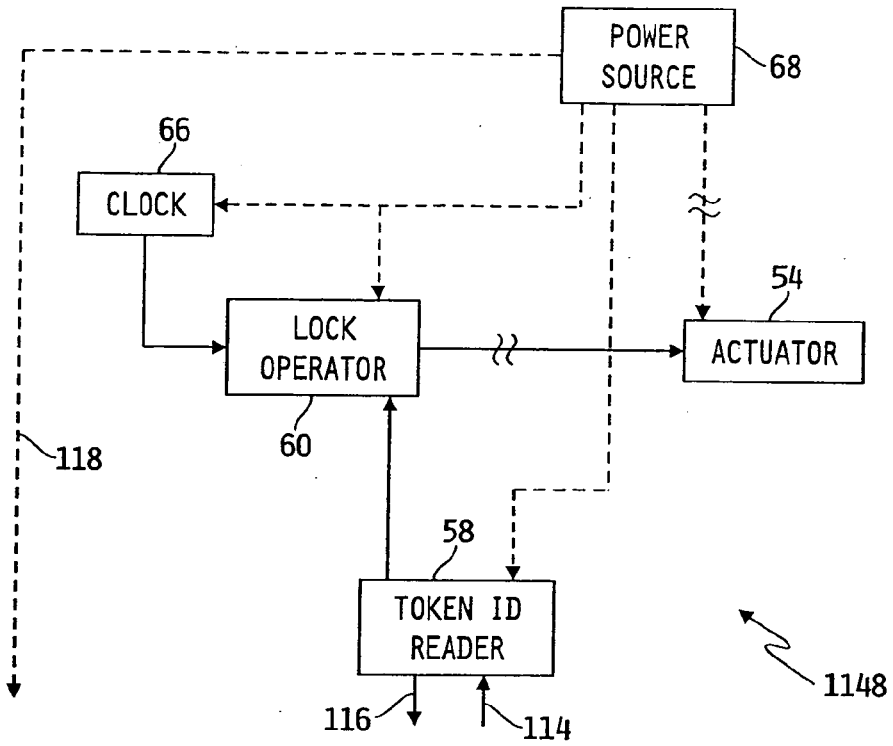
Figure 44:
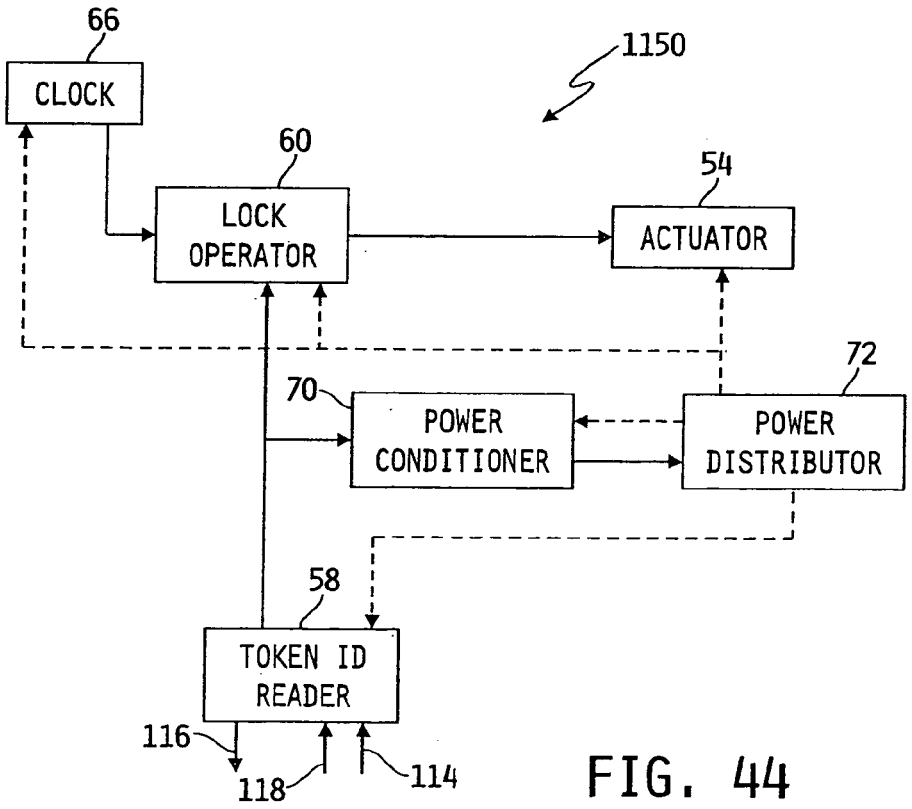
Figure 45:
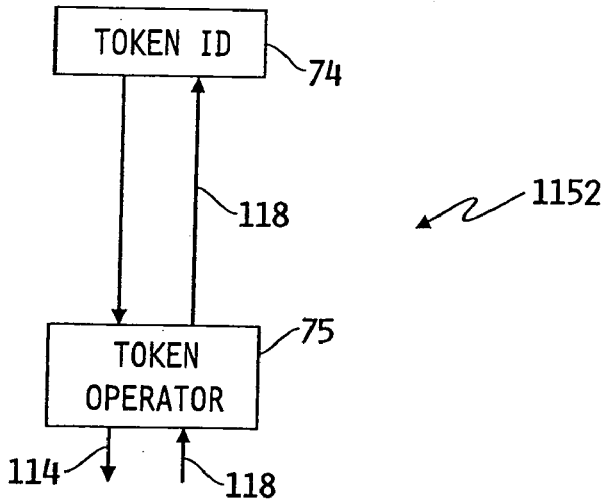
FIGS. 45-50 are flow charts showing the functional operation of several embodiments of the electronic portion of the token shown in FIGS. 2-4.
Figure 46:
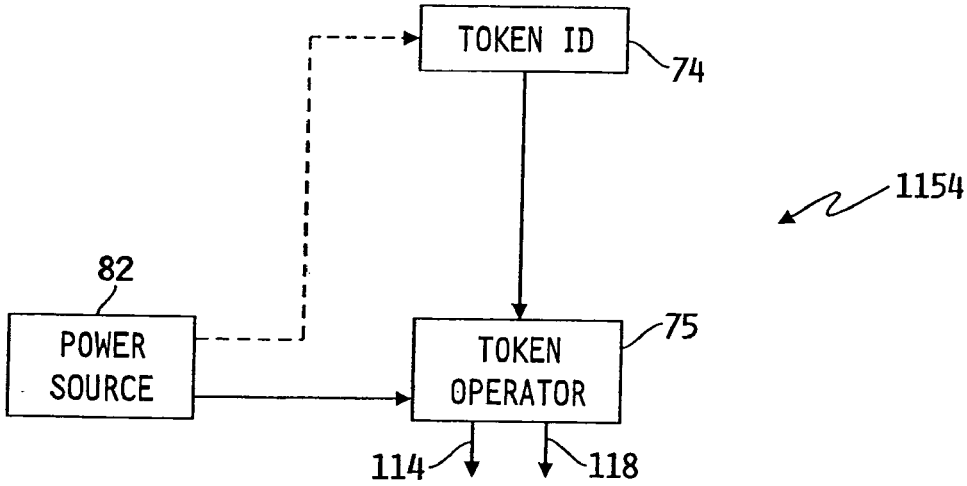
Figure 47:
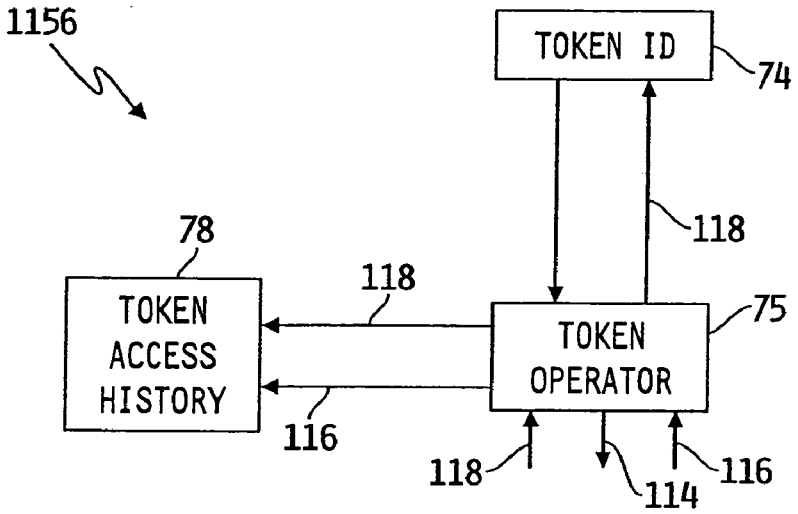
Figure 48:
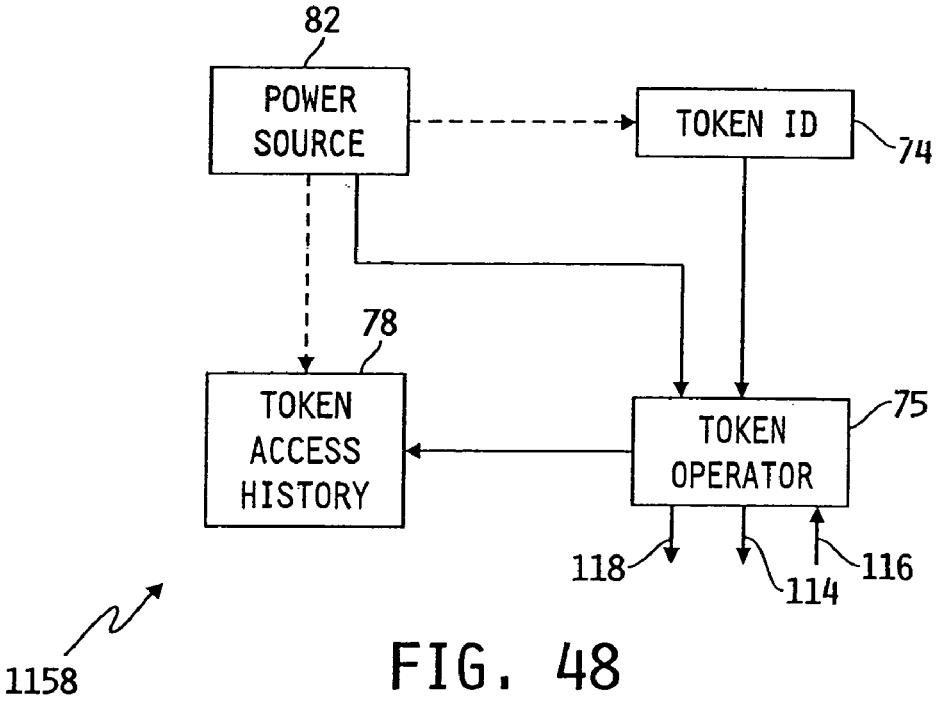
Figure 49:
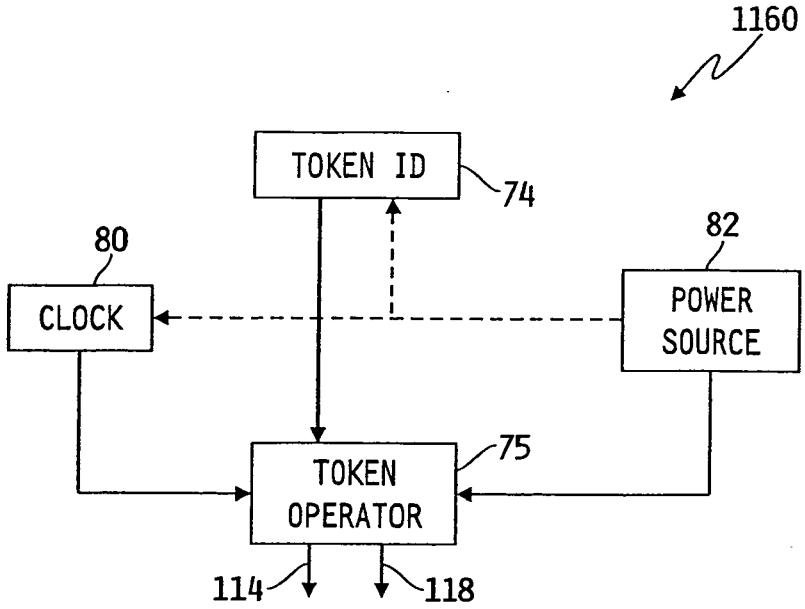
Figure 50:
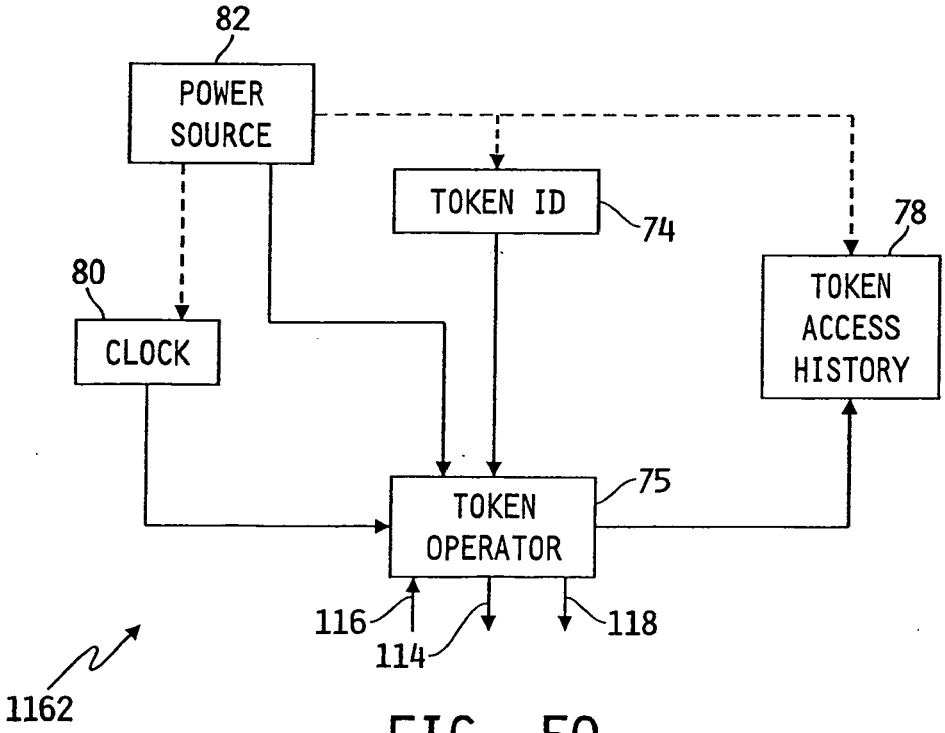
Figure 51:
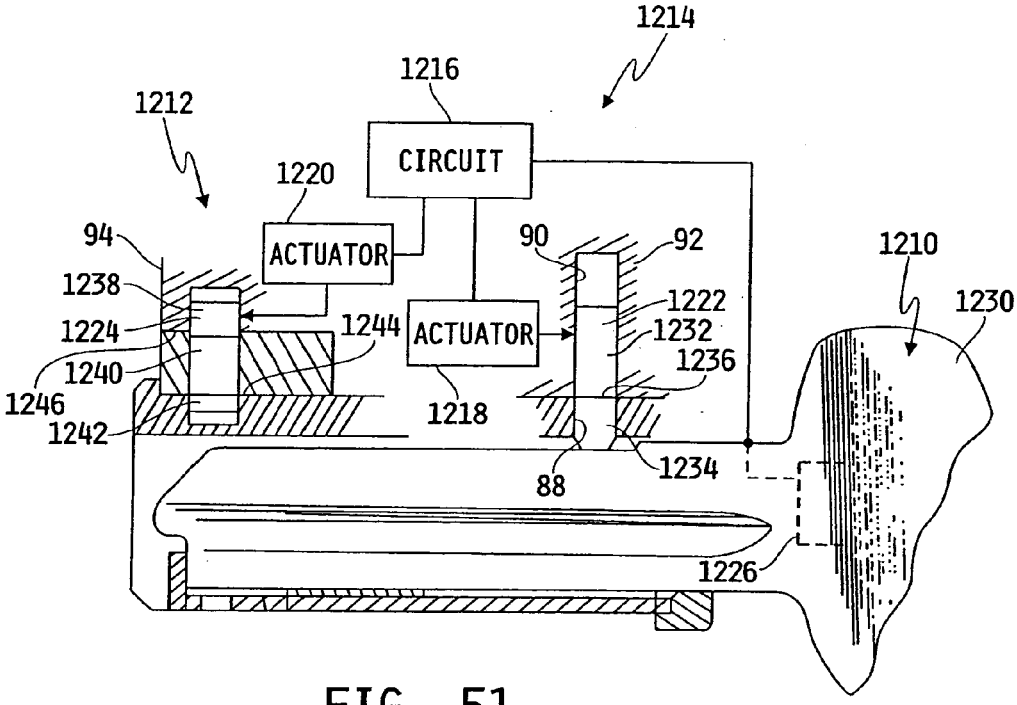
FIG. 51 is a sectional view similar to FIG. 2 of another preferred embodiment of a lock core and token positioned to lie in the lock core showing the lock core including an electrical portion, the token including an electrical portion, and the token being an "operating token" which interacts with the electrical portion of the lock core to permit rotation of a first portion of the lock core.
Figure 52:
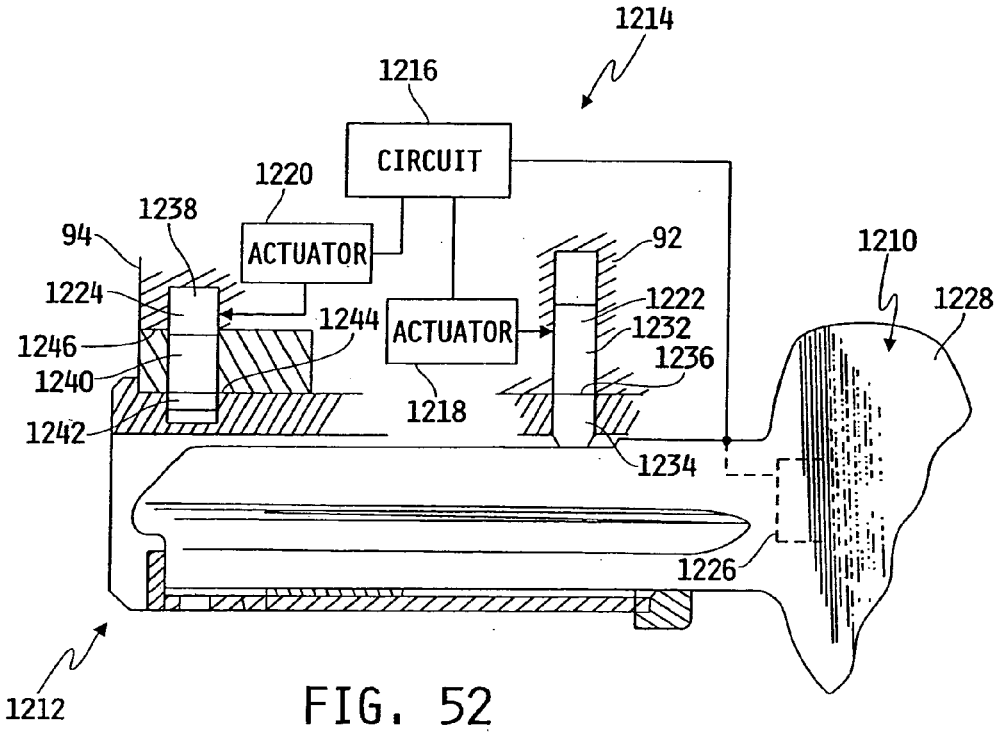
FIG. 52 is a sectional view similar to FIG. 51 showing the lock core of FIG. 51 and a "control" token positioned to lie in the lock core, the "control" token includes an electrical portion which interacts with the electrical portion of the lock core to permit rotation of a second portion of the lock core.
Figure 53:
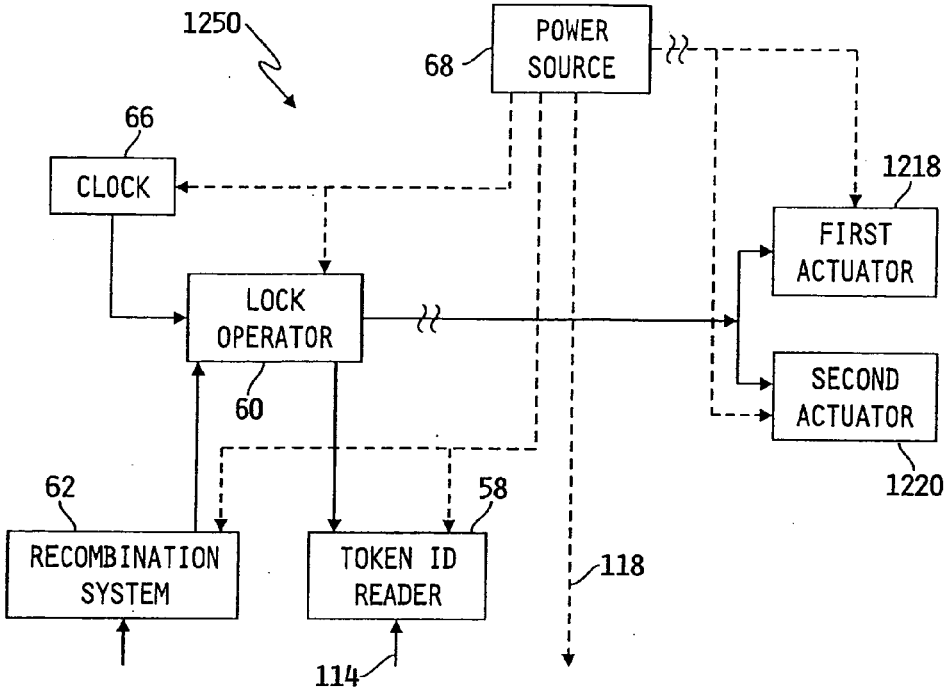
FIGS. 53-68 are flow charts showing the functional operation of the circuit of the electrical portion of the lock core shown in FIGS. 51 and 52.
Figure 54:
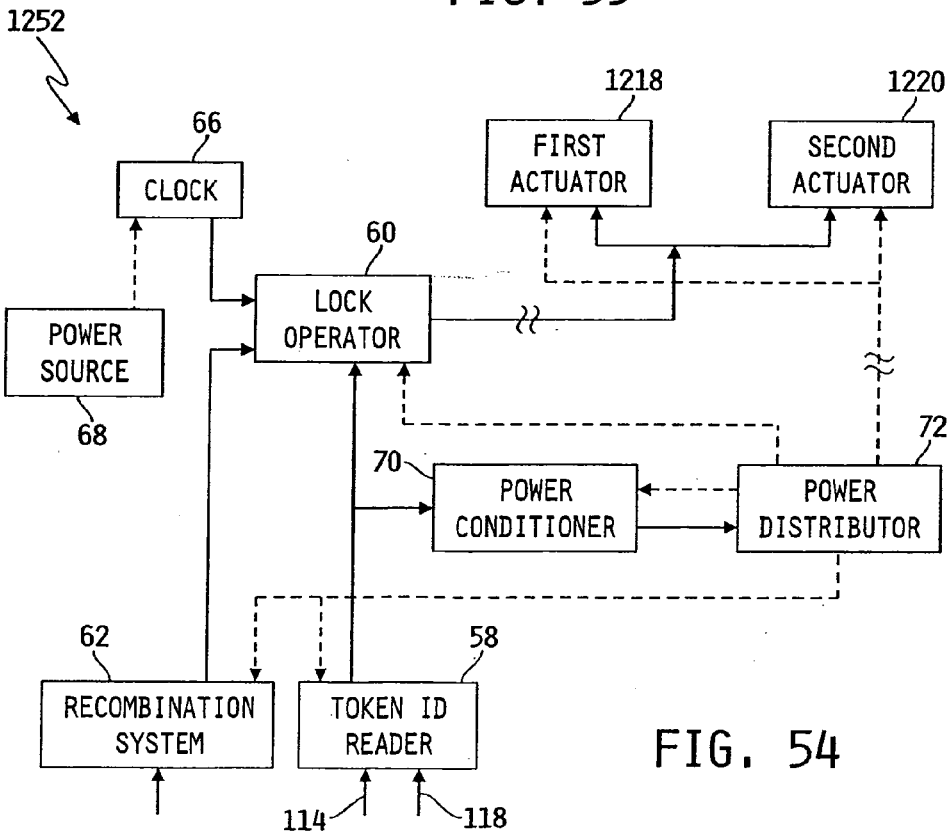
Figure 55:
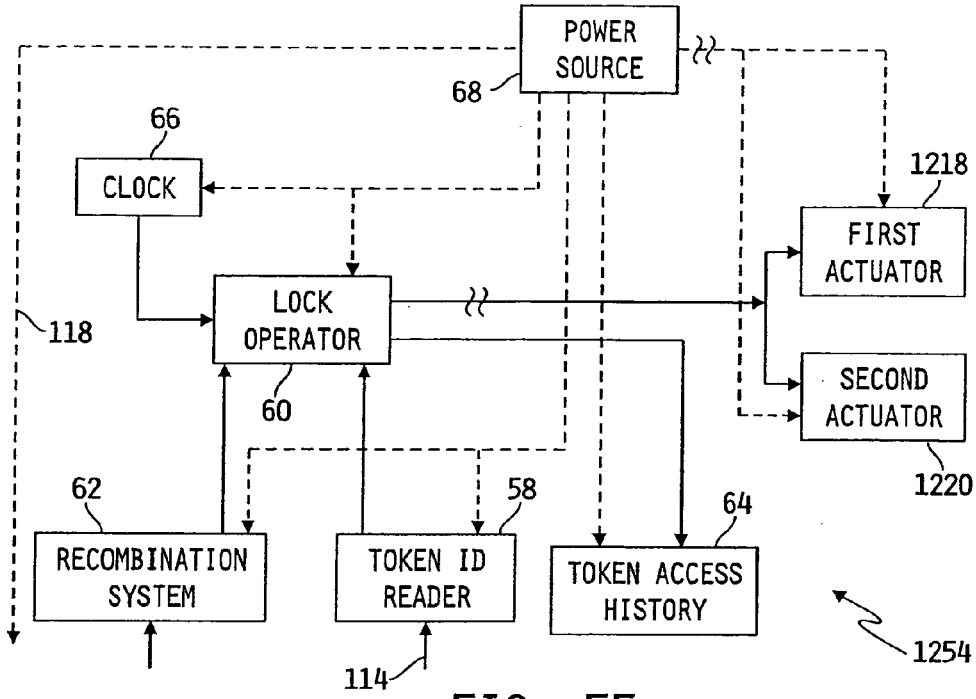
Figure 56:
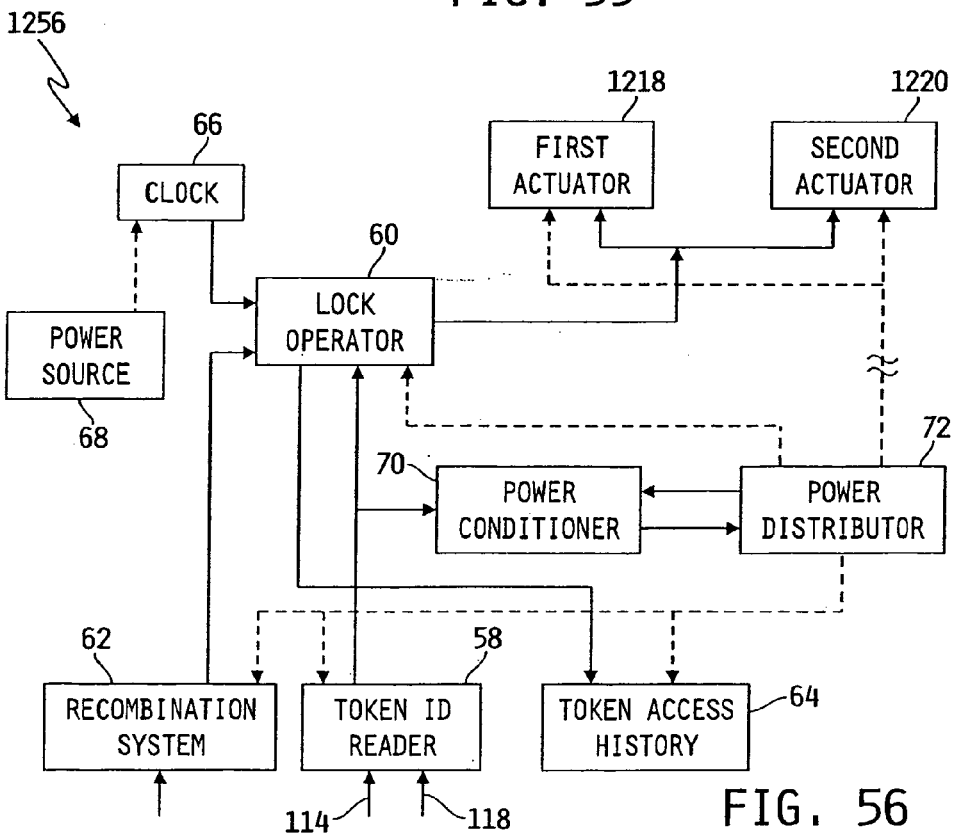
Figure 57:
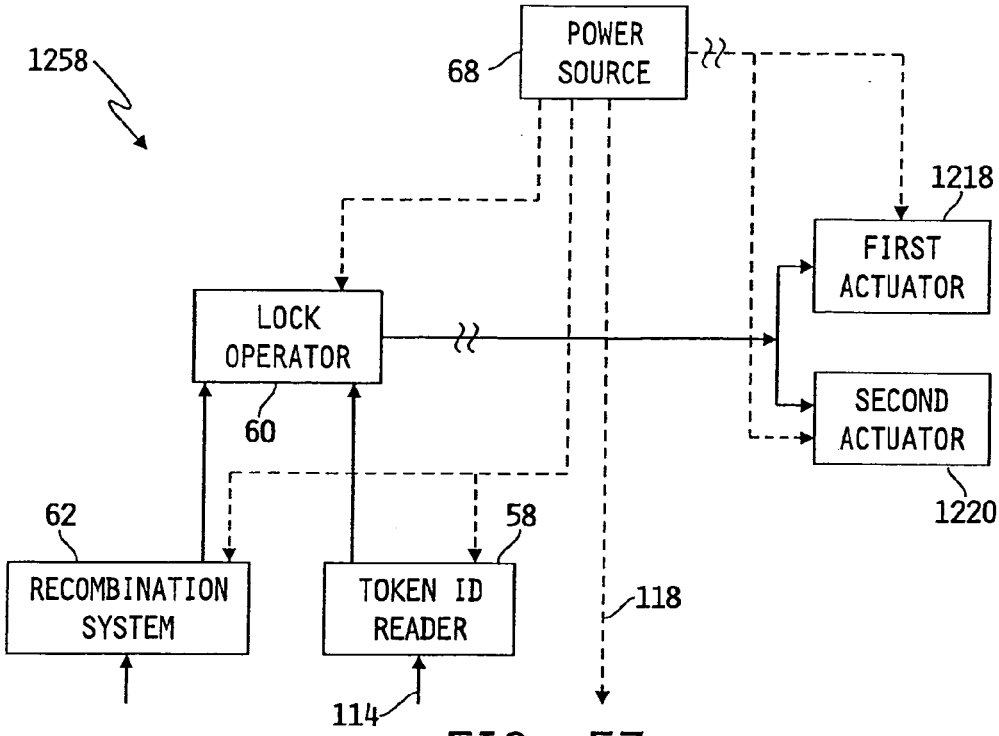
Figure 58:
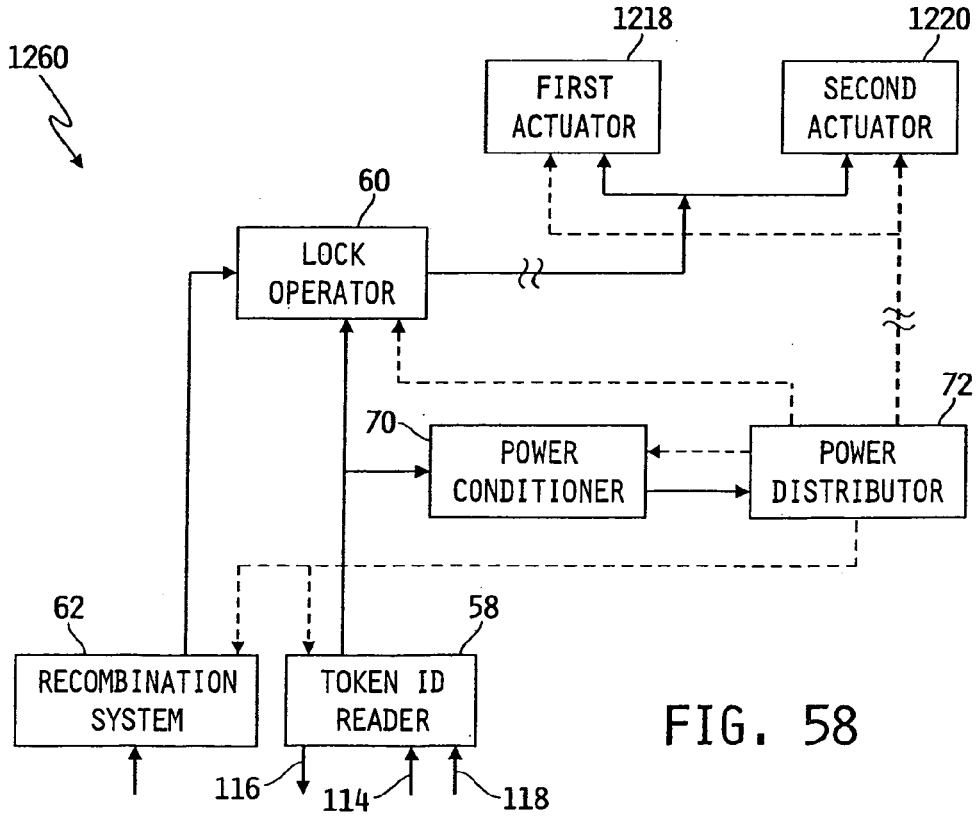
Figure 59:
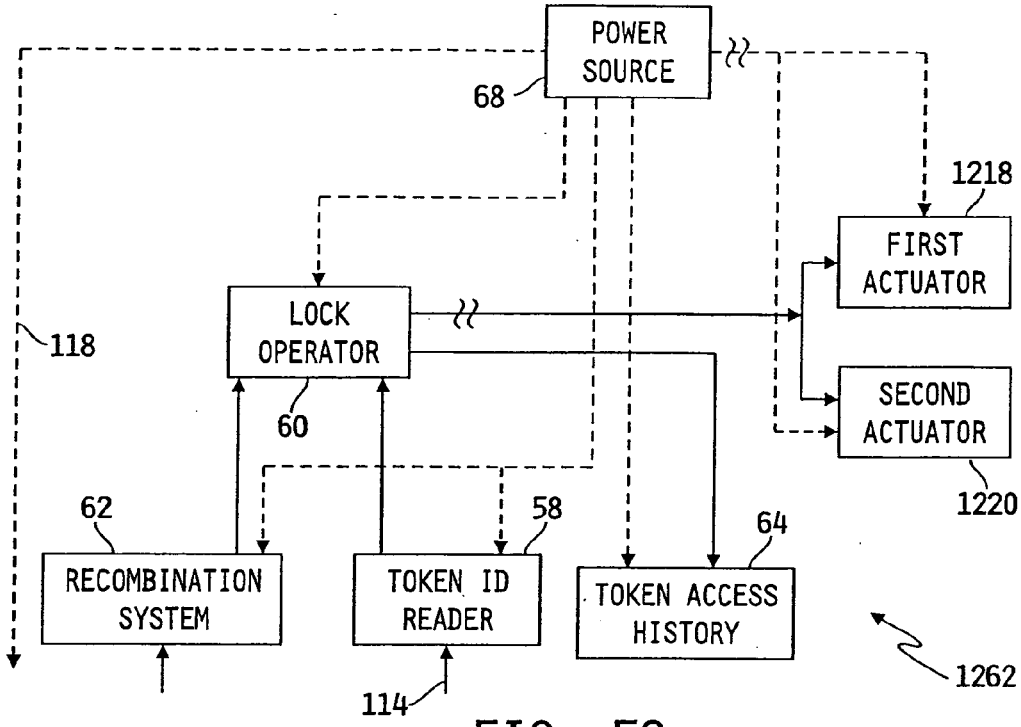
Figure 60:
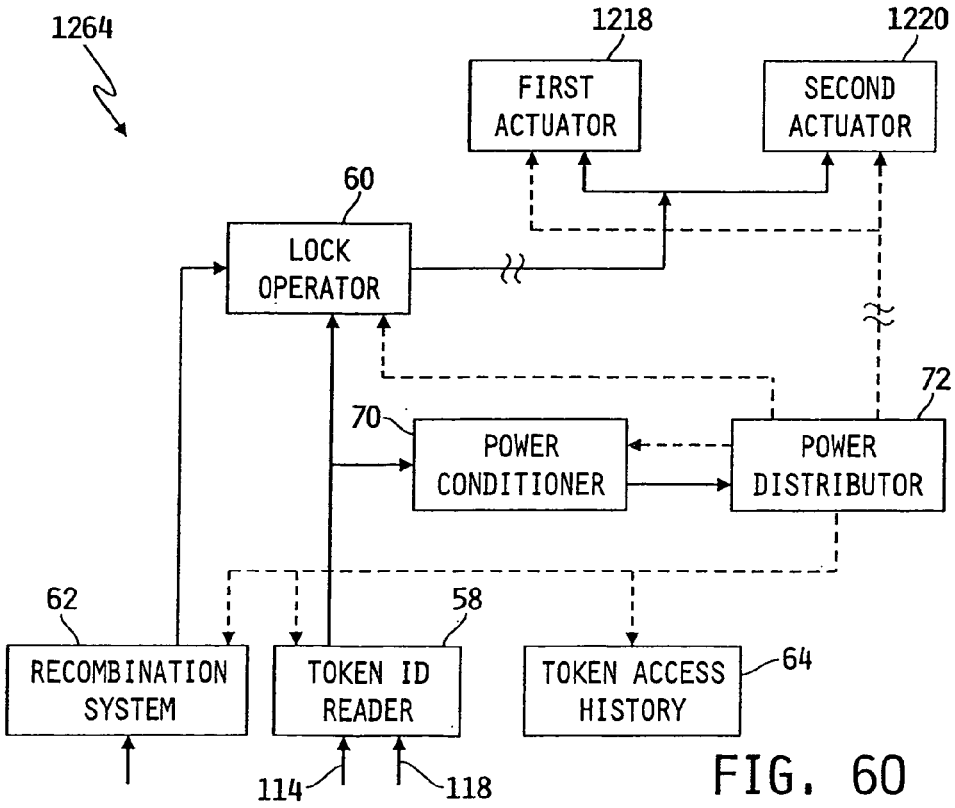
Figure 61:
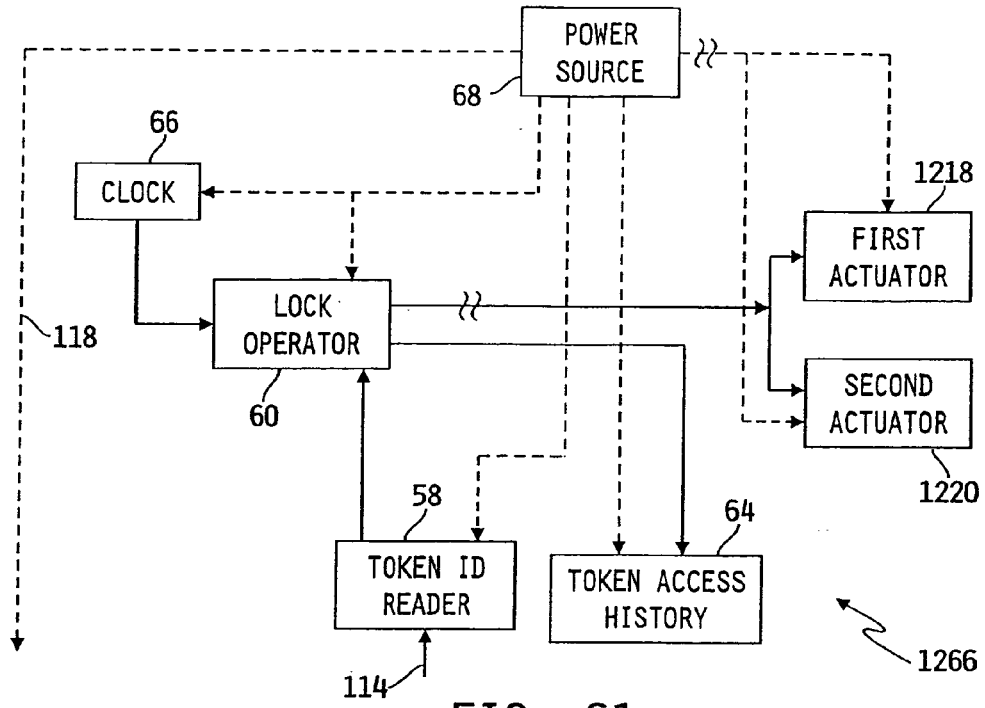
Figure 62:
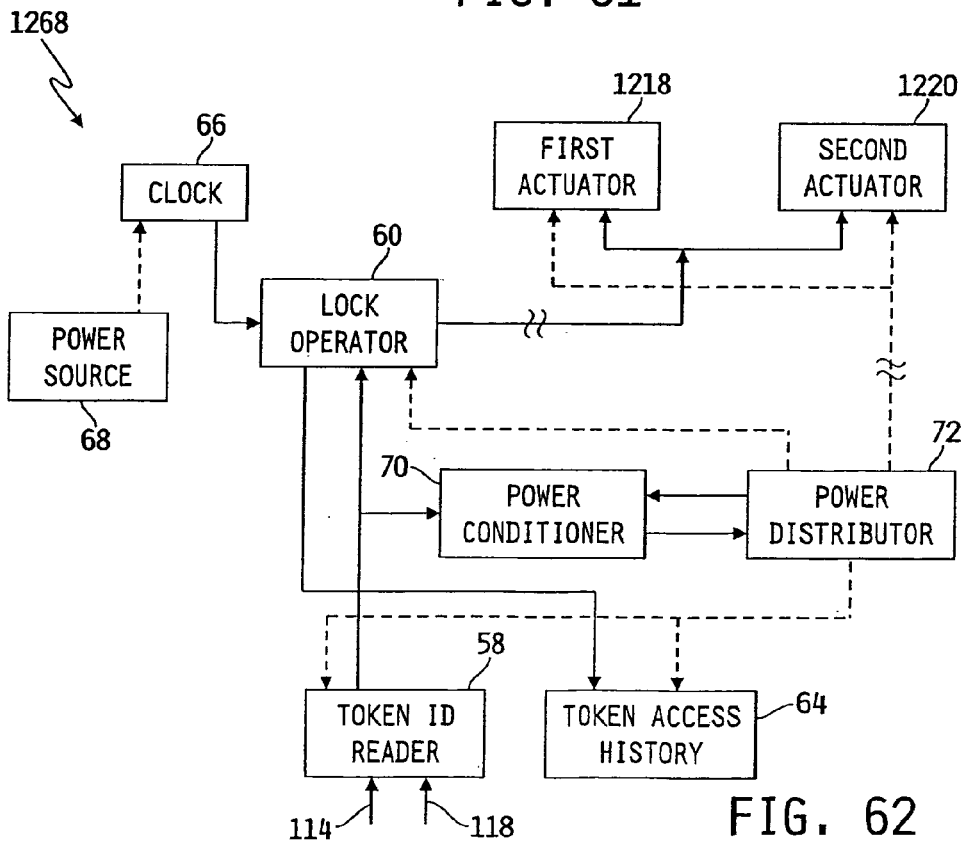
Figure 63:
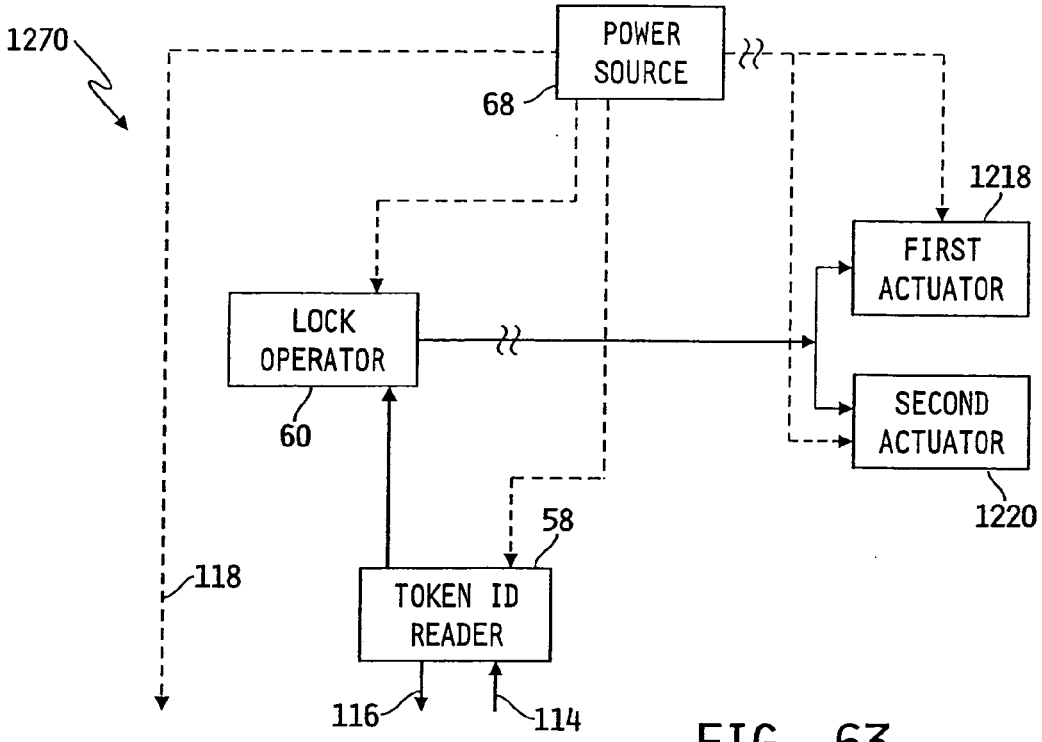
Figure 64:
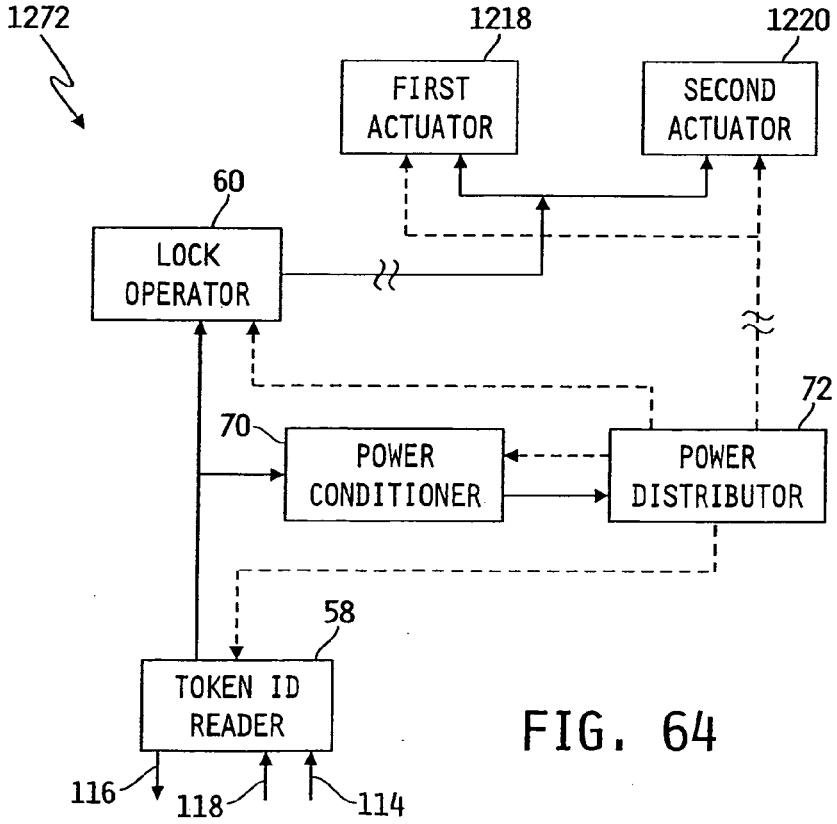
Figure 65:
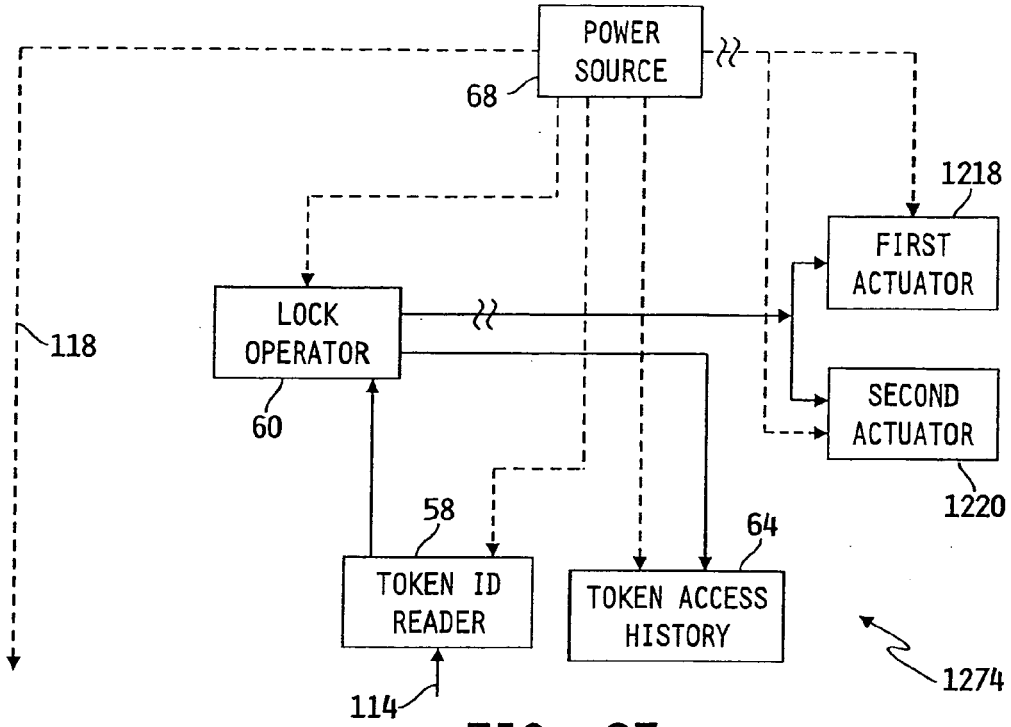
Figure 66:
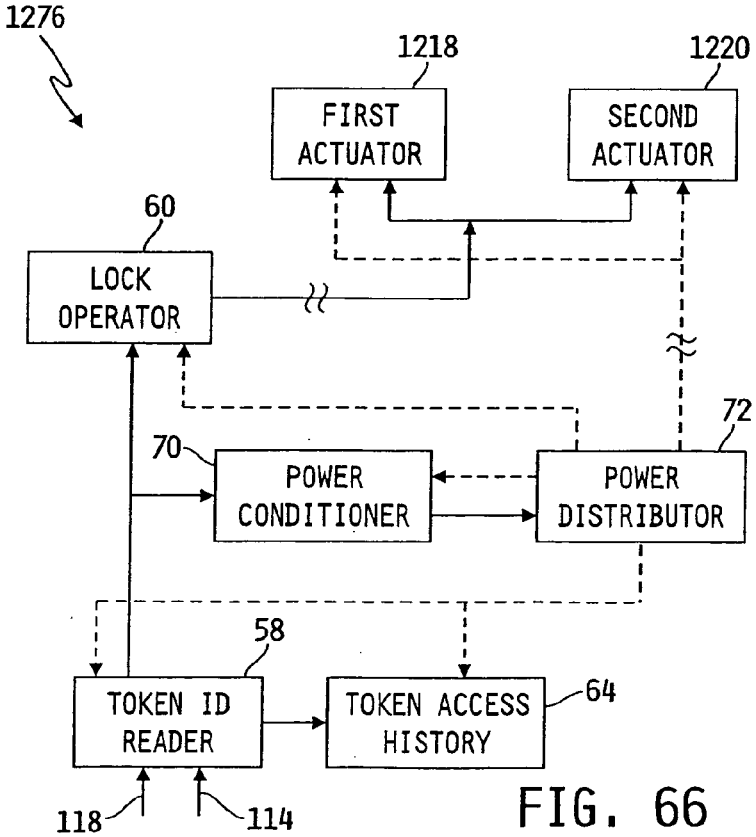
Figure 67:
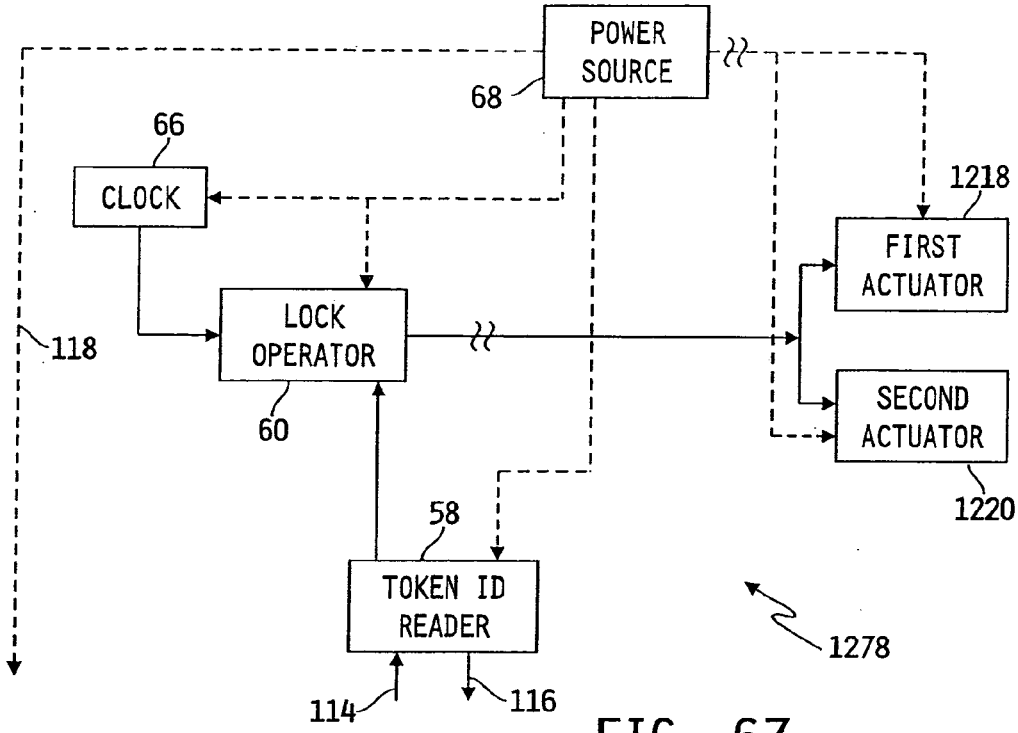
Figure 68:
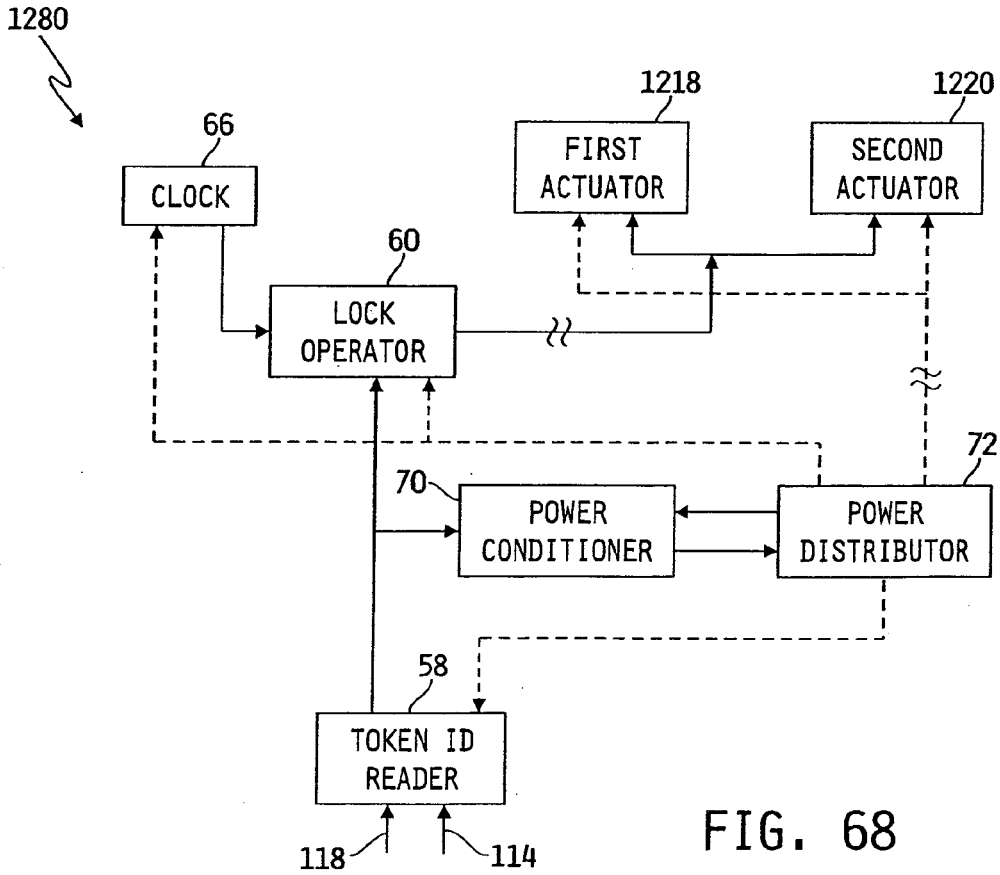
Figure 69:
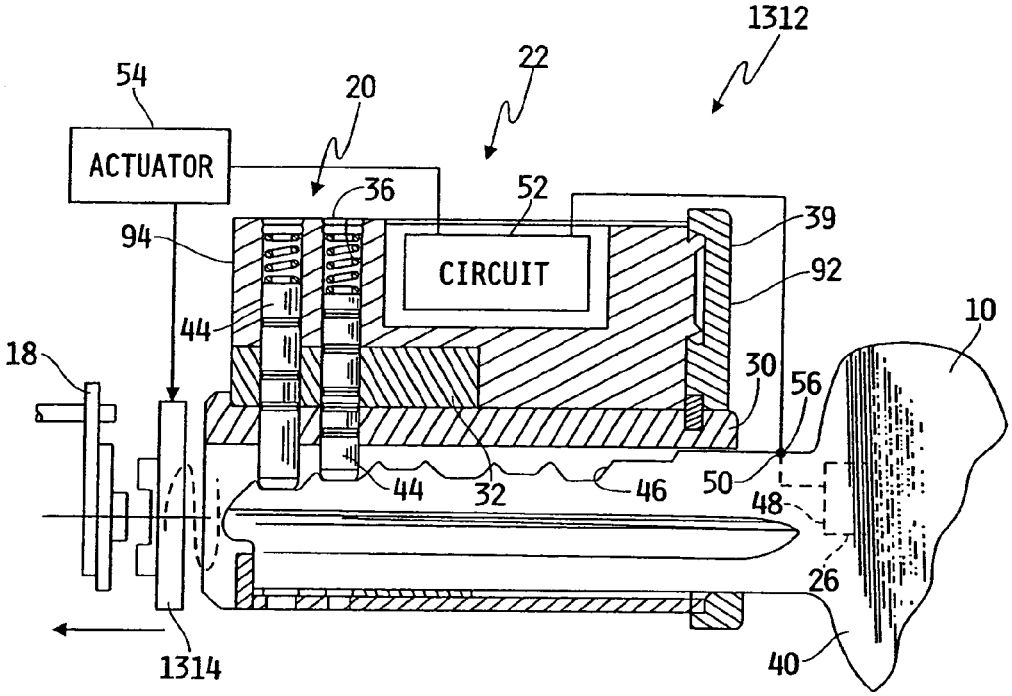
FIG. 69 is a sectional view similar to FIGS. 2 and 51 of yet another alternative embodiment of a lock core showing the lock core having an electrical portion and a mechanical portion.
Figure 70:
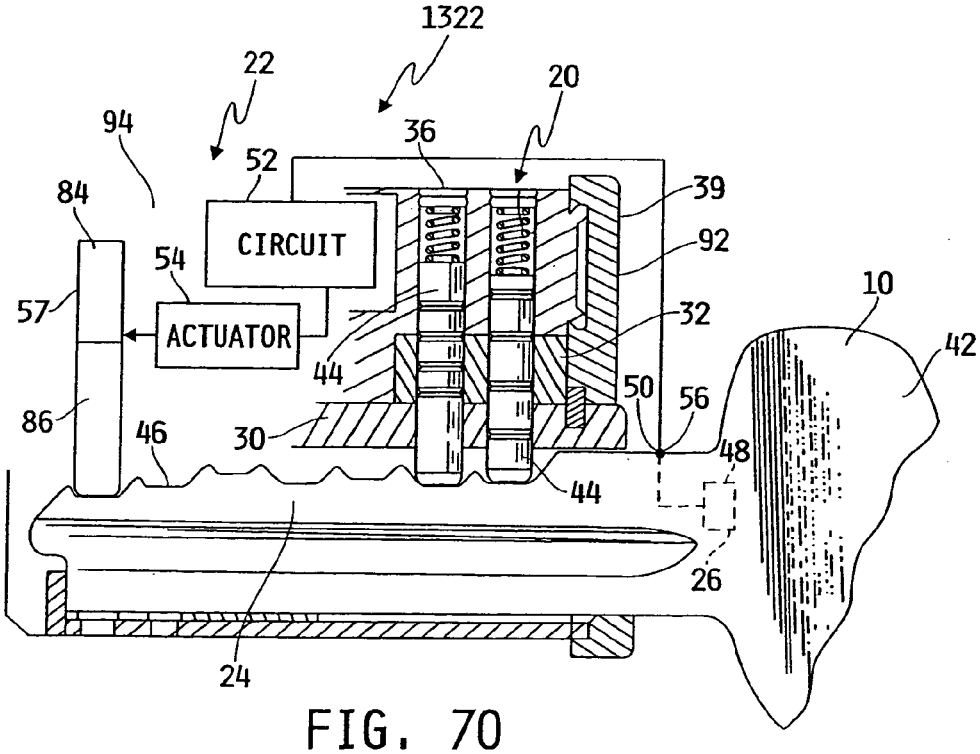
FIG. 70 is a sectional view similar to FIGS. 2, 51, and 69 of yet another alternative embodiment of a lock core showing the lock core having an electrical portion and a mechanical portion.
Figure 71:
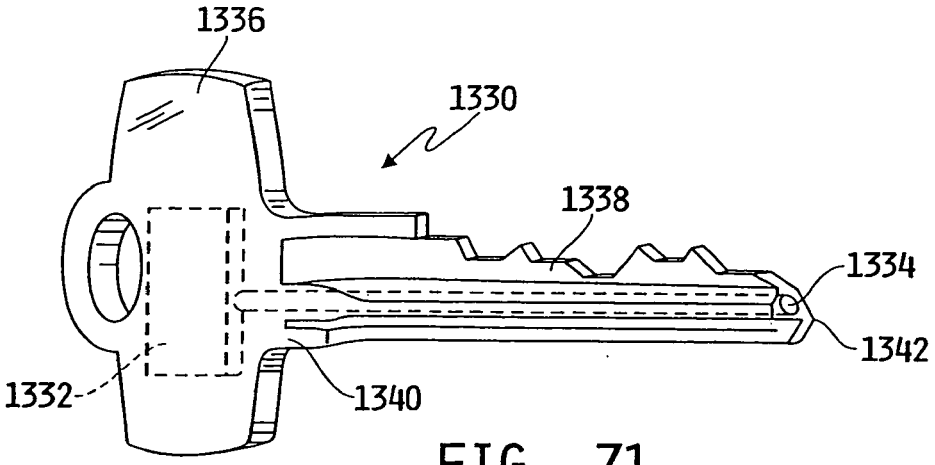
FIG. 71 is a perspective view of a token according to the present invention showing the token including a bow, a blade having a proximal end coupled to the bow and a distal end spaced apart from the bow, and an electrical portion (phantom lines) having an electrical contact positioned to lie at the distal end of the blade.
Figure 72:
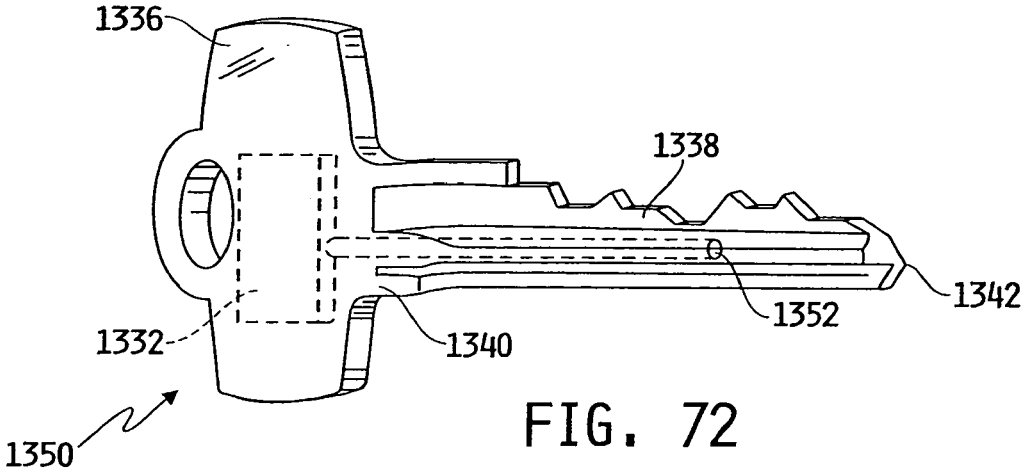
FIG. 72 is a perspective view of a token according to the present invention showing the token including an electrical portion (phantom lines) having an electrical contact positioned to lie on the blade between the proximal and distal ends of the blade.
Figure 73:
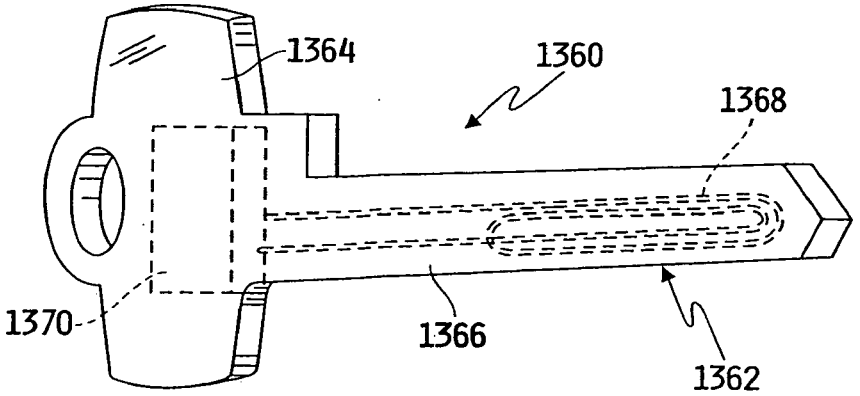
FIG. 73 is a perspective view of a token according to the present invention showing the token including an electrical portion (phantom lines) having an inductance coil positioned to lie in the blade.
Figure 74:
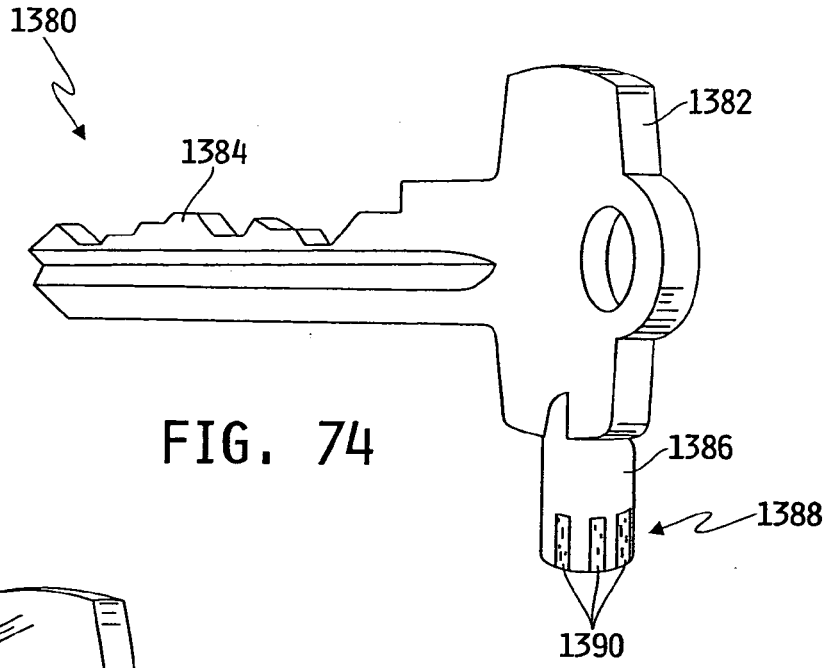
FIG. 74 is a perspective view of a token having a bow, a bitted blade coupled to the bow, and a cylindrical blade having electrical contacts coupled to the bow, the cylindrical blade extending substantially perpendicular to the bitted blade.
Figure 75:
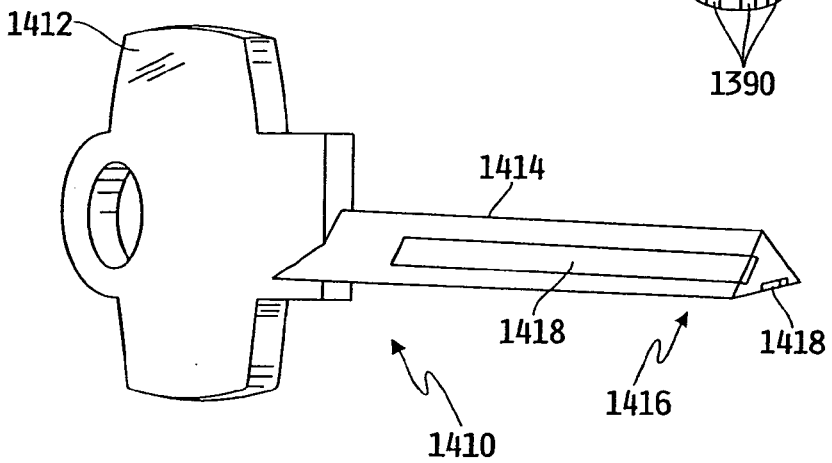
FIG. 75 is a perspective view of a token having a bow and a blade coupled to the bow, the blade having a triangular cross section to define three surfaces and electrical contacts on two of the surfaces.
Figure 76:
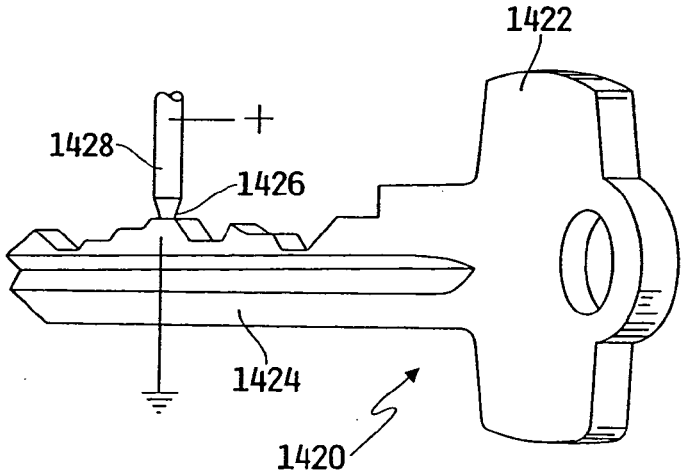
FIG. 76 is a perspective view of a key showing the key having a bitted blade and an electrical contact on the bitted blade.
Figure 77:
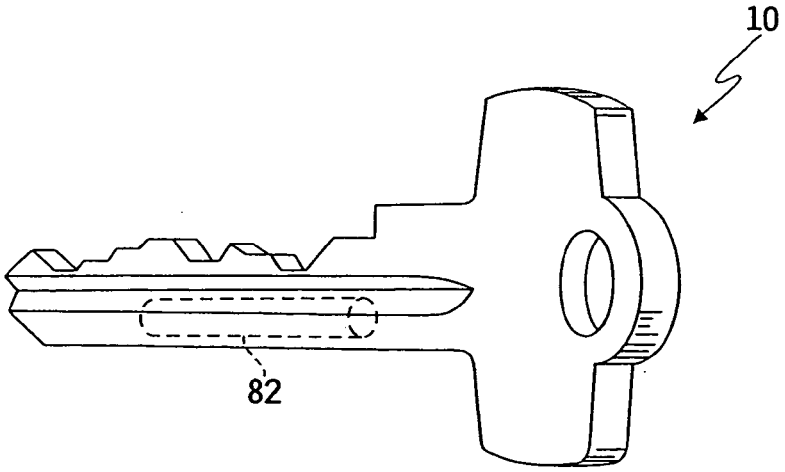
FIG. 77 is a perspective view of a token according to the present invention showing the token including a power source (phantom lines) positioned to lie in the blade of the token.
Figure 78:
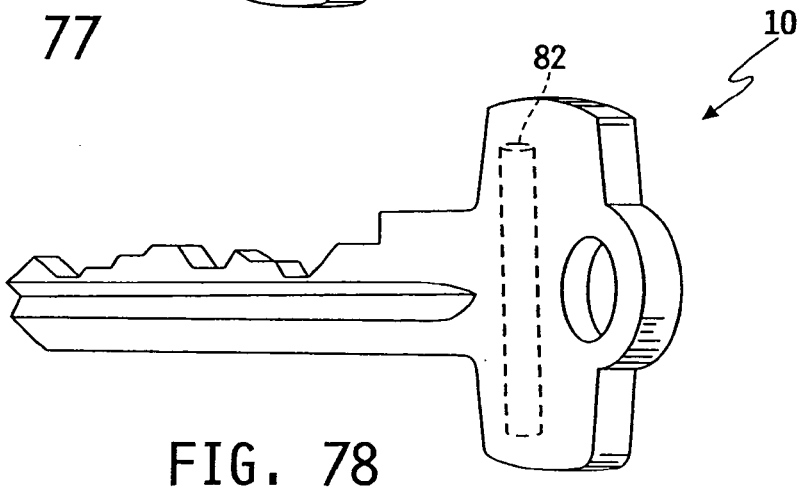
FIG. 78 is a perspective view of another token according to the present invention showing the token including a power source (phantom lines) positioned to lie in the bow of the token.
Figure 79:
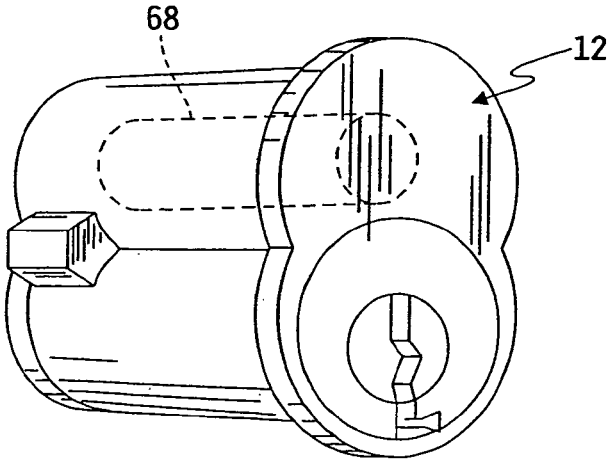
FIG. 79 is a perspective view of a lock core according to the present invention showing the lock core including a power source (phantom lines)
Figure 80:
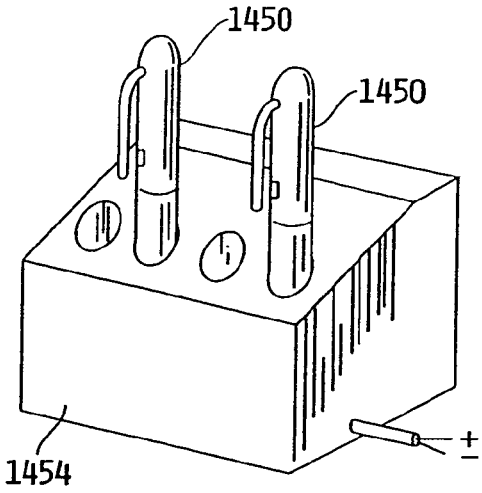
FIG. 80 is a perspective view of a power charger used to recharge power to tokens.
Figure 81:
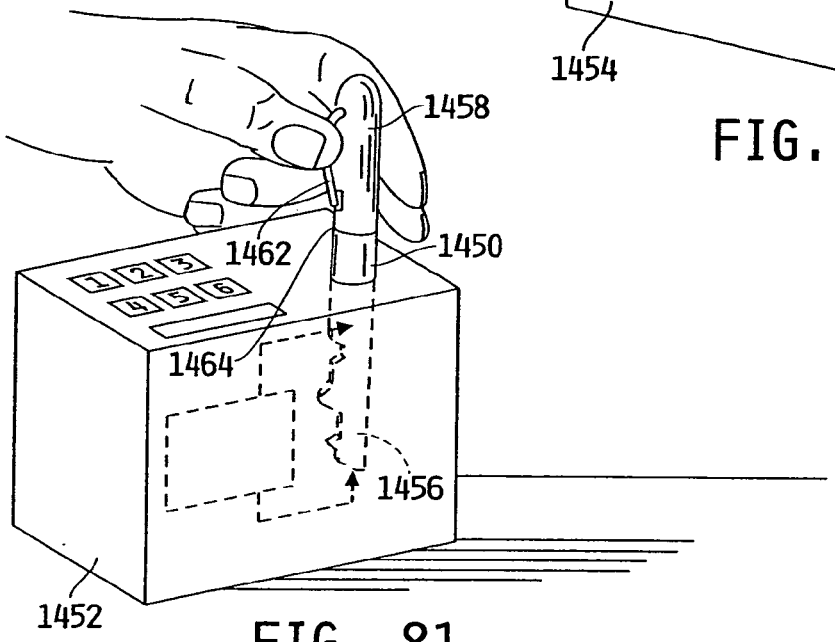
FIG. 81 is a perspective view of an information programmer used to program tokens charged by the power charger shown in FIG. 59.
Figure 82:
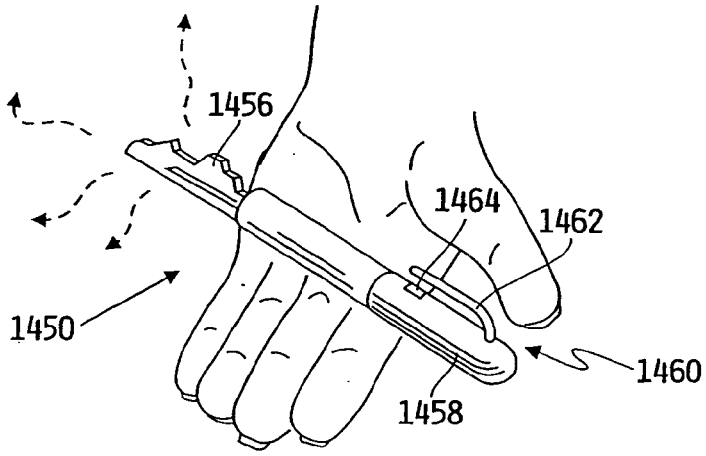
FIG. 82 is a perspective view of a user holding the token, the token including a handle having killswitch and a blade having a mechanical bitted portion and electrical contacts.

Referring to FIGS. 22-24 a fifth embodiment of electronic lock core 512 is illustrated. Lock core 512 includes a mechanical portion 520, electrical portion 522, a key plug or lock actuator 530, and a core body 528. Mechanical portion 520 includes two tumbler pin barrels 536 each containing tumbler pins 544 partially extending into passage or keyway 537 and blocking rotation of key plug 530 relative to core body 528. Electrical portion 522 includes a circuit 552, a electromagnetic actuator 554, a coupling or token communicator 556, and a mechanical linkage 557. As an alternative configuration to previously discussed embodiment of lock core 12, circuit 552 is located within cavity 583 instead of in cavity 559 in face plate 539. Mechanical linkage 557 includes a mechanical energy storage system 573, a ball bearing 533, a cam 535, and a ball bearing-receiving sleeve 541. Mechanical energy storage device 573 includes a semi-spherical ended tumbler 545, a spherical tumbler 577, a lower spring 575, an upper or return spring 587, and a blocker body 589 having an annular indentation 591. As shown FIG. 22, lock actuator 530 and core body 528 cooperate to define a longitudinal passage that receives mechanical energy storage device 573 (including return spring 587 and blocking body 589). Cam 535 is attached to rotatable element 543 of a rotational solenoid 547. Ball bearing 533 is received in sleeve 541 which opens at one end 549 adjacent to blocker body 589 and at the other end 551 adjacent to a cam 535. Cam 535 has a first surface 553, a second surface 555, and an inclined surface 579 extending between the first and second surfaces 553, 555. Cam 535 is positioned so that when ball bearing 533 engages first surface 553 of cam 535, ball bearing 533 is held securely within indentation 591 in blocking body 589.

If token 510 sends a valid access code to electronic core 512, rotational solenoid 547 rotates 180 degrees from the position shown in FIGS. 22-23 to the position shown in FIG. 24. During the rotation of rotatable shaft 543 of rotatable solenoid 547, ball bearing 533 is urged out of indentation 591 by upward motion of blocking body 589 so that ball bearing 533 rides along inclined surface 579 to second surface 555 of cam 535. Blocker body 589 is urged upwardly by the energy previously stored in lower spring 575. Upward movement of blocking body 589 causes blocking body 589 to not be received in blocker-receiving cavity 571 and therefore to not block rotation of the key plug 530 relative to the core body 528. Upward movement of blocker body 589 also compresses upper spring 587 to store energy to facilitate return of blocker body 589 to its blocking state upon removal of bitted blade 546 from keyway 537.

Once blocker body 589 has moved upwardly, ball bearing 533 engages sidewall 588 of blocker body 589 and is squeezed between second surface 555 and side wall 588 mechanically preventing cam 535 and movable element 543 of rotational solenoid 547 from returning to their initial orientations. Although rotatable element 543 is spring 592 biased to return to the position shown in FIGS. 22-23 when no current flows through solenoid 547, it is prevented from doing so by the above squeezing action. Thus, rotational solenoid 547 no longer needs to be energized to maintain it in the non-blocking position allowing power consumption of electrical portion 522 of lock core 512 to be reduced.

When bitted blade 546 is removed form keyway 537, upper spring 587 expands and urges blocking body 589 downwardly into blocker-receiving cavity 571. During this downward movement, ball bearing 533 follows side wall 588 of blocking body 589 until it is forced back into indentation 591 of blocking body 589. Thus no electrical power is consumed to restore lock core 512 to a state in which key plug 530 is prohibited from rotating relative to lock core 528.

As previously mentioned, the circuits 48, 52 and contacts or couplings 50, 56 used in each of the five specifically described embodiments may vary as to their configurations and individual components. Various examples of circuit 48, 52 configurations are illustrated and described in provisional application Ser. No. 60/080,974 that is expressly incorporated by reference. Contacts and couplings 50, 56 including metallic contacts, conductive elastic contacts, capacitive couplings, inductive couplings, optical couplings and combinations of the aforementioned are also illustrated and described in the provisional application. Additional examples of circuits 48, 52 and contacts or couplings 50, 56 are described and illustrated in U.S. Pat. Nos. 5,870,915, 5,870,913, 5,841,363, 5,836,187, 5,826,499, and 5,823,027, the disclosures of which are specifically incorporated herein by reference.

Although the invention has been described in detail with reference to certain preferred embodiments, variations and modifications exist within the scope and spirit of the invention as described and defined in the following claims.

The invention claimed is:

1. A lock system including a core body, a lock actuator coupled to the core body for rotation about an axis, a blocking body movable between a first position blocking rotation of the lock actuator about the axis and a second position permitting rotation of the lock actuator about the axis, a return spring that biases the blocking body toward the first position, a solenoid having a shaft that is movable between a first position in which the blocking body is locked to prevent rotation of the lock actuator about the axis and a second position in which the blocking body is unlocked to allow rotation of the lock actuator about the axis, movement of the shaft of the solenoid permitting biasing of the return spring, and a token couplable to the lock actuator, the solenoid moving the shaft from the first position to the second position after the token is coupled to the lock actuator, wherein mechanical energy transmitted through the token is stored in the return spring.

2. The lock system of claim 1, wherein the blocking body has a longitudinal axis and the return spring extending in the direction along the longitudinal axis of the blocking body, the return spring includes a plurality of coils that are concentric with the longitudinal axis of the return spring, the core body has a longitudinal axis, and the shaft extends in the direction of the longitudinal axis of the core body.

3. The lock system of claim 1, wherein the mechanical energy is transmitted to the return spring after the solenoid moves the shaft to the second position.

4. The lock system of claim 1, wherein the return spring is movable to a contracted position after the shaft of the solenoid moves from the first position.

5. The lock system of claim 1, wherein the blocking body has a longitudinal axis and the return spring is positioned along the longitudinal axis.

6. The lock system of claim 5, wherein the longitudinal axis of the blocking body is perpendicular to the axis of rotation of the lock actuator.

7. The lock system of claim 1, further including a lock cylinder having an interior region and an opening sized to receive the core body, lock actuator, and solenoid.

8. A lock system including a core body having a longitudinal axis, a lock actuator coupled to the core body for rotation about an axis, a blocking body movable between a first position blocking rotation of the lock actuator about the axis and a second position permitting rotation of the lock actuator about the axis, a solenoid having a shaft that extends in the direction of the longitudinal axis of the core body and is movable between a first position in which the blocking body is locked to prevent rotation of the lock actuator about the axis and a second position in which the blocking body is unlocked to allow rotation of the lock actuator about the axis, and a token couplable to the lock actuator to control movement of the shaft between the first and second positions, mechanical energy transmitted through the token urging the blocking body to the second position after the solenoid moves the shaft to the second position.

9. The lock system of claim 8, further comprising a return spring that biases the blocking body toward the first position, energy transmitted through the token being stored in the return spring.

10. The lock system of claim 9, wherein the blocking body has a longitudinal axis and the return spring is positioned along the longitudinal axis of the blocking body.

11. The lock system of claim 10, further including a lock cylinder having an interior region and opening sized to receive the core body, lock actuator, blocking body, and solenoid.

12. The lock system of claim 11, wherein the core body has a figure-8 profile that corresponds to the opening of the lock cylinder.

13. The lock system of claim 8, wherein the token has a power source that provides power to the solenoid when the token is coupled mechanically to the lock actuator.

14. The lock system of claim 13, wherein the token has an electric circuit, the electric circuit includes a clock, and the electric circuit stores data regarding a date and a lime that the token is coupled mechanically to the lock actuator.

15. A lock system including a core body, a lock actuator coupled to the core body for rotation about an axis, a blocking body movable between a first position blocking rotation of the lock actuator about the axis and a second position permitting rotation of the lock actuator about the axis, the blocking body having a longitudinal axis, a return spring extending in the direction of the longitudinal axis of the blocking body that biases the blocking body toward the first position, a solenoid having a shaft movable between a first position in which the blocking body is locked to prevent rotation of the lock actuator about the axis and a second position in which the blocking body is unlocked to allow rotation of the lock actuator about the axis, a lock cylinder having a back, face, interior region, and opening in the face sized to receive the core body, lock actuator, blocking body, and solenoid to permit removal of the core body, lock actuator, blocking body, and solenoid from the face of the lock cylinder, and a token couplable to the lock actuator to control movement of the shaft between the first and second positions.

16. The lock system of claim 15, wherein the token has a power source that provides power to the solenoid when the token is coupled mechanically to the lock actuator.

17. The lock system of claim 16, wherein the lock actuator has a passage that receives a first portion of the token when the token is mechanically coupled to the lock actuator and the power source is carried by a second portion of the token that is situated outside the passage when the token is coupled mechanically to the lock actuator.

18. The lock system of claim 15, wherein the token has an electric circuit, the electric circuit includes a clock, and the electric circuit stores data regarding a date and a time that the token is coupled mechanically to the lock actuator.

19. The lock system of claim 15, wherein the return spring includes coils that are concentric with the longitudinal axis of the blocking body.

20. The lock system of claim 15, wherein the core body and lock actuator cooperate to define a longitudinal passage and the blocking body and the return spring are positioned in the longitudinal passage to permit the blocking body to slide within the longitudinal passage.

21. The lock system of claim 15, further comprising a control lug rotatable relative to the core body between a first position blocking withdraw of the core body from the lock cylinder and a second position permitting withdraw of the core body through the face of the lock cylinder.

22. The lock system of claim 21, wherein core body has a figure8 profile and the opening in the face of the cylinder lock has a corresponding figure-8 profile.

23. The lock system of claim 15, wherein the shaft of the solenoid has a longitudinal axis that is parallel with the axis about which the lock actuator rotates.

24. The lock system of claim 23, wherein the shaft of the solenoid retracts during movement from the first position to the second position.

* * * * *